US008418303B2

(12) United States Patent
Kapoor et al.

(10) Patent No.: US 8,418,303 B2
(45) **Date of Patent: *Apr. 16, 2013**

(54) CLEANING ROBOT ROLLER PROCESSING

(75) Inventors: Deepak Ramesh Kapoor, Cupertino, CA (US); Zivthan A. Dubrovsky, Waltham, MA (US)

(73) Assignee: iRobot Corporation, Bedford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/307,893

(22) Filed: Nov. 30, 2011

(65) Prior Publication Data

US 2012/0159725 A1 Jun. 28, 2012

Related U.S. Application Data

(63) Continuation of application No. 11/751,413, filed on May 21, 2007, now Pat. No. 8,087, 117.

(60) Provisional application No. 60/747,791, filed on May 19, 2006, provisional application No. 60/803,504, filed on May 30, 2006, provisional application No. 60/807,442, filed on Jul. 14, 2006.

(51) Int. Cl.
*A47L 11/00* (2006.01)
*A47L 11/24* (2006.01)

(52) U.S. Cl.
USPC ..... 15/52.1; 15/3

(58) Field of Classification Search ..... 15/319
See application file for complete search history.

(56) References Cited

U.S. PATENT DOCUMENTS 1,755,054 A 4/1930 Darst
1,780,221 A 11/1930 Buchmann
(Continued)

FOREIGN PATENT DOCUMENTS

AU 2003275566 A1 6/2004
DE 2128842 C3 12/1980
(Continued)

OTHER PUBLICATIONS

Borges et al. "Optimal Mobile Robot Pose Estimation Using Geometrical Maps", IEEE Transactions on Robotics and Automation, vol. 18, No. 1, pp. 87-94, Feb. 2002.

(Continued)

*Primary Examiner* — Monica Carter
*Assistant Examiner* — Stephanie N Berry
(74) *Attorney, Agent, or Firm* — Fish & Richardson P.C.

(57) ABSTRACT

A coverage robot includes a chassis, a drive system, and a cleaning assembly. The cleaning assembly includes a housing and at least one driven cleaning roller including an elongated core with end mounting features defining a central longitudinal axis of rotation, multiple floor cleaning bristles extending radially outward from the core, and at least one compliant flap extending radially outward from the core to sweep a floor surface. The flap is configured to prevent errant filaments from spooling tightly about the core to aid subsequent removal of the filaments. In another aspect, a coverage robot includes a chassis, a drive system, a controller, and a cleaning assembly. The cleaning assembly includes a housing and at least one driven cleaning roller. The coverage robot includes a roller cleaning tool carried by the chassis and configured to longitudinally traverse the roller to remove accumulated debris from the cleaning roller.

15 Claims, 26 Drawing Sheets

U.S. PATENT DOCUMENTS

| | | | |
|---|---|---|---|
| 1,970,302 | A | 8/1934 | Gerhardt |
| 2,136,324 | A | 11/1938 | John |
| 2,302,111 | A | 11/1942 | Dow et al. |
| 2,353,621 | A | 7/1944 | Sav et al. |
| 2,770,825 | A | 11/1956 | Pullen |
| 3,119,369 | A | 1/1964 | Harland et al. |
| 3,166,138 | A | 1/1965 | Dunn |
| 3,333,564 | A | 8/1967 | Waters |
| 3,375,375 | A | 3/1968 | Robert et al. |
| 3,381,652 | A | 5/1968 | Schaefer et al. |
| 3,457,575 | A | 7/1969 | Bienek |
| 3,550,714 | A | 12/1970 | Bellinger |
| 3,569,727 | A | 3/1971 | Aggarwal et al. |
| 3,674,316 | A | 7/1972 | De Brey |
| 3,678,882 | A | 7/1972 | Kinsella |
| 3,744,586 | A | 7/1973 | Leinauer |
| 3,756,667 | A | 9/1973 | Bombardier et al. |
| 3,809,004 | A | 5/1974 | Leonheart |
| 3,816,004 | A | 6/1974 | Bignardi |
| 3,845,831 | A | 11/1974 | James |
| RE28,268 | E | 12/1974 | Autrand |
| 3,853,086 | A | 12/1974 | Asplund |
| 3,863,285 | A | 2/1975 | Hukuba |
| 3,888,181 | A | 6/1975 | Kups |
| 3,937,174 | A | 2/1976 | Haaga |
| 3,952,361 | A | 4/1976 | Wilkins |
| 3,989,311 | A | 11/1976 | Debrey |
| 3,989,931 | A | 11/1976 | Phillips |
| 3,993,017 | A | 11/1976 | De Brey |
| 4,004,313 | A | 1/1977 | Capra |
| 4,012,681 | A | 3/1977 | Finger et al. |
| 4,070,170 | A | 1/1978 | Leinfelt |
| 4,099,284 | A | 7/1978 | Shinozaki et al. |
| 4,119,900 | A | 10/1978 | Kremnitz |
| 4,175,589 | A | 11/1979 | Nakamura et al. |
| 4,175,892 | A | 11/1979 | De Brey |
| 4,196,727 | A | 4/1980 | Verkaart et al. |
| 4,198,727 | A | 4/1980 | Farmer |
| 4,199,838 | A | 4/1980 | Simonsson |
| 4,209,254 | A | 6/1980 | Reymond et al. |
| D258,901 | S | 4/1981 | Keyworth |
| 4,297,578 | A | 10/1981 | Carter |
| 4,306,329 | A | 12/1981 | Yokoi |
| 4,309,758 | A | 1/1982 | Halsall et al. |
| 4,328,545 | A | 5/1982 | Halsall et al. |
| 4,367,403 | A | 1/1983 | Miller |
| 4,369,543 | A | 1/1983 | Chen et al. |
| 4,401,909 | A | 8/1983 | Gorsek |
| 4,416,033 | A | 11/1983 | Specht |
| 4,445,245 | A | 5/1984 | Lu |
| 4,465,370 | A | 8/1984 | Yuasa et al. |
| 4,477,998 | A | 10/1984 | You |
| 4,481,692 | A | 11/1984 | Kurz |
| 4,482,960 | A | 11/1984 | Pryor |
| 4,492,058 | A | 1/1985 | Goldfarb et al. |
| 4,513,469 | A * | 4/1985 | Godfrey et al. ..... 15/319 |
| D278,732 | S | 5/1985 | Ohkado |
| 4,518,437 | A | 5/1985 | Sommer |
| 4,534,637 | A | 8/1985 | Suzuki et al. |
| 4,556,313 | A | 12/1985 | Miller et al. |
| 4,575,211 | A | 3/1986 | Matsumura et al. |
| 4,580,311 | A | 4/1986 | Kurz |
| 4,601,082 | A | 7/1986 | Kurz |
| 4,618,213 | A | 10/1986 | Chen |
| 4,620,285 | A | 10/1986 | Perdue |
| 4,624,026 | A | 11/1986 | Olson et al. |
| 4,626,995 | A | 12/1986 | Lofgren et al. |
| 4,628,454 | A | 12/1986 | Ito |
| 4,638,445 | A | 1/1987 | Mattaboni |
| 4,644,156 | A | 2/1987 | Takahashi et al. |
| 4,649,504 | A | 3/1987 | Krouglicof et al. |
| 4,652,917 | A | 3/1987 | Miller |
| 4,654,492 | A | 3/1987 | Koerner et al. |
| 4,654,924 | A | 4/1987 | Getz et al. |
| 4,660,969 | A | 4/1987 | Sorimachi et al. |
| 4,662,854 | A | 5/1987 | Fang |
| 4,674,048 | A | 6/1987 | Okumura |
| 4,679,152 | A | 7/1987 | Perdue |
| 4,680,827 | A | 7/1987 | Hummel |
| 4,696,074 | A | 9/1987 | Cavalli et al. |
| D292,223 | S | 10/1987 | Trumbull |
| 4,700,301 | A | 10/1987 | Dyke |
| 4,700,427 | A | 10/1987 | Knepper |
| 4,703,820 | A | 11/1987 | Reinaud |
| 4,710,020 | A | 12/1987 | Maddox et al. |
| 4,716,621 | A | 1/1988 | Zoni |
| 4,728,801 | A | 3/1988 | O'Connor |
| 4,733,343 | A | 3/1988 | Yoneda et al. |
| 4,733,430 | A | 3/1988 | Westergren |
| 4,733,431 | A | 3/1988 | Martin |
| 4,735,136 | A | 4/1988 | Lee et al. |
| 4,735,138 | A | 4/1988 | Gawler et al. |
| 4,748,336 | A | 5/1988 | Fujie et al. |
| 4,748,833 | A | 6/1988 | Nagasawa |
| 4,756,049 | A | 7/1988 | Uehara |
| 4,767,213 | A | 8/1988 | Hummel |
| 4,769,700 | A | 9/1988 | Pryor |
| 4,777,416 | A | 10/1988 | George, II et al. |
| D298,766 | S | 11/1988 | Tanno et al. |
| 4,782,550 | A | 11/1988 | Jacobs |
| 4,796,198 | A | 1/1989 | Boultinghouse et al. |
| 4,806,751 | A | 2/1989 | Abe et al. |
| 4,811,228 | A | 3/1989 | Hyyppa |
| 4,813,906 | A | 3/1989 | Matsuyama et al. |
| 4,815,157 | A | 3/1989 | Tsuchiya |
| 4,817,000 | A | 3/1989 | Eberhardt |
| 4,818,875 | A | 4/1989 | Weiner |
| 4,829,442 | A | 5/1989 | Kadonoff et al. |
| 4,829,626 | A | 5/1989 | Harkonen et al. |
| 4,832,098 | A | 5/1989 | Palinkas et al. |
| 4,851,661 | A | 7/1989 | Everett |
| 4,854,000 | A | 8/1989 | Takimoto |
| 4,854,006 | A | 8/1989 | Nishimura et al. |
| 4,855,915 | A | 8/1989 | Dallaire |
| 4,857,912 | A | 8/1989 | Everett et al. |
| 4,858,132 | A | 8/1989 | Holmquist |
| 4,867,570 | A | 9/1989 | Sorimachi et al. |
| 4,880,474 | A | 11/1989 | Koharagi et al. |
| 4,887,415 | A | 12/1989 | Martin |
| 4,891,762 | A | 1/1990 | Chotiros |
| 4,893,025 | A | 1/1990 | Lee |
| 4,901,394 | A | 2/1990 | Nakamura et al. |
| 4,905,151 | A | 2/1990 | Weiman et al. |
| 4,912,643 | A | 3/1990 | Beirne |
| 4,918,441 | A | 4/1990 | Bohman |
| 4,919,224 | A | 4/1990 | Shyu et al. |
| 4,919,489 | A | 4/1990 | Kopsco |
| 4,920,060 | A | 4/1990 | Parrent et al. |
| 4,920,605 | A | 5/1990 | Takashima |
| 4,933,864 | A | 6/1990 | Evans et al. |
| 4,937,912 | A | 7/1990 | Kurz |
| 4,953,253 | A | 9/1990 | Fukuda et al. |
| 4,954,962 | A | 9/1990 | Evans et al. |
| 4,955,714 | A | 9/1990 | Stotler et al. |
| 4,956,891 | A | 9/1990 | Wulff |
| 4,961,303 | A | 10/1990 | McCarty et al. |
| 4,961,304 | A | 10/1990 | Ovsborn et al. |
| 4,962,453 | A | 10/1990 | Pong et al. |
| 4,971,591 | A | 11/1990 | Raviv et al. |
| 4,973,912 | A | 11/1990 | Kaminski et al. |
| 4,974,283 | A | 12/1990 | Holsten et al. |
| 4,977,618 | A | 12/1990 | Allen |
| 4,977,639 | A | 12/1990 | Takahashi et al. |
| 4,986,663 | A | 1/1991 | Cecchi et al. |
| 5,001,635 | A | 3/1991 | Yasutomi et al. |
| 5,002,145 | A | 3/1991 | Waqkaumi et al. |
| 5,012,886 | A | 5/1991 | Jonas et al. |
| 5,018,240 | A | 5/1991 | Holman |
| 5,020,186 | A | 6/1991 | Lessig et al. |
| 5,022,812 | A | 6/1991 | Coughlan et al. |
| 5,023,788 | A | 6/1991 | Kitazume et al. |
| 5,024,529 | A | 6/1991 | Svetkoff et al. |
| D318,500 | S | 7/1991 | Malewicki et al. |
| 5,032,775 | A | 7/1991 | Mizuno et al. |
| 5,033,151 | A | 7/1991 | Kraft et al. |
| 5,033,291 | A | 7/1991 | Podoloff et al. |
| 5,040,116 | A | 8/1991 | Evans et al. |

5,045,769 A 9/1991 Everett
5,049,802 A 9/1991 Mintus et al.
5,051,906 A 9/1991 Evans et al.
5,062,819 A 11/1991 Mallory
5,070,567 A 12/1991 Holland
5,084,934 A 2/1992 Lessig et al.
5,086,535 A 2/1992 Grossmeyer et al.
5,090,321 A 2/1992 Abouav
5,093,955 A 3/1992 Blehert et al.
5,094,311 A 3/1992 Akeel
5,105,502 A 4/1992 Takashima
5,105,550 A 4/1992 Shenoha
5,109,566 A 5/1992 Kobayashi et al.
5,115,538 A 5/1992 Cochran et al.
5,127,128 A 7/1992 Lee
5,136,675 A 8/1992 Hodson
5,136,750 A 8/1992 Takashima et al.
5,142,985 A 9/1992 Stearns et al.
5,144,471 A 9/1992 Takanashi et al.
5,144,714 A 9/1992 Mori et al.
5,144,715 A 9/1992 Matsuyo et al.
5,152,028 A 10/1992 Hirano
5,152,202 A 10/1992 Strauss
5,155,684 A 10/1992 Burke et al.
5,163,202 A 11/1992 Kawakami et al.
5,163,320 A 11/1992 Goshima et al.
5,164,579 A 11/1992 Pryor et al.
5,165,064 A 11/1992 Mattaboni
5,170,352 A 12/1992 McTamaney et al.
5,173,881 A 12/1992 Sindle
5,182,833 A 2/1993 Yamaguchi et al.
5,202,742 A 4/1993 Frank et al.
5,204,814 A 4/1993 Noonan et al.
5,206,500 A 4/1993 Decker et al.
5,208,521 A 5/1993 Aoyama
5,216,777 A 6/1993 Moro et al.
5,227,985 A 7/1993 DeMenthon
5,233,682 A 8/1993 Abe et al.
5,239,720 A 8/1993 Wood et al.
5,251,358 A 10/1993 Moro et al.
5,261,139 A 11/1993 Lewis
5,276,618 A 1/1994 Everett
5,276,939 A 1/1994 Uenishi
5,277,064 A 1/1994 Knigga et al.
5,279,672 A 1/1994 Betker et al.
5,284,452 A 2/1994 Corona
5,284,522 A 2/1994 Kobayashi et al.
5,293,955 A 3/1994 Lee
D345,707 S 4/1994 Alister
5,303,448 A 4/1994 Hennessey et al.
5,307,273 A 4/1994 Oh et al.
5,309,592 A 5/1994 Hiratsuka
5,310,379 A 5/1994 Hippely et al.
5,315,227 A 5/1994 Pierson et al.
5,319,827 A 6/1994 Yang
5,319,828 A 6/1994 Waldhauser et al.
5,321,614 A 6/1994 Ashworth
5,323,483 A 6/1994 Baeg
5,324,948 A 6/1994 Dudar et al.
5,341,186 A 8/1994 Kato
5,341,540 A 8/1994 Soupert et al.
5,341,549 A 8/1994 Wirtz et al.
5,345,649 A 9/1994 Whitlow
5,353,224 A 10/1994 Lee et al.
5,363,305 A 11/1994 Cox et al.
5,363,935 A 11/1994 Schempf et al.
5,369,347 A 11/1994 Yoo
5,369,838 A 12/1994 Wood et al.
5,386,862 A 2/1995 Glover et al.
5,399,951 A 3/1995 Lavallee et al.
5,400,244 A 3/1995 Watanabe et al.
5,404,612 A 4/1995 Ishikawa
5,410,479 A 4/1995 Coker
5,435,405 A 7/1995 Schempf et al.
5,440,216 A 8/1995 Kim
5,442,358 A 8/1995 Keeler et al.
5,444,965 A 8/1995 Colens
5,446,356 A 8/1995 Kim
5,446,445 A 8/1995 Bloomfield et al.
5,451,135 A 9/1995 Schempf et al.
5,454,129 A 10/1995 Kell
5,455,982 A 10/1995 Armstrong et al.
5,465,525 A 11/1995 Mifune et al.
5,465,619 A 11/1995 Sotack et al.
5,467,273 A 11/1995 Faibish et al.
5,471,560 A 11/1995 Allard et al.
5,491,670 A 2/1996 Weber
5,497,529 A 3/1996 Boesi
5,498,948 A 3/1996 Bruni et al.
5,502,638 A 3/1996 Takenaka
5,505,072 A 4/1996 Oreper
5,507,067 A 4/1996 Hoekstra et al.
5,510,893 A 4/1996 Suzuki
5,511,147 A 4/1996 Abdel
5,515,572 A 5/1996 Hoekstra et al.
5,534,762 A 7/1996 Kim
5,537,017 A 7/1996 Feiten et al.
5,537,711 A 7/1996 Tseng
5,539,953 A 7/1996 Kurz
5,542,146 A 8/1996 Hoekstra et al.
5,542,148 A 8/1996 Young
5,546,631 A 8/1996 Chambon
5,548,511 A 8/1996 Bancroft
5,551,525 A 9/1996 Pack et al.
5,553,349 A 9/1996 Kilstrom et al.
5,555,587 A 9/1996 Guha
5,560,077 A 10/1996 Crotchett
5,568,589 A 10/1996 Hwang
D375,592 S 11/1996 Ljunggren
5,608,306 A 3/1997 Rybeck et al.
5,608,894 A 3/1997 Kawakami et al.
5,608,944 A 3/1997 Gordon
5,610,488 A 3/1997 Miyazawa
5,611,106 A 3/1997 Wulff
5,611,108 A 3/1997 Knowlton et al.
5,613,261 A 3/1997 Kawakami et al.
5,613,269 A 3/1997 Miwa
5,621,291 A 4/1997 Lee
5,622,236 A 4/1997 Azumi et al.
5,634,237 A 6/1997 Paranjpe
5,634,239 A 6/1997 Tuvin et al.
5,636,402 A 6/1997 Kubo et al.
5,642,299 A 6/1997 Hardin et al.
5,646,494 A 7/1997 Han
5,647,554 A 7/1997 Ikegami et al.
5,650,702 A 7/1997 Azumi
5,652,489 A 7/1997 Kawakami
5,682,313 A 10/1997 Edlund et al.
5,682,839 A 11/1997 Grimsley et al.
5,696,675 A 12/1997 Nakamura et al.
5,698,861 A 12/1997 Oh
5,709,007 A 1/1998 Chiang
5,710,506 A 1/1998 Broell et al.
5,714,119 A 2/1998 Kawagoe et al.
5,717,169 A 2/1998 Liang et al.
5,717,484 A 2/1998 Hamaguchi et al.
5,720,077 A 2/1998 Nakamura et al.
5,732,401 A 3/1998 Conway
5,735,959 A 4/1998 Kubo et al.
5,745,235 A 4/1998 Vercammen et al.
5,752,871 A 5/1998 Tsuzuki
5,756,904 A 5/1998 Oreper et al.
5,761,762 A 6/1998 Kubo et al.
5,764,888 A 6/1998 Bolan et al.
5,767,437 A 6/1998 Rogers
5,767,960 A 6/1998 Orman
5,777,596 A 7/1998 Herbert
5,778,486 A 7/1998 Kim
5,781,697 A 7/1998 Jeong
5,781,960 A 7/1998 Kilstrom et al.
5,786,602 A 7/1998 Pryor et al.
5,787,545 A 8/1998 Colens
5,793,900 A 8/1998 Nourbakhsh et al.
5,794,297 A 8/1998 Muta
5,812,267 A 9/1998 Everett et al.
5,814,808 A 9/1998 Takada et al.
5,815,880 A 10/1998 Nakanishi
5,815,884 A 10/1998 Imamura et al.

5,819,008 A 10/1998 Asama et al.
5,819,360 A 10/1998 Fujii
5,819,936 A 10/1998 Saveliev et al.
5,820,821 A 10/1998 Kawagoe et al.
5,821,730 A 10/1998 Drapkin
5,825,981 A 10/1998 Matsuda
5,828,770 A 10/1998 Leis et al.
5,831,597 A 11/1998 West et al.
5,839,156 A 11/1998 Park et al.
5,839,532 A 11/1998 Yoshiji et al.
5,841,259 A 11/1998 Kim et al.
5,867,800 A 2/1999 Leif
5,869,910 A 2/1999 Colens
5,896,611 A 4/1999 Haaga
5,903,124 A 5/1999 Kawakami
5,905,209 A 5/1999 Oreper
5,907,886 A 6/1999 Buscher
5,910,700 A 6/1999 Crotzer
5,911,260 A 6/1999 Suzuki
5,916,008 A 6/1999 Wong
5,924,167 A 7/1999 Wright et al.
5,926,909 A 7/1999 McGee
5,933,102 A 8/1999 Miller et al.
5,933,913 A 8/1999 Wright et al.
5,935,179 A 8/1999 Kleiner et al.
5,940,346 A 8/1999 Sadowsky et al.
5,940,927 A 8/1999 Haegermarck et al.
5,940,930 A 8/1999 Oh et al.
5,942,869 A 8/1999 Katou et al.
5,943,730 A 8/1999 Boomgaarden
5,943,733 A 8/1999 Tagliaferri
5,947,225 A 9/1999 Kawakami et al.
5,950,408 A 9/1999 Schaedler
5,959,423 A 9/1999 Nakanishi et al.
5,968,281 A 10/1999 Wright et al.
5,974,348 A 10/1999 Rocks
5,974,365 A 10/1999 Mitchell
5,983,448 A 11/1999 Wright et al.
5,984,880 A 11/1999 Lander et al.
5,987,383 A 11/1999 Keller et al.
5,989,700 A 11/1999 Krivopal
5,991,951 A 11/1999 Kubo et al.
5,995,883 A 11/1999 Nishikado
5,995,884 A 11/1999 Allen et al.
5,996,167 A 12/1999 Close
5,998,953 A 12/1999 Nakamura et al.
5,998,971 A 12/1999 Corbridge
6,000,088 A 12/1999 Wright et al.
6,009,358 A 12/1999 Angott et al.
6,021,545 A 2/2000 Delgado et al.
6,023,813 A 2/2000 Thatcher et al.
6,023,814 A 2/2000 Imamura
6,025,687 A 2/2000 Himeda et al.
6,026,539 A 2/2000 Mouw et al.
6,030,464 A 2/2000 Azevedo
6,030,465 A 2/2000 Marcussen et al.
6,032,542 A 3/2000 Warnick et al.
6,036,572 A 3/2000 Sze
6,038,501 A 3/2000 Kawakami
6,040,669 A 3/2000 Hog
6,041,471 A 3/2000 Charky et al.
6,041,472 A 3/2000 Kasen et al.
6,046,800 A 4/2000 Ohtomo et al.
6,049,620 A 4/2000 Dickinson et al.
6,052,821 A 4/2000 Chouly et al.
6,055,042 A 4/2000 Sarangapani
6,055,702 A 5/2000 Imamura et al.
6,061,868 A 5/2000 Moritsch et al.
6,065,182 A 5/2000 Wright et al.
6,073,432 A 6/2000 Schaedler
6,076,025 A 6/2000 Ueno et al.
6,076,026 A 6/2000 Jambhekar et al.
6,076,226 A 6/2000 Reed
6,076,227 A 6/2000 Schallig et al.
6,081,257 A 6/2000 Zeller
6,088,020 A 7/2000 Mor
6,094,775 A 8/2000 Behmer
6,099,091 A 8/2000 Campbell
6,101,670 A 8/2000 Song
6,101,671 A 8/2000 Wright et al.
6,108,031 A 8/2000 King et al.
6,108,067 A 8/2000 Okamoto
6,108,076 A 8/2000 Hanseder
6,108,269 A 8/2000 Kabel
6,108,597 A 8/2000 Kirchner et al.
6,112,143 A 8/2000 Allen et al.
6,112,996 A 9/2000 Matsuo
6,119,057 A 9/2000 Kawagoe
6,122,798 A 9/2000 Kobayashi et al.
6,124,694 A 9/2000 Bancroft et al.
6,125,498 A 10/2000 Roberts et al.
6,131,237 A 10/2000 Kasper et al.
6,138,063 A 10/2000 Himeda
6,142,252 A 11/2000 Kinto et al.
6,146,278 A 11/2000 Kobayashi
6,154,279 A 11/2000 Thayer
6,154,694 A 11/2000 Aoki et al.
6,160,479 A 12/2000 Ahlen et al.
6,167,332 A 12/2000 Kurtzberg et al.
6,167,587 B1 1/2001 Kasper et al.
6,192,548 B1 2/2001 Huffman
6,216,307 B1 4/2001 Kaleta et al.
6,220,865 B1 4/2001 Macri et al.
6,226,830 B1 5/2001 Hendriks et al.
6,230,362 B1 5/2001 Kasper et al.
6,237,741 B1 5/2001 Guidetti
6,240,342 B1 5/2001 Fiegert et al.
6,243,913 B1 6/2001 Frank et al.
6,255,793 B1 7/2001 Peless et al.
6,259,979 B1 7/2001 Holmquist
6,261,379 B1 7/2001 Conrad et al.
6,263,539 B1 7/2001 Baig
6,263,989 B1 7/2001 Won
6,272,936 B1 8/2001 Oreper et al.
6,276,478 B1 8/2001 Hopkins et al.
6,278,918 B1 8/2001 Dickson et al.
6,282,526 B1 8/2001 Ganesh
6,283,034 B1 9/2001 Miles
6,285,778 B1 9/2001 Nakajima et al.
6,285,930 B1 9/2001 Dickson et al.
6,300,737 B1 10/2001 Bergvall et al.
6,321,337 B1 11/2001 Reshef et al.
6,321,515 B1 11/2001 Colens
6,323,570 B1 11/2001 Nishimura et al.
6,324,714 B1 12/2001 Walz et al.
6,327,741 B1 12/2001 Reed
6,332,400 B1 12/2001 Meyer
6,339,735 B1 1/2002 Peless et al.
6,362,875 B1 3/2002 Burkley
6,370,453 B2 4/2002 Sommer
6,374,155 B1 4/2002 Wallach et al.
6,374,157 B1 4/2002 Takamura
6,381,802 B2 5/2002 Park
6,385,515 B1 5/2002 Dickson et al.
6,388,013 B1 5/2002 Saraf et al.
6,389,329 B1 5/2002 Colens
6,400,048 B1 6/2002 Nishimura et al.
6,401,294 B2 6/2002 Kasper
6,408,226 B1 6/2002 Byrne et al.
6,412,141 B2 7/2002 Kasper et al.
6,415,203 B1 7/2002 Inoue et al.
6,421,870 B1 7/2002 Basham et al.
6,427,285 B1 8/2002 Legatt et al.
6,430,471 B1 8/2002 Kintou et al.
6,431,296 B1 8/2002 Won
6,437,227 B1 8/2002 Theimer
6,437,465 B1 8/2002 Nishimura et al.
6,438,456 B1 8/2002 Feddema et al.
6,438,793 B1 8/2002 Miner et al.
6,442,476 B1 8/2002 Poropat
6,443,509 B1 9/2002 Levin et al.
6,444,003 B1 9/2002 Sutcliffe
6,446,302 B1 9/2002 Kasper et al.
6,454,036 B1 9/2002 Airey et al.
D464,091 S 10/2002 Christianson
6,457,206 B1 10/2002 Judson
6,459,955 B1 10/2002 Bartsch et al.
6,463,368 B1 10/2002 Feiten et al.

6,465,982 B1 10/2002 Bergvall et al.
6,473,167 B1 10/2002 Odell
6,480,762 B1 11/2002 Uchikubo et al.
6,481,515 B1 11/2002 Kirkpatrick et al.
6,490,539 B1 12/2002 Dickson et al.
6,491,127 B1 12/2002 Holmberg et al.
6,493,612 B1 12/2002 Bisset et al.
6,493,613 B2 12/2002 Peless et al.
6,496,754 B2 12/2002 Song et al.
6,496,755 B2 12/2002 Wallach et al.
6,502,657 B2 1/2003 Kerrebrock et al.
6,504,610 B1 1/2003 Bauer et al.
6,507,773 B2 1/2003 Parker et al.
6,525,509 B1 2/2003 Petersson et al.
D471,243 S 3/2003 Cioffi et al.
6,532,404 B2 3/2003 Colens
6,535,793 B2 3/2003 Allard
6,540,607 B2 4/2003 Mokris et al.
6,548,982 B1 4/2003 Papanikolopoulos et al.
6,553,612 B1 4/2003 Dyson et al.
6,556,722 B1 4/2003 Russell et al.
6,556,892 B2 4/2003 Kuroki et al.
6,557,104 B2 4/2003 Vu et al.
D474,312 S 5/2003 Stephens et al.
6,563,130 B2 5/2003 Dworkowski et al.
6,571,415 B2 6/2003 Gerber et al.
6,571,422 B1 6/2003 Gordon et al.
6,572,711 B2 6/2003 Sclafani et al.
6,574,536 B1 6/2003 Kawagoe et al.
6,580,246 B2 6/2003 Jacobs
6,584,376 B1 6/2003 Van
6,586,908 B2 7/2003 Petersson et al.
6,587,573 B1 7/2003 Stam et al.
6,590,222 B1 7/2003 Bisset et al.
6,594,551 B2 7/2003 McKinney et al.
6,594,844 B2 7/2003 Jones
D478,884 S 8/2003 Slipy et al.
6,601,265 B1 8/2003 Burlington
6,604,021 B2 8/2003 Imai et al.
6,604,022 B2 8/2003 Parker et al.
6,605,156 B1 8/2003 Clark et al.
6,611,120 B2 8/2003 Song et al.
6,611,734 B2 8/2003 Parker et al.
6,611,738 B2 8/2003 Ruffner
6,615,108 B1 9/2003 Peless et al.
6,615,885 B1 9/2003 Ohm
6,622,465 B2 9/2003 Jerome et al.
6,624,744 B1 9/2003 Wilson et al.
6,625,843 B2 9/2003 Kim et al.
6,629,028 B2 9/2003 Paromtchik et al.
6,639,659 B2 10/2003 Granger
6,658,325 B2 12/2003 Zweig
6,658,354 B2 12/2003 Lin
6,658,692 B2 12/2003 Lenkiewicz et al.
6,658,693 B1 12/2003 Reed, Jr.
6,661,239 B1 12/2003 Ozick
6,662,889 B2 12/2003 De et al.
6,668,951 B2 12/2003 Won
6,670,817 B2 12/2003 Fournier et al.
6,671,592 B1 12/2003 Bisset et al.
6,687,571 B1 2/2004 Byrne et al.
6,690,134 B1 2/2004 Jones et al.
6,690,993 B2 2/2004 Foulke et al.
6,697,147 B2 2/2004 Ko et al.
6,711,280 B2 3/2004 Stafsudd et al.
6,732,826 B2 5/2004 Song et al.
6,737,591 B1 5/2004 Lapstun et al.
6,741,054 B2 5/2004 Koselka et al.
6,741,364 B2 5/2004 Lange et al.
6,748,297 B2 6/2004 Song et al.
6,756,703 B2 6/2004 Chang
6,760,647 B2 7/2004 Nourbakhsh et al.
6,764,373 B1 7/2004 Osawa et al.
6,769,004 B2 7/2004 Barrett
6,774,596 B1 8/2004 Bisset
6,779,380 B1 8/2004 Nieuwkamp
6,781,338 B2 8/2004 Jones et al.
6,809,490 B2 10/2004 Jones et al.
6,810,305 B2 10/2004 Kirkpatrick
6,830,120 B1 12/2004 Yashima et al.
6,832,407 B2 12/2004 Salem et al.
6,836,701 B2 12/2004 McKee
6,841,963 B2 1/2005 Song et al.
6,845,297 B2 1/2005 Allard
6,856,811 B2 2/2005 Burdue et al.
6,859,010 B2 2/2005 Jeon et al.
6,859,682 B2 2/2005 Naka et al.
6,860,206 B1 3/2005 Rudakevych et al.
6,865,447 B2 3/2005 Lau et al.
6,870,792 B2 3/2005 Chiappetta
6,871,115 B2 3/2005 Huang et al.
6,883,201 B2 * 4/2005 Jones et al. ..... 15/319
6,886,651 B1 5/2005 Slocum et al.
6,888,333 B2 5/2005 Laby
6,901,624 B2 6/2005 Mori et al.
6,906,702 B1 6/2005 Tanaka et al.
6,914,403 B2 7/2005 Tsurumi
6,917,854 B2 7/2005 Bayer
6,925,357 B2 8/2005 Wang et al.
6,925,679 B2 8/2005 Wallach et al.
6,929,548 B2 8/2005 Wang
D510,066 S 9/2005 Hickey et al.
6,938,298 B2 9/2005 Aasen
6,940,291 B1 9/2005 Ozick
6,941,199 B1 9/2005 Bottomley et al.
6,956,348 B2 10/2005 Landry et al.
6,957,712 B2 10/2005 Song et al.
6,960,986 B2 11/2005 Asama et al.
6,965,209 B2 11/2005 Jones et al.
6,965,211 B2 11/2005 Tsurumi
6,968,592 B2 11/2005 Takeuchi et al.
6,971,140 B2 12/2005 Kim
6,975,246 B1 12/2005 Trudeau
6,980,229 B1 12/2005 Ebersole
6,985,556 B2 1/2006 Shanmugavel et al.
6,993,954 B1 2/2006 George et al.
6,999,850 B2 2/2006 McDonald
7,013,527 B2 3/2006 Thomas et al.
7,024,278 B2 4/2006 Chiapetta et al.
7,024,280 B2 4/2006 Parker et al.
7,027,893 B2 4/2006 Perry et al.
7,030,768 B2 4/2006 Wanie
7,031,805 B2 4/2006 Lee et al.
7,032,469 B2 4/2006 Bailey
7,053,578 B2 5/2006 Diehl et al.
7,054,716 B2 5/2006 McKee et al.
7,055,210 B2 6/2006 Keppler et al.
7,057,120 B2 6/2006 Ma et al.
7,057,643 B2 6/2006 Iida et al.
7,065,430 B2 6/2006 Naka et al.
7,066,291 B2 6/2006 Martins et al.
7,069,124 B1 6/2006 Whittaker et al.
7,079,923 B2 7/2006 Abramson et al.
7,085,623 B2 8/2006 Siegers
7,085,624 B2 8/2006 Aldred et al.
7,113,847 B2 9/2006 Chmura et al.
7,133,746 B2 11/2006 Abramson et al.
7,142,198 B2 11/2006 Lee
7,148,458 B2 12/2006 Schell et al.
7,155,308 B2 12/2006 Jones
7,167,775 B2 1/2007 Abramson et al.
7,171,285 B2 1/2007 Kim et al.
7,173,391 B2 2/2007 Jones et al.
7,174,238 B1 2/2007 Zweig
7,188,000 B2 3/2007 Chiappetta et al.
7,193,384 B1 3/2007 Norman et al.
7,196,487 B2 3/2007 Jones et al.
7,201,786 B2 4/2007 Wegelin et al.
7,206,677 B2 4/2007 Hulden
7,211,980 B1 5/2007 Bruemmer et al.
7,225,500 B2 6/2007 Diehl et al.
7,246,405 B2 7/2007 Yan
7,248,951 B2 7/2007 Huldén
7,275,280 B2 10/2007 Haegermarck et al.
7,283,892 B1 10/2007 Boillot et al.
7,288,912 B2 10/2007 Landry et al.
7,318,248 B1 1/2008 Yan
7,320,149 B1 1/2008 Huffman et al.

7,324,870 B2 1/2008 Lee
7,328,196 B2 2/2008 Peters
7,332,890 B2 2/2008 Cohen et al.
7,352,153 B2 4/2008 Yan
7,359,766 B2 4/2008 Jeon et al.
7,360,277 B2 4/2008 Moshenrose et al.
7,363,108 B2 4/2008 Noda et al.
7,388,879 B2 6/2008 Sabe et al.
7,389,166 B2 6/2008 Harwig et al.
7,408,157 B2 8/2008 Yan
7,418,762 B2 9/2008 Arai et al.
7,430,455 B2 9/2008 Casey et al.
7,430,462 B2 9/2008 Chiu et al.
7,441,298 B2 10/2008 Svendsen et al.
7,444,206 B2 10/2008 Abramson et al.
7,448,113 B2 11/2008 Jones et al.
7,459,871 B2 12/2008 Landry et al.
7,467,026 B2 12/2008 Sakagami et al.
7,474,941 B2 1/2009 Kim et al.
7,503,096 B2 3/2009 Lin
7,515,991 B2 4/2009 Egawa et al.
7,555,363 B2 6/2009 Augenbraun et al.
7,557,703 B2 7/2009 Yamada et al.
7,568,259 B2 8/2009 Yan
7,571,511 B2 8/2009 Jones et al.
7,578,020 B2 8/2009 Jaworski et al.
7,600,521 B2 10/2009 Woo
7,603,744 B2 10/2009 Reindle
7,617,557 B2 11/2009 Reindle
7,620,476 B2 11/2009 Morse et al.
7,636,982 B2 12/2009 Jones et al.
7,647,144 B2 1/2010 Haegermarck
7,650,666 B2 1/2010 Jang
7,660,650 B2 2/2010 Kawagoe et al.
7,663,333 B2 2/2010 Jones et al.
7,693,605 B2 4/2010 Park
7,706,917 B1 4/2010 Chiappetta et al.
7,765,635 B2 8/2010 Park
7,801,645 B2 9/2010 Taylor et al.
7,805,220 B2 9/2010 Taylor et al.
7,809,944 B2 10/2010 Kawamoto
7,849,555 B2 12/2010 Hahm et al.
7,853,645 B2 12/2010 Brown et al.
7,920,941 B2 4/2011 Park et al.
7,937,800 B2 5/2011 Yan
7,957,836 B2 6/2011 Myeong et al.
8,087,117 B2 * 1/2012 Kapoor et al. ..... 15/52.1
2001/0004719 A1 6/2001 Sommer
2001/0013929 A1 8/2001 Torsten
2001/0020200 A1 9/2001 Das et al.
2001/0025183 A1 9/2001 Shahidi
2001/0037163 A1 11/2001 Allard
2001/0043509 A1 11/2001 Green et al.
2001/0045883 A1 11/2001 Holdaway et al.
2001/0047231 A1 11/2001 Peless et al.
2001/0047895 A1 12/2001 De Fazio et al.
2002/0011367 A1 1/2002 Kolesnik
2002/0011813 A1 1/2002 Koselka et al.
2002/0016649 A1 2/2002 Jones
2002/0021219 A1 2/2002 Edwards
2002/0027652 A1 3/2002 Paromtchik et al.
2002/0036779 A1 3/2002 Kiyoi et al.
2002/0081937 A1 6/2002 Yamada et al.
2002/0095239 A1 7/2002 Wallach et al.
2002/0097400 A1 7/2002 Jung et al.
2002/0104963 A1 8/2002 Mancevski
2002/0108209 A1 8/2002 Peterson
2002/0112742 A1 8/2002 Bredo et al.
2002/0113973 A1 8/2002 Ge
2002/0116089 A1 8/2002 Kirkpatrick
2002/0120364 A1 8/2002 Colens
2002/0124343 A1 9/2002 Reed
2002/0153185 A1 10/2002 Song et al.
2002/0156556 A1 10/2002 Ruffner
2002/0159051 A1 10/2002 Guo
2002/0166193 A1 11/2002 Kasper
2002/0169521 A1 11/2002 Goodman et al.
2002/0173877 A1 11/2002 Zweig
2002/0189871 A1 12/2002 Won
2003/0009259 A1 1/2003 Hattori et al.
2003/0019071 A1 1/2003 Field et al.
2003/0023356 A1 1/2003 Keable
2003/0024986 A1 2/2003 Mazz et al.
2003/0025472 A1 2/2003 Jones et al.
2003/0028286 A1 2/2003 Glenn et al.
2003/0030399 A1 2/2003 Jacobs
2003/0058262 A1 3/2003 Sato et al.
2003/0060928 A1 3/2003 Abramson et al.
2003/0067451 A1 4/2003 Tagg et al.
2003/0097875 A1 5/2003 Lentz et al.
2003/0120389 A1 6/2003 Abramson et al.
2003/0124312 A1 7/2003 Autumn
2003/0126352 A1 7/2003 Barrett
2003/0137268 A1 7/2003 Papanikolopoulos et al.
2003/0146384 A1 8/2003 Logsdon et al.
2003/0192144 A1 10/2003 Song et al.
2003/0193657 A1 10/2003 Uomori et al.
2003/0216834 A1 11/2003 Allard
2003/0221114 A1 11/2003 Hino et al.
2003/0229421 A1 12/2003 Chmura et al.
2003/0229474 A1 12/2003 Suzuki et al.
2003/0233171 A1 12/2003 Heiligensetzer
2003/0233177 A1 12/2003 Johnson et al.
2003/0233870 A1 12/2003 Mancevski
2003/0233930 A1 12/2003 Ozick
2004/0016077 A1 1/2004 Song et al.
2004/0020000 A1 2/2004 Jones
2004/0030448 A1 2/2004 Solomon
2004/0030449 A1 2/2004 Solomon
2004/0030450 A1 2/2004 Solomon
2004/0030451 A1 2/2004 Solomon
2004/0030570 A1 2/2004 Solomon
2004/0030571 A1 2/2004 Solomon
2004/0031113 A1 2/2004 Wosewick et al.
2004/0049877 A1 3/2004 Jones et al.
2004/0055163 A1 3/2004 McCambridge et al.
2004/0068351 A1 4/2004 Solomon
2004/0068415 A1 4/2004 Solomon
2004/0068416 A1 4/2004 Solomon
2004/0074038 A1 4/2004 Im et al.
2004/0074044 A1 4/2004 Diehl et al.
2004/0076324 A1 4/2004 Burl et al.
2004/0083570 A1 5/2004 Song et al.
2004/0085037 A1 5/2004 Jones et al.
2004/0088079 A1 5/2004 Lavarec et al.
2004/0093122 A1 5/2004 Galibraith
2004/0098167 A1 5/2004 Yi et al.
2004/0111184 A1 6/2004 Chiappetta et al.
2004/0111821 A1 6/2004 Lenkiewicz et al.
2004/0113777 A1 6/2004 Matsuhira et al.
2004/0117064 A1 6/2004 McDonald
2004/0117846 A1 6/2004 Karaoguz et al.
2004/0118998 A1 6/2004 Wingett et al.
2004/0128028 A1 7/2004 Miyamoto et al.
2004/0133316 A1 7/2004 Dean
2004/0134336 A1 7/2004 Solomon
2004/0134337 A1 7/2004 Solomon
2004/0143919 A1 7/2004 Wilder
2004/0148419 A1 7/2004 Chen et al.
2004/0148731 A1 8/2004 Damman et al.
2004/0153212 A1 8/2004 Profio et al.
2004/0156541 A1 8/2004 Jeon et al.
2004/0158357 A1 8/2004 Lee et al.
2004/0181706 A1 9/2004 Chen et al.
2004/0187249 A1 9/2004 Jones et al.
2004/0187457 A1 9/2004 Colens
2004/0196451 A1 10/2004 Aoyama
2004/0200505 A1 10/2004 Taylor et al.
2004/0204792 A1 10/2004 Taylor et al.
2004/0210345 A1 10/2004 Noda et al.
2004/0210347 A1 10/2004 Sawada et al.
2004/0211444 A1 10/2004 Taylor et al.
2004/0221790 A1 11/2004 Sinclair et al.
2004/0236468 A1 11/2004 Taylor et al.
2004/0244138 A1 12/2004 Taylor et al.
2004/0255425 A1 12/2004 Arai et al.
2005/0000543 A1 1/2005 Taylor et al.
2005/0010330 A1 1/2005 Abramson et al.

| | | | |
|---|---|---|---|
| 2005/0010331 | A1 | 1/2005 | Taylor et al. |
| 2005/0021181 | A1 | 1/2005 | Kim et al. |
| 2005/0067994 | A1 | 3/2005 | Jones et al. |
| 2005/0085947 | A1 | 4/2005 | Aldred et al. |
| 2005/0137749 | A1 | 6/2005 | Jeon et al. |
| 2005/0144751 | A1 | 7/2005 | Kegg et al. |
| 2005/0150074 | A1 | 7/2005 | Diehl et al. |
| 2005/0150519 | A1 | 7/2005 | Keppler et al. |
| 2005/0154795 | A1 | 7/2005 | Kuz et al. |
| 2005/0156562 | A1 | 7/2005 | Cohen et al. |
| 2005/0165508 | A1 | 7/2005 | Kanda et al. |
| 2005/0166354 | A1 | 8/2005 | Uehigashi |
| 2005/0166355 | A1 | 8/2005 | Tani |
| 2005/0172445 | A1 | 8/2005 | Diehl et al. |
| 2005/0183229 | A1 | 8/2005 | Uehigashi |
| 2005/0183230 | A1 | 8/2005 | Uehigashi |
| 2005/0187678 | A1 | 8/2005 | Myeong et al. |
| 2005/0192707 | A1 | 9/2005 | Park et al. |
| 2005/0204717 | A1 | 9/2005 | Colens |
| 2005/0209736 | A1 | 9/2005 | Kawagoe |
| 2005/0211880 | A1 | 9/2005 | Schell et al. |
| 2005/0212929 | A1 | 9/2005 | Schell et al. |
| 2005/0213082 | A1 | 9/2005 | DiBernardo et al. |
| 2005/0213109 | A1 | 9/2005 | Schell et al. |
| 2005/0217042 | A1 | 10/2005 | Reindle |
| 2005/0218852 | A1 | 10/2005 | Landry et al. |
| 2005/0222933 | A1 | 10/2005 | Wesby |
| 2005/0229340 | A1 | 10/2005 | Sawalski et al. |
| 2005/0229355 | A1 | 10/2005 | Crouch et al. |
| 2005/0235451 | A1 | 10/2005 | Yan |
| 2005/0251292 | A1 | 11/2005 | Casey et al. |
| 2005/0255425 | A1 | 11/2005 | Pierson |
| 2005/0258154 | A1 | 11/2005 | Blankenship et al. |
| 2005/0273967 | A1 | 12/2005 | Taylor et al. |
| 2005/0288819 | A1 | 12/2005 | de Guzman |
| 2006/0000050 | A1 | 1/2006 | Cipolla et al. |
| 2006/0010638 | A1 | 1/2006 | Shimizu et al. |
| 2006/0020369 | A1 | 1/2006 | Taylor et al. |
| 2006/0020370 | A1 | 1/2006 | Abramson |
| 2006/0021168 | A1 | 2/2006 | Nishikawa |
| 2006/0025134 | A1 | 2/2006 | Cho et al. |
| 2006/0037170 | A1 | 2/2006 | Shimizu |
| 2006/0042042 | A1 | 3/2006 | Mertes et al. |
| 2006/0044546 | A1 | 3/2006 | Lewin et al. |
| 2006/0060216 | A1 | 3/2006 | Woo et al. |
| 2006/0061657 | A1 | 3/2006 | Rew et al. |
| 2006/0064828 | A1 | 3/2006 | Stein et al. |
| 2006/0087273 | A1 | 4/2006 | Ko et al. |
| 2006/0089765 | A1 | 4/2006 | Pack et al. |
| 2006/0100741 | A1 | 5/2006 | Jung |
| 2006/0119839 | A1 | 6/2006 | Bertin et al. |
| 2006/0143295 | A1 | 6/2006 | Costa et al. |
| 2006/0146776 | A1 | 7/2006 | Kim |
| 2006/0190133 | A1 | 8/2006 | Konandreas et al. |
| 2006/0190146 | A1 | 8/2006 | Morse et al. |
| 2006/0196003 | A1 | 9/2006 | Song et al. |
| 2006/0220900 | A1 | 10/2006 | Ceskutti et al. |
| 2006/0259194 | A1 | 11/2006 | Chiu |
| 2006/0259494 | A1 | 11/2006 | Watson et al. |
| 2006/0288519 | A1 | 12/2006 | Jaworski et al. |
| 2006/0293787 | A1 | 12/2006 | Kanda et al. |
| 2007/0006404 | A1 | 1/2007 | Cheng et al. |
| 2007/0017061 | A1 | 1/2007 | Yan |
| 2007/0028574 | A1 | 2/2007 | Yan |
| 2007/0032904 | A1 | 2/2007 | Kawagoe et al. |
| 2007/0042716 | A1 | 2/2007 | Goodall et al. |
| 2007/0043459 | A1 | 2/2007 | Abbott et al. |
| 2007/0061041 | A1 | 3/2007 | Zweig |
| 2007/0114975 | A1 | 5/2007 | Cohen et al. |
| 2007/0150096 | A1 | 6/2007 | Yeh et al. |
| 2007/0157415 | A1 | 7/2007 | Lee et al. |
| 2007/0157420 | A1 | 7/2007 | Lee et al. |
| 2007/0179670 | A1 | 8/2007 | Chiappetta et al. |
| 2007/0226949 | A1 | 10/2007 | Hahm et al. |
| 2007/0234492 | A1 | 10/2007 | Svendsen et al. |
| 2007/0244610 | A1 | 10/2007 | Ozick et al. |
| 2007/0250212 | A1 | 10/2007 | Halloran et al. |
| 2007/0266508 | A1 | 11/2007 | Jones et al. |
| 2008/0007203 | A1 | 1/2008 | Cohen et al. |
| 2008/0039974 | A1 | 2/2008 | Sandin et al. |
| 2008/0052846 | A1 | 3/2008 | Kapoor et al. |
| 2008/0091304 | A1 | 4/2008 | Ozick et al. |
| 2008/0184518 | A1 | 8/2008 | Taylor et al. |
| 2008/0276407 | A1 | 11/2008 | Schnittman et al. |
| 2008/0281470 | A1 | 11/2008 | Gilbert et al. |
| 2008/0282494 | A1 | 11/2008 | Won et al. |
| 2008/0294288 | A1 | 11/2008 | Yamauchi |
| 2008/0302586 | A1 | 12/2008 | Yan |
| 2008/0307590 | A1 | 12/2008 | Jones et al. |
| 2009/0007366 | A1 | 1/2009 | Svendsen et al. |
| 2009/0038089 | A1 | 2/2009 | Landry et al. |
| 2009/0049640 | A1 | 2/2009 | Lee et al. |
| 2009/0055022 | A1 | 2/2009 | Casey et al. |
| 2009/0102296 | A1 | 4/2009 | Greene et al. |
| 2009/0292393 | A1 | 11/2009 | Casey et al. |
| 2010/0011529 | A1 | 1/2010 | Won et al. |
| 2010/0049365 | A1 | 2/2010 | Jones et al. |
| 2010/0063628 | A1 | 3/2010 | Landry et al. |
| 2010/0107355 | A1 | 5/2010 | Won et al. |
| 2010/0257690 | A1 | 10/2010 | Jones et al. |
| 2010/0257691 | A1 | 10/2010 | Jones et al. |
| 2010/0263158 | A1 | 10/2010 | Jones et al. |
| 2010/0268384 | A1 | 10/2010 | Jones et al. |
| 2010/0312429 | A1 | 12/2010 | Jones et al. |

FOREIGN PATENT DOCUMENTS

| | | | |
|---|---|---|---|
| DE | 3317376 | A1 | 11/1984 |
| DE | 3536907 | C2 | 2/1989 |
| DE | 3404202 | C2 | 12/1992 |
| DE | 199311014 | U1 | 10/1993 |
| DE | 44 14 683 | | 10/1995 |
| DE | 4414683 | A1 | 10/1995 |
| DE | 4338841 | C2 | 8/1999 |
| DE | 19849978 | | 2/2001 |
| DE | 19849978 | C2 | 2/2001 |
| DE | 10242257 | | 4/2003 |
| DE | 102004038074.0 | | 6/2005 |
| DE | 10357636 | A1 | 7/2005 |
| DE | 102004041021 | | 8/2005 |
| DE | 102004041021 | B3 | 8/2005 |
| DE | 102005046813 | A1 | 4/2007 |
| DK | 198803389 | A | 12/1988 |
| EP | 265542 | A1 | 5/1988 |
| EP | 281085 | A2 | 9/1988 |
| EP | 307381 | A3 | 7/1990 |
| EP | 358628 | A3 | 5/1991 |
| EP | 437024 | A1 | 7/1991 |
| EP | 433697 | A3 | 12/1992 |
| EP | 479273 | A3 | 5/1993 |
| EP | 294101 | B1 | 12/1993 |
| EP | 554978 | A3 | 3/1994 |
| EP | 615719 | A1 | 9/1994 |
| EP | 861629 | A1 | 9/1998 |
| EP | 792726 | B1 | 6/1999 |
| EP | 930040 | A3 | 10/1999 |
| EP | 845237 | B1 | 4/2000 |
| EP | 1018315 | A1 | 7/2000 |
| EP | 1172719 | A1 | 1/2002 |
| EP | 1228734 | A3 | 6/2003 |
| EP | 1 331 537 | A1 | 7/2003 |
| EP | 1 331 537 | B1 | 7/2003 |
| EP | 1380245 | | 1/2004 |
| EP | 1380246 | A3 | 3/2005 |
| EP | 1553472 | A1 | 7/2005 |
| EP | 1557730 | | 7/2005 |
| EP | 1642522 | A3 | 11/2007 |
| ES | 2 238 196 | | 8/2005 |
| ES | 2238196 | B1 | 11/2006 |
| FR | 2601443 | B1 | 11/1991 |
| FR | 2 828 589 | | 8/2001 |
| GB | 702 426 | | 1/1954 |
| GB | 702426 | A | 1/1954 |
| GB | 2128842 | B | 4/1986 |
| GB | 2213047 | A | 8/1989 |
| GB | 2225221 | A | 5/1990 |
| GB | 2 283 838 | | 5/1995 |
| GB | 2284957 | A | 6/1995 |
| GB | 2267360 | B | 12/1995 |

| | | | |
|---|---|---|---|
| GB | 2300082 | B | 9/1999 |
| GB | 2404330 | B | 7/2005 |
| GB | 2417354 | A | 2/2006 |
| JP | 53021869 | U | 2/1978 |
| JP | 53110257 | A | 9/1978 |
| JP | 53110257 | A2 | 9/1978 |
| JP | 943901 | C | 3/1979 |
| JP | 57014726 | A2 | 1/1982 |
| JP | 57064217 | A | 4/1982 |
| JP | 59005315 | B | 2/1984 |
| JP | 59033511 | U | 3/1984 |
| JP | 59094005 | A | 5/1984 |
| JP | 59099308 | U | 7/1984 |
| JP | 59112311 | U | 7/1984 |
| JP | 59033511 | B | 8/1984 |
| JP | 59120124 | U | 8/1984 |
| JP | 59131668 | U | 9/1984 |
| JP | 59164973 | A | 9/1984 |
| JP | 59184917 | A | 10/1984 |
| JP | 2283343 | A2 | 11/1984 |
| JP | 59212924 | A | 12/1984 |
| JP | 59226909 | A | 12/1984 |
| JP | 60089213 | | 5/1985 |
| JP | 60089213 | U | 6/1985 |
| JP | 60211510 | A | 10/1985 |
| JP | 60259895 | A | 12/1985 |
| JP | 61023221 | A2 | 1/1986 |
| JP | 61097712 | A | 5/1986 |
| JP | 61023221 | B | 6/1986 |
| JP | 62074018 | A | 4/1987 |
| JP | 62070709 | U | 5/1987 |
| JP | 62-120510 | | 6/1987 |
| JP | 62-154008 | | 7/1987 |
| JP | 62154008 | | 7/1987 |
| JP | 62164431 | U | 10/1987 |
| JP | 62263507 | A | 11/1987 |
| JP | 62263508 | A | 11/1987 |
| JP | 62189057 | U | 12/1987 |
| JP | 63079623 | A | 4/1988 |
| JP | 63-183032 | | 7/1988 |
| JP | 63158032 | A | 7/1988 |
| JP | 63-241610 | | 10/1988 |
| JP | 1162454 | A | 6/1989 |
| JP | 2-6312 | | 1/1990 |
| JP | 2006312 | U1 | 1/1990 |
| JP | 2026312 | B | 6/1990 |
| JP | 2283343 | A | 11/1990 |
| JP | 03-051023 | | 3/1991 |
| JP | 3051023 | A2 | 3/1991 |
| JP | 3197758 | A | 8/1991 |
| JP | 3201903 | A | 9/1991 |
| JP | 4019586 | B | 3/1992 |
| JP | 4084921 | A | 3/1992 |
| JP | 5023269 | B | 4/1993 |
| JP | 5091604 | A2 | 4/1993 |
| JP | 5042076 | U | 6/1993 |
| JP | 5046246 | U | 6/1993 |
| JP | 5150827 | A | 6/1993 |
| JP | 5150829 | A | 6/1993 |
| JP | 5046239 | B | 7/1993 |
| JP | 5054620 | U | 7/1993 |
| JP | 5040519 | Y2 | 10/1993 |
| JP | 5257527 | A | 10/1993 |
| JP | 5257533 | A | 10/1993 |
| JP | 5285861 | A | 11/1993 |
| JP | 6003251 | Y2 | 1/1994 |
| JP | 06-038912 | | 2/1994 |
| JP | 6026312 | U | 4/1994 |
| JP | 6137828 | A | 5/1994 |
| JP | 6293095 | A | 10/1994 |
| JP | 06-327598 | | 11/1994 |
| JP | 6105781 | B | 12/1994 |
| JP | 7059702 | A2 | 3/1995 |
| JP | 7129239 | A | 5/1995 |
| JP | 7059702 | B | 6/1995 |
| JP | 7222705 | A | 8/1995 |
| JP | 7222705 | A2 | 8/1995 |
| JP | 7270518 | A | 10/1995 |
| JP | 7281742 | A2 | 10/1995 |
| JP | 7281752 | A | 10/1995 |
| JP | 7-295636 | | 11/1995 |
| JP | 7311041 | A2 | 11/1995 |
| JP | 7313417 | A | 12/1995 |
| JP | 7319542 | A2 | 12/1995 |
| JP | 8000393 | B2 | 1/1996 |
| JP | 8000393 | Y2 | 1/1996 |
| JP | 8016241 | A2 | 1/1996 |
| JP | 8016776 | B | 2/1996 |
| JP | 8016776 | B2 | 2/1996 |
| JP | 8063229 | A2 | 3/1996 |
| JP | 8083125 | A | 3/1996 |
| JP | 8083125 | A2 | 3/1996 |
| JP | 08-089451 | | 4/1996 |
| JP | 8089449 | A | 4/1996 |
| JP | 2520732 | B2 | 5/1996 |
| JP | 8123548 | A | 5/1996 |
| JP | 08-152916 | | 6/1996 |
| JP | 8152916 | A2 | 6/1996 |
| JP | 8256960 | A2 | 10/1996 |
| JP | 8263137 | A | 10/1996 |
| JP | 8286741 | A2 | 11/1996 |
| JP | 8286744 | A2 | 11/1996 |
| JP | 8322774 | A | 12/1996 |
| JP | 8322774 | A2 | 12/1996 |
| JP | 8335112 | A | 12/1996 |
| JP | 9043901 | A | 2/1997 |
| JP | 9044240 | A | 2/1997 |
| JP | 9047413 | A | 2/1997 |
| JP | 9066855 | A | 3/1997 |
| JP | 9145309 | A | 6/1997 |
| JP | 9160644 | A | 6/1997 |
| JP | 9160644 | A2 | 6/1997 |
| JP | 9-179625 | | 7/1997 |
| JP | 9179625 | A2 | 7/1997 |
| JP | 9179685 | A2 | 7/1997 |
| JP | 9185410 | | 7/1997 |
| JP | 9192069 | A2 | 7/1997 |
| JP | 9204223 | A2 | 8/1997 |
| JP | 9206258 | A | 8/1997 |
| JP | 9206258 | A2 | 8/1997 |
| JP | 9233712 | A | 9/1997 |
| JP | 09251318 | | 9/1997 |
| JP | 9251318 | A | 9/1997 |
| JP | 9265319 | A | 10/1997 |
| JP | 9269807 | A | 10/1997 |
| JP | 9269810 | A | 10/1997 |
| JP | 02555263 | Y2 | 11/1997 |
| JP | 9319431 | A2 | 12/1997 |
| JP | 9319432 | A | 12/1997 |
| JP | 9319434 | A | 12/1997 |
| JP | 9325812 | A | 12/1997 |
| JP | 10055215 | A | 2/1998 |
| JP | 10117973 | A | 5/1998 |
| JP | 10117973 | A2 | 5/1998 |
| JP | 10118963 | A | 5/1998 |
| JP | 10177414 | A | 6/1998 |
| JP | 10214114 | A | 8/1998 |
| JP | 10214114 | A2 | 8/1998 |
| JP | 10228316 | | 8/1998 |
| JP | 10240342 | A2 | 9/1998 |
| JP | 10260727 | A2 | 9/1998 |
| JP | 10295595 | A | 11/1998 |
| JP | 11015941 | A | 1/1999 |
| JP | 11065655 | A2 | 3/1999 |
| JP | 11085269 | A2 | 3/1999 |
| JP | 11102219 | A2 | 4/1999 |
| JP | 11102220 | A | 4/1999 |
| JP | 11162454 | A | 6/1999 |
| JP | 11174145 | A | 7/1999 |
| JP | 11175149 | A | 7/1999 |
| JP | 11178764 | A | 7/1999 |
| JP | 11178765 | A | 7/1999 |
| JP | 11-508810 | | 8/1999 |
| JP | 11212642 | A | 8/1999 |
| JP | 11212642 | A2 | 8/1999 |
| JP | 11213157 | A | 8/1999 |
| JP | 11-510935 | | 9/1999 |
| JP | 11248806 | A | 9/1999 |

| | | | |
|---|---|---|---|
| JP | 11282532 | A | 10/1999 |
| JP | 11282533 | A | 10/1999 |
| JP | 11295412 | A | 10/1999 |
| JP | 11346964 | A2 | 12/1999 |
| JP | 2000047728 | A | 2/2000 |
| JP | 2000056006 | A | 2/2000 |
| JP | 2000056831 | A | 2/2000 |
| JP | 2000066722 | A | 3/2000 |
| JP | 2000075925 | A | 3/2000 |
| JP | 10240343 | A2 | 5/2000 |
| JP | 2000275321 | A | 10/2000 |
| JP | 2000353014 | A | 12/2000 |
| JP | 2000353014 | A2 | 12/2000 |
| JP | 2001022443 | A | 1/2001 |
| JP | 2001067588 | A | 3/2001 |
| JP | 2001087182 | | 4/2001 |
| JP | 2001087182 | A | 4/2001 |
| JP | 2001121455 | A | 5/2001 |
| JP | 2001125641 | A | 5/2001 |
| JP | 2001216482 | A | 8/2001 |
| JP | 2001-258807 | | 9/2001 |
| JP | 2001265437 | A | 9/2001 |
| JP | 2001-275908 | | 10/2001 |
| JP | 2001289939 | A | 10/2001 |
| JP | 2001306170 | A | 11/2001 |
| JP | 2001320781 | A | 11/2001 |
| JP | 2001-525567 | | 12/2001 |
| JP | 2002-78650 | | 3/2002 |
| JP | 2002-204768 | | 7/2002 |
| JP | 2002204769 | A | 7/2002 |
| JP | 2002247510 | A | 8/2002 |
| JP | 2002-532178 | | 10/2002 |
| JP | 3356170 | | 10/2002 |
| JP | 2002-323925 | | 11/2002 |
| JP | 2002333920 | A | 11/2002 |
| JP | 2002-355206 | | 12/2002 |
| JP | 2002-360471 | | 12/2002 |
| JP | 2002-360482 | | 12/2002 |
| JP | 2002360479 | A | 12/2002 |
| JP | 2002366227 | A | 12/2002 |
| JP | 2002369778 | A | 12/2002 |
| JP | 2002369778 | A2 | 12/2002 |
| JP | 2003-10076 | | 1/2003 |
| JP | 2003010076 | A | 1/2003 |
| JP | 2003010088 | A | 1/2003 |
| JP | 2003015740 | A | 1/2003 |
| JP | 2003028528 | A | 1/2003 |
| JP | 2003-5296 | | 2/2003 |
| JP | 2003-036116 | | 2/2003 |
| JP | 2003-38401 | | 2/2003 |
| JP | 2003-38402 | | 2/2003 |
| JP | 2003-505127 | | 2/2003 |
| JP | 03375843 | B2 | 2/2003 |
| JP | 2003036116 | | 2/2003 |
| JP | 2003047579 | A | 2/2003 |
| JP | 2003052596 | A | 2/2003 |
| JP | 2003-061882 | | 3/2003 |
| JP | 2003084994 | A | 3/2003 |
| JP | 2003167628 | A | 6/2003 |
| JP | 2003 180587 | | 7/2003 |
| JP | 2003180586 | A | 7/2003 |
| JP | 2003180587 | A | 7/2003 |
| JP | 2003186539 | A | 7/2003 |
| JP | 2003190064 | A | 7/2003 |
| JP | 2003190064 | A2 | 7/2003 |
| JP | 2003241836 | A | 8/2003 |
| JP | 2003262520 | A | 9/2003 |
| JP | 2003285288 | A | 10/2003 |
| JP | 2003304992 | A | 10/2003 |
| JP | 2003-310489 | | 11/2003 |
| JP | 2003310509 | A | 11/2003 |
| JP | 2003330543 | A | 11/2003 |
| JP | 2004123040 | A | 4/2004 |
| JP | 2004148021 | A | 5/2004 |
| JP | 2004160102 | A | 6/2004 |
| JP | 2004166968 | A | 6/2004 |
| JP | 2004174228 | A | 6/2004 |
| JP | 2004198330 | A | 7/2004 |
| JP | 2004219185 | A | 8/2004 |
| JP | 2005118354 | A | 5/2005 |
| JP | 2005135400 | A | 5/2005 |
| JP | 2005211360 | A | 8/2005 |
| JP | 2005224265 | A | 8/2005 |
| JP | 2005230032 | A | 9/2005 |
| JP | 2005245916 | A | 9/2005 |
| JP | 2005296511 | A | 10/2005 |
| JP | 2005346700 | A2 | 12/2005 |
| JP | 2005352707 | A | 12/2005 |
| JP | 2006043071 | A | 2/2006 |
| JP | 2006155274 | A | 6/2006 |
| JP | 2006164223 | A | 6/2006 |
| JP | 2006227673 | A | 8/2006 |
| JP | 2006247467 | A | 9/2006 |
| JP | 2006260161 | A | 9/2006 |
| JP | 2006293662 | A | 10/2006 |
| JP | 2006296697 | A | 11/2006 |
| JP | 2007034866 | A | 2/2007 |
| JP | 2007213180 | A | 8/2007 |
| JP | 04074285 | B2 | 4/2008 |
| JP | 2009015611 | A | 1/2009 |
| JP | 2010198552 | A | 9/2010 |
| WO | WO 95/26512 | | 10/1995 |
| WO | WO95/30887 | | 11/1995 |
| WO | WO9530887 | A1 | 11/1995 |
| WO | WO9617258 | A3 | 2/1997 |
| WO | WO 97/15224 | | 5/1997 |
| WO | WO 97/40734 | | 11/1997 |
| WO | WO 97/41451 | | 11/1997 |
| WO | WO9853456 | A1 | 11/1998 |
| WO | WO9905580 | A2 | 2/1999 |
| WO | WO9916078 | A1 | 4/1999 |
| WO | WO 99/28800 | | 6/1999 |
| WO | WO 99/38056 | | 7/1999 |
| WO | WO 99/38237 | | 7/1999 |
| WO | WO 99/43250 | | 9/1999 |
| WO | WO9959042 | A1 | 11/1999 |
| WO | WO 00/04430 | | 1/2000 |
| WO | WO 00/36962 | | 6/2000 |
| WO | WO 00/38026 | | 6/2000 |
| WO | WO0038028 | A1 | 6/2000 |
| WO | WO0038029 | A1 | 6/2000 |
| WO | WO 00/78410 | | 12/2000 |
| WO | WO 01/06904 | | 2/2001 |
| WO | WO 01/06905 | | 2/2001 |
| WO | WO0180703 | A1 | 11/2001 |
| WO | WO0191623 | A2 | 12/2001 |
| WO | WO 02/39864 | | 5/2002 |
| WO | WO 02/39868 | | 5/2002 |
| WO | WO 02/058527 | | 8/2002 |
| WO | WO 02/062194 | | 8/2002 |
| WO | WO 02/067744 | | 9/2002 |
| WO | WO 02/067745 | | 9/2002 |
| WO | WO 02/071175 | | 9/2002 |
| WO | WO 02/074150 | | 9/2002 |
| WO | WO 02/075356 | | 9/2002 |
| WO | WO 02/075469 | | 9/2002 |
| WO | WO 02/075470 | | 9/2002 |
| WO | WO02067752 | A1 | 9/2002 |
| WO | WO02069774 | A1 | 9/2002 |
| WO | WO02075350 | A1 | 9/2002 |
| WO | WO02081074 | A1 | 10/2002 |
| WO | WO 02/101477 | | 12/2002 |
| WO | WO03015220 | A1 | 2/2003 |
| WO | WO03024292 | A2 | 3/2003 |
| WO | WO 03/026474 | | 4/2003 |
| WO | WO 03/040845 | | 5/2003 |
| WO | WO 03/040846 | | 5/2003 |
| WO | WO02069775 | A3 | 5/2003 |
| WO | WO03040546 | A1 | 5/2003 |
| WO | WO03062850 | A2 | 7/2003 |
| WO | WO03062852 | A1 | 7/2003 |
| WO | WO 2004/006034 | | 1/2004 |
| WO | WO2004004533 | A1 | 1/2004 |
| WO | WO2004004534 | A1 | 1/2004 |
| WO | WO2004005956 | A1 | 1/2004 |
| WO | WO2004058028 | A2 | 1/2004 |
| WO | WO2004025947 | A3 | 5/2004 |
| WO | WO2004043215 | A1 | 5/2004 |

| | | | |
|---|---|---|---|
| WO | WO2004/058028 | | 7/2004 |
| WO | WO2004/059409 | | 7/2004 |
| WO | WO2004058028 | | 7/2004 |
| WO | WO2005006935 | A1 | 1/2005 |
| WO | WO2005036292 | A1 | 4/2005 |
| WO | WO2005/055795 | | 6/2005 |
| WO | WO 2005/055795 | | 6/2005 |
| WO | WO2005055796 | A2 | 6/2005 |
| WO | WO2005076545 | A1 | 8/2005 |
| WO | WO2005077243 | A1 | 8/2005 |
| WO | WO2005077244 | A1 | 8/2005 |
| WO | WO2005081074 | A1 | 9/2005 |
| WO | WO2005082223 | A1 | 9/2005 |
| WO | WO2005083541 | A1 | 9/2005 |
| WO | WO2005098475 | A1 | 10/2005 |
| WO | WO2005098476 | A1 | 10/2005 |
| WO | WO2006046400 | A1 | 5/2006 |
| WO | WO2006/061133 | | 6/2006 |
| WO | WO2006068403 | A1 | 6/2006 |
| WO | WO2006073248 | A1 | 7/2006 |
| WO | WO2007036490 | A3 | 5/2007 |
| WO | WO2007065033 | A2 | 6/2007 |
| WO | WO2007137234 | A2 | 11/2007 |

OTHER PUBLICATIONS

Braunstingl et al. "Fuzzy Logic Wall Following of a Mobile Robot Based on the Concept of General Perception" ICAR '95, 7th International Conference on Advanced Robotics, Sant Feliu De Guixols, Spain, pp. 367-376, Sep. 1995.
Bulusu, et al. "Self Configuring Localization systems: Design and Experimental Evaluation", ACM Transactions on Embedded Computing Systems vol. 3 No. 1 pp. 24-60, 2003.
Caccia, et al. "Bottom-Following for Remotely Operated Vehicles", 5th IFAC conference, Alaborg, Denmark, pp. 245-250 Aug. 1, 2000.
Chae, et al. "StarLITE: A new artificial landmark for the navigation of mobile robots", http://www.irc.atr.jp/jk-nrs2005/pdf/Starlite.pdf, 4 pages, 2005.
Chamberlin et al. "Team 1: Robot Locator Beacon System" NASA Goddard SFC, Design Proposal, 15 pages, Feb. 17, 2006.
Champy "Physical management of IT assets in Data Centers using RFID technologies", RFID 2005 University, Oct. 12-14, 2005.
Chiri "Joystick Control for Tiny OS Robot", http://www.eecs.berkeley.edu/Programs/ugrad/superb/papers2002/chiri.pdf. 12 pages, Aug. 8, 2002.
Christensen et al. "Theoretical Methods for Planning and Control in Mobile Robotics" 1997 First International Conference on Knowledge-Based Intelligent Electronic Systems, Adelaide, Australia, pp. 81-86, May 21-27, 1997.
Andersen et al., "Landmark based navigation strategies", SPIE Conference on Mobile Robots XIII, SPIE vol. 3525, pp.
Clerentin, et al. "A localization method based on two omnidirectional perception systems cooperation" Proc of IEEE International Conference on Robotics & Automation, San Francisco, CA vol. 2, pp. 1219-1224, Apr. 2000.
Corke "High Performance Visual serving for robots end-point control". SPIE vol. 2056 Intelligent robots and computer vision 1993.
Cozman et al. "Robot Localization using a Computer Vision Sextant", IEEE International Midwest Conference on Robotics and Automation, pp. 106-111, 1995.
D'Orazio, et al. "Model based Vision System for mobile robot position estimation", SPIE vol. 2058 Mobile Robots VIII, pp. 38-49, 1992.
De Bakker, et al. "Smart PSD-array for sheet of light range imaging", Proc. of SPIE vol. 3965, pp. 1-12, May 15, 2000.
Desaulniers, et al. "An Efficient Algorithm to find a shortest path for a car-like Robot", IEEE Transactions on robotics and Automation vol. 11 No. 6, pp. 819-828, Dec. 1995.
Dorfmüller-Ulhaas "Optical Tracking From User Motion to 3D Interaction", http://www.cg.tuwien.ac.at/research/publications/2002/Dorimueller-Ulhaas-thesis, 182 pages, 2002.
Dorsch, et al. "Laser Triangulation: Fundamental uncertainty in distance measurement", Applied Optics, vol. 33 No. 7, pp. 1306-1314, Mar. 1, 1994.
Dudek, al. et al "Localizing a Robot with Minimum Travel" Proceedings of the sixth annual ACM-SIAM symposium on Discrete algorithms, vol. 27 No. 2 pp. 583-604, Apr. 1998.
Dulimarta, et al. "Mobile Robot Localization in Indoor Environment", Pattern Recognition, vol. 30, No. 1, pp. 99-111, 1997.
EBay "Roomba Timer -> Timed Cleaning—Floorvac Robotic Vacuum", Cgi.ebay.com/ws/eBayISAPI.dll?viewitem&category=43526&item=4375198387&rd=1, 5 pages, Apr. 20, 2005.
Electrolux "Welcome to the Electrolux trilobite" www.electroluxusa.com/node57.asp?currentURL=node142.asp%3F, 2 pages, Mar. 18, 2005.
Eren, et al. "Accuracy in position estimation of mobile robots based on coded infrared signal transmission", Proceedings: Integrating Intelligent Instrumentation and Control, Instrumentation and Measurement Technology Conference, 1995. IMTC/95. pp. 548-551, 1995.
Eren, et al. "Operation of Mobile Robots in a Structured Infrared Environment", Proceedings. 'Sensing, Processing, Networking', IEEE Instrumentation and Measurement Technology Conference, 1997 (IMTC/97), Ottawa, Canada vol. 1, pp. 20-25, May 19-21, 1997.
Barker, "Navigation by the Stars—Ben Barker 4th Year Project" Power point pp. 1-20.
Becker, et al. "Reliable Navigation Using Landmarks" IEEE International Conference on Robotics and Automation, 0-7803-1965-6, pp. 401-406, 1995.
Benayad-Cherif, et al., "Mobile Robot Navigation Sensors" SPIE vol. 1831 Mobile Robots, VII, pp. 378-387, 1992.
Facchinetti, Claudio et al. "Using and Learning Vision-Based Self-Positioning for Autonomous Robot Navigation", ICARCV '94, vol. 3 pp. 1694-1698, 1994.
Betke, et al., "Mobile Robot localization using Landmarks" Proceedings of the IEEE/RSJ/GI International Conference on Intelligent Robots and Systems '94 "Advanced Robotic Systems and the Real World" (IROS '94), vol.
Facchinetti, Claudio et al. "Self-Positioning Robot Navigation Using Ceiling Images Sequences", ACCV '95, 5 pages, Dec. 5-8, 1995.
Fairfield, Nathaniel et al. "Mobile Robot Localization with Sparse Landmarks", SPIE vol. 4573 pp. 148-155, 2002.
Favre-Bulle, Bernard "Efficient tracking of 3D-Robot Position by Dynamic Triangulation", IEEE Instrumentation and Measurement Technology Conference IMTC 98 Session on Instrumentation and Measurement in Robotics, vol. 1, pp. 446-449, May 18-21, 1998.
Fayman "Exploiting Process Integration and Composition in the context of Active Vision", IEEE Transactions on Systems, Man, and Cybernetics—Part C: Application and reviews, vol. 29 No. 1, pp. 73-86, Feb. 1999.
Florbot GE Plastics Image (1989-1990).
Franz, et al. "Biomimetric robot navigation", Robotics and Autonomous Systems vol. 30 pp. 133-153, 2000.
Friendly Robotics "Friendly Robotics—Friendly Vac, Robotic Vacuum Cleaner", www.friendlyrobotics.com/vac.htm. 5 pages Apr. 20, 2005.
Fuentes, et al. "Mobile Robotics 1994", University of Rochester. Computer Science Department, TR 588, 44 pages, Dec. 7, 1994.
Bison, P et al., "Using a structured beacon for cooperative position estimation" Robotics and Autonomous Systems vol. 29, No. 1, pp. 33-40, Oct. 1999.
Fukuda, et al. "Navigation System based on Ceiling Landmark Recognition for Autonomous mobile robot", 1995 IEEE/RSJ International Conference on Intelligent Robots and Systems 95. 'Human Robot Interaction and Cooperative Robots', Pittsburgh, PA, pp. 1466/1471, Aug. 5-9, 1995.
Gionis "A hand-held optical surface scanner for environmental Modeling and Virtual Reality", Virtual Reality World, 16 pages 1996.
Goncalves et al. "A Visual Front-End for Simultaneous Localization and Mapping", Proceedings of the 2005 IEEE International Conference on Robotics and Automation, Barcelona, Spain, pp. 44-49, Apr. 2005.
Gregg et al. "Autonomous Lawn Care Applications", 2006 Florida Conference on Recent Advances in Robotics, FCRAR 2006, pp. 1-5, May 25-26, 2006.

Hamamatsu "SI PIN Diode S5980, S5981 S5870—Multi-element photodiodes for surface mounting", Hamatsu Photonics, 2 pages Apr. 2004.
Hammacher Schlemmer "Electrolux Trilobite Robotic Vacuum" www.hammacher.com/publish/71579.asp?promo=xsells, 3 pages, Mar. 18, 2005.
Haralick et al. "Pose Estimation from Corresponding Point Data", IEEE Transactions on systems, Man, and Cybernetics, vol. 19, No. 6, pp. 1426-1446, Nov. 1989.
Hausler "About the Scaling Behaviour of Optical Range Sensors", Fringe '97, Proceedings of the 3rd International Workshop on Automatic Processing of Fringe Patterns, Bremen, Germany, pp. 147-155, Sep. 15-17, 1997.
Blaasvaer, et al. "AMOR—An Autonomous Mobile Robot Navigation System", Proceedings of the IEEE International Conference on Systems, Man, and Cybernetics, pp. 2266-2271, 1994.
Hoag, et al. "Navigation and Guidance in interstellar space", ACTA Astronautica vol. 2, pp. 513-533 , Feb. 14, 1975.
Huntsberger et al. "CAMPOUT: A Control Architecture for Tightly Coupled Coordination of Multirobot Systems for Planetary Surface Exploration", IEEE Transactions on Systems, Man, and Cybernetics—Part A: Systems and Humans, vol. 33, No. 5, pp. 550-559, Sep. 2003.
Iirobotics.com "Samsung Unveils Its Multifunction Robot Vacuum", www.iirobotics.com/webpages/hotstuff.php?ubre=111, 3 pages, Mar. 18, 2005.
Jarosiewicz et al. "Final Report—Lucid", University of Florida, Departmetn of Electrical and Computer Engineering, EEL 5666—Intelligent Machine Design Laboratory, 50 pages, Aug. 4, 1999.
Jensfelt, et al. "Active Global Localization for a mobile robot using multiple hypothesis tracking", IEEE Transactions on Robots and Automation vol. 17, No. 5, pp. 748-760, Oct. 2001.
Jeong, et al. "An intelligent map-building system for indoor mobile robot using low cost photo sensors", SPIE vol. 6042 6 pages, 2005.
Kahney, "Robot Vacs are in the House," www.wired.com/news/technology/o,1282,59237,00.html, 6 pages, Jun. 18, 2003.
Karcher "Product Manual Download Karch", www.karcher.com, 17 pages, 2004.
Karcher "Karcher RoboCleaner RC 3000", www.robocleaner.de/english/screen3.html, 4 pages, Dec. 12, 2003.
Karcher USA "RC 3000 Robotics cleaner", www.karcher-usa.com, 3 pages, Mar. 18, 2005.
Karlsson et al., The vSLAM Algorithm for Robust Localization and Mapping, Proceedings of the 2005 IEEE International Conference on Robotics and Automation, Barcelona, Spain, pp. 24-29, Apr. 2005.
Karlsson, et al Core Technologies for service Robotics, IEEE/RSJ International Conference on Intelligent Robots and Systems (IROS 2004), vol. 3, pp. 2979-2984, Sep. 28-Oct. 2, 2004.
King "Heplmate-TM—Autonomous mobile Robots Navigation Systems", SPIE vol. 1388 Mobile Robots pp. 190-198, 1990.
Kleinberg, The Localization Problem for Mobile Robots, Laboratory for Computer Science, Massachusetts Institute of Technology, 1994 IEEE, pp. 521-531, 1994.
Knight, et al., "Localization and Identification of Visual Landmarks", Journal of Computing Sciences in Colleges, vol. 16 Issue 4, 2001 pp. 312-313, May 2001.
Kolodko et al. "Experimental System for Real-Time Motion Estimation", Proceedings of the 2003 IEEE/ASME International Conference on Advanced Intelligent Mechatronics (AIM 2003), pp. 981-986, 2003.
Komoriya et al., Planning of Landmark Measurement for the Navigation of a Mobile Robot, Proceedings of the 1992 IEEE/RSJ International Cofnerence on Intelligent Robots and Systems, Raleigh, NC pp. 1476-1481, Jul. 7-10, 1992.
Koolatron "KOOLVAC—Owner's Manual", 13 pages.
Krotov, et al. "Digital Sextant", Downloaded from the internet at: http://www.cs.cmu.edu/~epk/ , 1 page, 1995.
Krupa et al. "Autonomous 3-D Positioning of Surgical Instruments in Robotized Laparoscopic Surgery Using Visual Servoing", IEEE Transactions on Robotics and Automation, vol. 19, No. 5, pp. 842-853, Oct. 5, 2003.
Kuhl, et al. "Self Localization in Environments using Visual Angles", VRCAI '04 Proceedings of the 2004 ACM SIGGRAPH international conference on Virtual Reality continuum and its applications in industry, pp. 472-475, 2004.
Kurth, "Range-Only Robot Localization and SLAM with Radio", http://www.ri.cmu.edu/pub_files/pub4/kurth_derek_2004_1/kurth_derek_2004_1.pdf. 60 pages, May 2004.
Lambrinos, et al. "A mobile robot employing insect strategies for navigation", http://www8.cs.umu.se/kurser/TDBD17/VT04/dl/Assignment%20Papers/lambrinos-RAS-2000.pdf, 38 pages, Feb. 19, 1999.
Lang et al. "Visual Measurement of Orientation Using Ceiling Features", 1994 IEEE, pp. 552-555, 1994.
Lapin, "Adaptive position estimation for an automated guided vehicle", SPIE vol. 1831 Mobile Robots VII, pp. 82-94, 1992.
LaValle et al. "Robot Motion Planning in a Changing, Partially Predictable Environment", 1994 IEEE International Symposium on Intelligent Control, Columbus, OH, pp. 261-266, Aug. 16-18, 1994.
Lee, et al. "Localization of a Mobile Robot Using the Image of a Moving Object", IEEE Transaction on Industrial Electronics, vol. 50, No. 3 pp. 612-619, Jun. 2003.
Lee, et al. "Development of Indoor Navigation system for Humanoid Robot Using Multi-sensors Integration", ION NTM, San Diego, CA pp. 798-805, Jan. 22-24, 2007.
Leonard, et al. "Mobile Robot Localization by tracking Geometric Beacons", IEEE Transaction on Robotics and Automation, vol. 7, No. 3 pp. 376-382, Jun. 1991.
Li et al. "Robost Statistical Methods for Securing Wireless Localization in Sensor Networks", Wireless Information Network Laboratory, Rutgers University.
Li et al. "Making a Local Map of Indoor Environments by Swiveling a Camera and a Sonar", Proceedings of the 1999 IEEE/RSJ International Conference on Intelligent Robots and Systems, pp. 954-959, 1999.
Lin, et al.. "Mobile Robot Navigation Using Artificial Landmarks", Journal of robotics System 14(2). pp. 93-106, 1997.
Linde "Dissertation, "On Aspects of Indoor Localization"" https://eldorado.tu-dortmund.de/handle/2003/22854, University of Dortmund, 138 pages, Aug. 28, 2006.
Lumelsky, et al. "An Algorithm for Maze Searching with Azimuth Input", 1994 IEEE International Conference on Robotics and Automation, San Diego, CA vol. 1, pp. 111-116, 1994.
Luo et al., "Real-time Area-Covering Operations with Obstacle Avoidance for Cleaning Robots," 2002, IEeE, p. 2359-2364.
Ma "Thesis: Documentation on Northstar", California Institute of Technology, 14 pages, May 17, 2006.
Madsen, et al. "Optimal landmark selection for triangulation of robot position", Journal of Robotics and Autonomous Systems vol. 13 pp. 277-292, 1998.
Martishevcky, "The Accuracy of point light target coordinate determination by dissectoral tracking system", SPIE vol. 2591 pp. 25-30.
Matsutek Enterprises Co. Ltd "Automatic Rechargeable Vacuum Cleaner", http://matsutek.manufacturer.globalsources.com/si/6008801427181/pdtl/Home-vacuum/10 . . . , Apr. 23, 2007.
McGillem, et al. "Infra-red Lacation System for Navigation and Autonomous Vehicles", 1988 IEEE International Conference on Robotics and Automation, vol. 2, pp. 1236-1238, Apr. 24-29, 1988.
McGillem,et al. "A Beacon Navigation Method for Autonomous Vehicles", IEEE Transactions on Vehicular Technology, vol. 38, No. 3, pp. 132-139, Aug. 1989.
Michelson "Autonomous Navigation", 2000 Yearbook of Science & Technology, McGraw-Hill, New York, ISBN 0-07-052771-7, pp. 28-30, 1999.
Miro, et al. "Towards Vision Based Navigation in Large Indoor Environments", Proceedings of the IEEE/RSJ International Conference on Intelligent Robots and Systems, Beijing, China, pp. 2096-2102, Oct. 9-15, 2006.
MobileMag "Samsung Unveils High-tech Robot Vacuum Cleaner", http://www.mobilemag.com/content/100/102/C2261/, 4 pages, Mar. 18, 2005.
Monteiro, et al. "Visual Servoing for Fast Mobile Robot: Adaptive Estimation of Kinematic Parameters", Proceedings of the IECON '93., International Conference on Industrial Electronics, Maui, HI, pp. 1588-1593, Nov. 15-19, 1993.
Moore, et al. A simple Map-bases Localization strategy using range measurements, SPIE vol. 5804 pp. 612-620, 2005.
Munich et al. "SIFT-ing Through Features with ViPR", IEEE Robotics & Automation Magazine, pp. 72-77, Sep. 2006.
Munich et al. "ERSP: A Software Platform and Architecture for the Service Robotics Industry", Intelligent Robots and Systems, 2005. (IROS 2005), pp. 460-467, Aug. 2-6, 2005.
Nam, et al. "Real-Time Dynamic Visual Tracking Using PSD Sensors and extended Trapezoidal Motion Planning", Applied Intelligence 10, pp. 53-70, 1999.
Nitu et al. "Optomechatronic System for Position Detection of a Mobile Mini-Robot", IEEE Ttransactions on Industrial Electronics, vol. 52, No. 4, pp. 969-973, Aug. 2005.
On Robo "Robot Reviews Samsung Robot Vacuum (VC-RP30W)", www.onrobo.com/reviews/AT_Home/vacuum_cleaners/on00vcrb30rosam/index.htm.. 2 pages, 2005.
InMach "Intelligent Machines", www.inmach.de/inside.html, 1 page, Nov. 19, 2008.
Innovation First "2004 EDU Robot Controller Reference Guide", http://www.ifirobotics.com, 13 pgs., Mar. 1, 2004.
OnRobo "Samsung Unveils Its Multifunction Robot Vacuum", www.onrobo.com/enews/0210/samsung_vacuum.shtml, 3 pages, Mar. 18, 2005.
Pages et al. "Optimizing Plane-to-Plane Positioning Tasks by Image-Based Visual Servoing and Structured Light", IEEE Transactions on Robotics, vol. 22, No. 5, pp. 1000-1010, Oct. 2006.
Pages et al. "A camera-projector system for robot positioning by visual servoing", Proceedings of the 2006 Conference on Computer Vision and Pattern Recognition Workshop (CVPRW06), 8 pages, Jun. 17-22, 2006.
Pages, et al. "Robust decoupled visual servoing based on structured light", 2005 IEEE/RSJ Int. Conf. on Intelligent Robots and Systems, pp. 2676-2681, 2005.
Park et al. "A Neural Network Based Real-Time Robot Tracking Controller Using Position Sensitive Detectors," IEEE World Congress on Computational Intelligence., 1994 IEEE International Conference on Neutral Networks, Orlando, Florida pp. 2754-2758, Jun. 27-Jul. 2, 1994.
Park, et al. "Dynamic Visual Servo Control of Robot Manipulators using Neutral Networks", The Korean Institute Telematics and Electronics, vol. 29-B, No. 10, pp. 771-779, Oct. 1992.
Paromtchik "Toward Optical Guidance of Mobile Robots".
Paromtchik, et al. "Optical Guidance System for Multiple mobile Robots", Proceedings 2001 ICRA. IEEE International Conference on Robotics and Automation, vol. 3, pp. 2935-2940 (May 21-26, 2001).
Penna, et al. "Models for Map Building and Navigation", IEEE Transactions on Systems. Man. and Cybernetics. vol. 23 No. 5, pp. 1276-1301, Sep./Oct. 1993.
Pirjanian "Reliable Reaction", Proceedings of the 1996 IEEE/SICE/RSJ International Conference on Multisensor Fusion and Integration for Intelligent Systems, pp. 158-165, 1996.
Pirjanian "Challenges for Standards for consumer Robotics", IEEE Workshop on Advanced Robotics and its Social impacts, pp. 260-264, Jun. 12-15, 2005.
Pirjanian et al. "Distributed Control for a Modular, Reconfigurable Cliff Robot", Proceedings of the 2002 IEEE International Conference on Robotics & Automation, Washington, D.C. pp. 4083-4088, May 2002.
Pirjanian et al. "Representation and Execution of Plan Sequences for Multi-Agent Systems", Proceedings of the 2001 IEEE/RSJ International Conference on Intelligent Robots and Systems, Maui, Hawaii, pp. 2117-2123, Oct. 29-Nov. 3, 2001.
Pirjanian et al. "Multi-Robot Target Acquisition using Multiple Objective Behavior Coordination", Proceedings of the 2000 IEEE International Conference on Robotics & Automation, San Francisco, CA, pp. 2696-2702, Apr. 2000.
Pirjanian et al. "A decision-theoretic approach to fuzzy behavior coordination", 1999 IEEE International Symposium on Computational Intelligence in Robotics and Automation, 1999. CIRA '99., Monterey, CA, pp. 101-106, Nov. 8-9, 1999.
Pirjanian et al. "Improving Task Reliability by Fusion of Redundant Homogeneous Modules Using Voting Schemes", Proceedings of the 1997 IEEE International Conference on Robotics and Automation, Albuquerque, NM, pp. 425-430, Apr. 1997.
Prassler et al., "A Short History of Cleaning Robots", Autonomous Robots 9, 211-226, 2000, 16 pages.
Radio Frequency Identification: Tracking ISS Consumables, Author Unknown, 41 pages.
Remazeilles, et al. "Image based robot navigation in 3D environments", Proc. of SPIE, vol. 6052, pp. 1-14, Dec. 6, 2005.
Rives, et al. "Visual servoing based on ellipse features", SPIE vol. 2056 Intelligent Robots and Computer Vision pp. 356-367, 1993.
Robotics World Jan. 2001: "A Clean Sweep".
Ronnback "On Methods for Assistive Mobile Robots", http://www.openthesis.org/documents/methods-assistive-mobile-robots-595019.html, 218 pages, Jan. 1, 2006.
Roth-Tabak, et al. "Environment Model for mobile Robots Indoor Navigation", SPIE vol. 1388 Mobile Robots pp. 453-463, 1990.
Sadath M Malik et al. "Virtual Prototyping for Conceptual Design of a Tracked Mobile Robot". Electrical and Computer Engineering, Canadian Conference on, IEEE, PI. May 1, 2006, pp. 2349-2352.
Sahin, et al. "Development of a Visual Object Localization Module for Mobile Robots", 1999 Third European Workshop on Advanced Mobile Robots, (Eurobot '99), pp. 65-72, 1999.
Salomon, et al. "Low-Cost Optical Indoor Localization system for Mobile Objects without Image Processing", IEEE Conference on Emerging Technologies and Factory Automation, 2006. (ETFA '06), pp. 629-632, Sep. 20-22, 2006.
Sato "Range Imaging Based on Moving Pattern Light and Spatio-Temporal Matched Filter", Proceedings International Conference on Image Processing, vol. 1., Lausanne, Switzerland, pp. 33-36, Sep. 16-19, 1996.
Schenker, et al. "Lightweight rovers for Mars science exploration and sample return", Intelligent Robots and Computer Vision XVI, SPIE Proc. 3208, pp. 24-36, 1997.
Sebastian Thrun, Learning Occupancy Grid Maps With Forward Sensor Models, School of Computer Science, Carnegie Mellon University, pp. 1-28.
Shimoga et al. "Touch and Force Reflection for Telepresence Surgery", Engineering in Medicine and Biology Society, 1994. Engineering Advances: New Opportunities for Biomedical Engineers. Proceedings of the 16th Annual International Conference of the IEEE, Baltimore, MD, pp. 1049-1050, 1994.
Sim, et al "Learning Visual Landmarks for Pose Estimation", IEEE International Conference on Robotics and Automation, vol. 3, Detroit, MI, pp. 1972-1978, May 10-15, 1999.
Sobh et al. "Case Studies in Web-Controlled Devices and Remote Manipulation", Automation Congress, 2002 Proceedings of the 5th Biannual World, pp. 435-440, Dec. 10, 2002.
Stella, et al. "Self-Location for Indoor Navigation of Autonomous Vehicles", Part of the SPIE conference on Enhanced and Synthetic Vision SPIE vol. 3364 pp. 298-302, 1998.
Summet "Tracking Locations of Moving Hand-held Displays Using Projected Light", Pervasive 2005, LNCS 3468 pp. 37-46 (2005).
Svedman et al. "Structure from Stereo Vision using Unsynchronized Cameras for Simultaneous Localization and Mapping", 2005 IEEE/RSJ International Conference on Intelligent Robots and Systems, pp. 2993-2998, 2005.
Takio et al. "Real-Time Position and Pose Tracking Method of Moving Object Using Visual Servo System", 47th IEEE International Symposium on Circuits and Systems, pp. 167-170, 2004.
Teller "Pervasive pose awareness for people, Objects and Robots", http://www.ai.mit.edu/lab/dangerous-ideas/Spring2003/teller-pose.pdf, 6 pages, Apr. 30, 2003.
Terada et al. "An Acquisition of the Relation between Vision and Action using Self-Organizing Map and Reinforcement Learning", 1998 Second International Conference on Knowledge-Based Intelligent Electronic Systems, Adelaide, Australiam pp. 429-434, Apr. 21-23, 1998.
The Sharper Image "e-Vac Robotic Vacuum, S1727 Instructions" www.sharperimage.com, 18 pages.
The Sharper Image "Robotic Vacuum Cleaner—Blue" www.Sharperimage.com, 2 pages, Mar. 18, 2005.

The Sharper Image "E Vac Robotic Vacuum", www.sharperiamge.com/us/en/templates/products/pipmorework1printable.jhtml, 2 pages, Mar. 18, 2005.
TheRobotStore.com "Friendly Robotics Robotic Vacuum RV400—The Robot Store", www.therobotstore.com/s.nl/sc.9/category.-109/it.A/id.43/.f, 1 page, Apr. 20, 2005.
TotalVac.com RC3000 RoboCleaner website Mar. 18, 2005.
Trebi-Ollennu et al. "Mars Rover Pair Cooperatively Transporting a Long Payload", Proceedings of the 2002 IEEE International Conference on Robotics & Automation, Washington, D.C. pp. 3136-3141, May 2002.
Tribelhorn et al., "Evaluating the Roomba: A low-cost, ubiquitous platform for robotics research and education," 2007, IEEE, p. 1393-1399.
Tse et al. "Design of a Navigation System for a Household Mobile Robot Using Neural Networks", Department of Manufacturing Engg. & Engg. Management, City University of Hong Kong, pp. 2151-2156, 1998.
UAMA (Asia) Industrial Co., Ltd. "RobotFamily", 2005.
Watanabe et al. "Position Estimation of Mobile Robots With Internal and External Sensors Using Uncertainty Evolution Technique", 1990 IEEE International Conference on Robotics and Automation, Cincinnati, OH, pp. 2011-2016, May 13-18, 1990.
Watts "Robot, boldly goes where no man can", The Times—pp. 20, Jan. 1985.
Wijk et al. "Triangulation-Based Fusion of Sonar Data with Application in Robot Pose Tracking ", IEEE Transactions on Robotics and Automation, vol. 16, No. 6, pp. 740-752, Dec. 2000.
Wolf et al. "Robust Vision-based Localization for Mobile Robots Using an Image Retrieval System Based on Invariant Features", Proceedings of the 2002 IEEE International Conference on Robotics & Automation, Washington, D.C. pp. 359-365, May 2002.
Wolf et al. "Robust Vision-Based Localization by Combining an Image-Retrieval System with Monte Carol Localization", IEEE Transactions on Robotics, vol. 21, No. 2, pp. 208-216, Apr. 2005.
Wong "EIED Online>> Robot Business", ED Online ID# 13114, 17 pages, Jul. 2006.
Yamamoto et al. "Optical Sensing for Robot Perception and Localization", 2005 IEEE Workshop on Advanced Robotics and its Social Impacts, pp. 14-17, 2005.
Yata et al. "Wall Following Using Angle Information Measured by a Single Ultrasonic Transducer", Proceedings of the 1998 IEEE, International Conference on Robotics & Automation, Leuven, Belgium, pp. 1590-1596, May 1998.
Yun, et al. "Image-Based Absolute Positioning System for Mobile Robot Navigation", IAPR International Workshops SSPR, Hong Kong, pp. 261-269, Aug. 17-19, 2006.
Yun, et al. "Robust Positioning a Mobile Robot with Active Beacon Sensors", Lecture Notes in Computer Science, 2006, vol. 4251, pp. 890-897, 2006.
Yuta, et al. "Implementation of an Active Optical Range sensor Using Laser Slit for In-Door Intelligent Mobile Robot", IEE/RSJ International workshop on Intelligent Robots and systems (IROS 91) vol. 1, Osaka, Japan, pp. 415-420, Nov. 3-5, 1991.
Zha et al. "Mobile Robot Localization Using Incomplete Maps for Change Detection in a Dynamic Environment", Advanced Intelligent Mechatronics '97. Final Program and Abstracts., IEEE/ASME International Conference, pp. 110, Jun. 16-20, 1997.
Zhang, et al. "A Novel Mobile Robot Localization Based on Vision", SPIE vol. 6279, 6 pages, Jan. 29, 2007.
Euroflex Intellegente Monstre Mauele (English only except).
Roboking—not just a vacuum cleaner, a robot! Jan. 21, 2004, 5 pages.
SVET Computers—New Technologies—Robot vacuum cleaner, 1 page.
Popco.net Make your digital life http://www.popco.net/zboard/view.php?id=tr_review&no=40 accessed Nov. 1, 2011.
Matsumura Camera Online Shop http://www.rakuten.co.jp/matsucame/587179/711512/ accessed Nov. 1, 2011.
Dyson's Robot Vacuum Cleaner—the DC06, May 2, 2004 http://www.gizmag.com/go/1282/ accessed Nov. 11, 2011.
Electrolux Trilobite, http://www.electrolux-ui.com:8080/2002%5C822%5C833102EN.pdf 10 pages.
Electrolux Trilobite, Time to enjoy life, 38 pages http://www.robocon.co.kr/trilobite/Presentation_Trilobite_Kor_030104.ppt accessed Dec. 22, 2011.
Facts on the Trilobite http://www.frc.ri.cmu.edu/~hpm/talks/Extras/trilobite.desc.html 2 pages accessed Nov. 1, 2011.
Euroflex Jan. 1, 2006 http://www.euroflex.tv/novita_dett.php?id=15 1 page accessed Nov. 1, 2011.
FloorBotics, VR-8 Floor Cleaning Robot, Product Description for Manuafacturers, http://www.consensus.com.au/SoftwareAwards/CSAarchive/CSA2004/CSAart04/FloorBot/F.
Friendly Robotics, 18 pages http://www.robotsandrelax.com/PDFs/RV400Manual.pdf accessed Dec. 22, 2011.
It's eye, 2003 www.hitachi.co.jp/rd/pdf/topics/hitac2003_10.pdf 2 pages.
Hitachi, May 29, 2003 http://www.hitachi.co.jp/New/cnews/hl_030529_hl_030529.pdf 8 pages.
Robot Buying Guide, LG announces the first robotic vacuum cleaner for Korea, Apr. 21, 2003 http://robotbg.com/news/2003/04/22/lg_announces_the_first_robotic_vacu.
CleanMate 365, Intelligent Automatic Vacuum Cleaner, Model No. QQ-1, User Manual www.metapo.com/support/user_manual.pdf 11 pages.
UBOT, cleaning robot capable of wiping with a wet duster, http://us.aving.net/news/view.php?articleId=23031, 4 pages accessed Nov. 1, 2011.
Taipei Times, Robotic vacuum by Matsuhita about ot undergo testing, Mar. 26, 2002 http://www.taipeitimes.com/News/worldbiz/archives/2002/03/2610000129338 accessed.
Tech-on! http://techon.nikkeibp.co.jp/members/01db/20020311006501/, 4 pages, accessed Nov. 1, 2011.
http://ascii.jp/elem/000/000/330/330024/.
IT media http://www.itmedia.co.jp/news/0111/16/robofesta_m.html accessed Nov. 1, 2011.
Yujin Robotics, an intelligent cleaning robot 'iclebo Q' AVING USA http://us.aving.net/news/view.php?articleId=7257, 8 pages accessed Nov. 4, 2011.
Special Reports, Vacuum Cleaner Robot Operated in Conjunction with 3G Celluar Phone vol. 59, No. 9 (2004) 3 pages http://www.toshiba.co.jp/tech/review/2004/09/59_0.
Toshiba Corporation 2003, http://warp.ndl.go.jp/info:ndljp/pid/258151/www.soumu.go.jp/joho_tsusin/policyreports/chousa/netrobot/pdf/030214_1_33_a.pdf 16 pages.
http://www.karcher.de/versions/intg/assets/video/2_4_robo_en.swf. Accessed Sep. 25, 2009.
McLurkin "The Ants: A community of Microrobots", Paper submitted for requirements of BSEE at MIT, May 12, 1995.
Grumet "Robots Clean House", Popular Mechanics, Nov. 2003.
McLurkin Stupid Robot Tricks: A Behavior-based Distributed Algorithm Library for Programming Swarms of Robots, Paper submitted for requirements of BSEE at MIT, May 2004.
Kurs et al, Wireless Power transfer via Strongly Coupled Magnetic Resonances, Downloaded from www.sciencemag.org , Aug. 17, 2007.
Cameron Morland, *Autonomous Lawn Mower Control*, Jul. 24, 2002.
Doty, Keith L et al, "Sweep Strategies for a Sensory-Driven, Behavior-Based Vacuum Cleaning Agent" AAAI 1993 Fall Symposium Series Instantiating Real-World Agents Research Triangle Park, Raleigh, NC, Oct. 22-24, 1993, pp. 1-6.
Electrolux designed for the well-lived home, website: http://www.electroluxusa.com/node57.as[?currentURL=node142.asp%3F, acessed Mar. 18, 2005.
eVac Robotic Vacuum S1727 Instruction Manual, Sharper Image Corp, Copyright 2004.
Everyday Robots, website: http://www.everydayrobots.com/index.php?option=content&task=view&id=9, accessed Apr. 20, 2005.
Examination report dated Aug. 17, 2010 from corresponding application EP 07783998.3.
Examination report dated Jul. 15, 2011 from corresponding U.S. Appl. No. 12/687,464.
Examination report in counterpart U.S. Appl. No. 10/818,073 dated Jan. 7, 2009.
Examination report in counterpart U.S. Appl. No. 10/818,073 dated May 7, 2008.

Examination report in counterpart U.S. Appl. No. 11/751,267 dated Apr. 13, 2010.
Examination report in counterpart U.S. Appl. No. 11/751,267 dated Dec. 2, 2010.
Examination report in counterpart U.S. Appl. No. 11/751,470 dated Feb. 18, 2011.
Examination report in counterpart U.S. Appl. No. 11/751,470 dated May 27, 2010.
Examination report in counterpart U.S. Appl. No. 11/834,606 dated Feb. 28, 2008.
Examination report in counterpart U.S. Appl. No. 11/834,647 date Mar. 6, 2009.
Examination report in counterpart U.S. Appl. No. 11/834,647 date Oct. 31, 2008.
Examination report in counterpart U.S. Appl. No. 11/834,647 date Sep. 9, 2009.
Examination report in counterpart U.S. Appl. No. 11/834,647 dated May 16, 2008.
Examination report in counterpart U.S. Appl. No. 11/834,656 dated Jan. 26, 2009.
Examination report in counterpart U.S. Appl. No. 11/834,656 dated Jul. 28, 2008.
Facts on the Trilobite webpage: "http://trilobiteelectroluxse/presskit_en/node11335asp?print=yes&pressID=" accessed Dec. 12, 2003.
Friendly Robotics Robotic Vacuum RV400—The Robot Store website: http://www.therobotstore.com/s.nl/sc.9/category,-109/it.A/id.43/.f, accessed Apr. 20, 2005.
Gat, Erann, Robust Low-computation Sensor-driven Control for Task-Directed Navigation, Proceedings of the 1991 IEEE, International Conference on Robotics and Automation, Sacramento, California, Apr. 1991, pp. 2484-2489.
Hitachi: News release: The home cleaning robot of the autonomous movement type (experimental machine) is developed, website: http://www.i4u.com/japanreleases/hitachirobot.htm., accessed Mar. 18, 2005.
International Preliminary Report on Patentability in corresponding application PCT/US2007/069389, dated Nov. 4, 2008.
Kärcher Product Manual Download webpage: "http://wwwkarchercom/bta/downloadenshtml?ACTION=SELECTTEILENR&ID=rc3000&submitButtonName=Select+Product+Manual" and associated pdf file "5959-915enpdf (47 MB) English/English" accessed Jan. 21, 2004.
Karcher RC 3000 Cleaning Robot—user manual Manufacturer: Alfred-Karcher GmbH & Co, Cleaning Systems, Alfred Karcher-Str 28-40, PO Box 160, D-71349 Winnenden, Germany, Dec. 2002.
Kärcher RoboCleaner RC 3000 Product Details webpages: "http://wwwrobocleanerde/english/screen3html" through " . . . screen6html" accessed Dec. 12, 2003.
Karcher USA, RC3000 Robotic Cleaner, website: http://www.karcher-usa.com/showproducts.php?op=view_prod&param1=143&param2=&param3=, accessed Mar. 18, 2005.
Koolvac Robotic Vacuum Cleaner Owner's Manual, Koolatron, Undated.
NorthStar Low-Cost, Indoor Localization, Evolution robotics, Powering Intelligent Products.
Prassler et al., A Short History of Cleaning Robots, Autonomous Robots 9, 211-226, 2000, 16 pages.
Put Your Roomba . . . On "Automatic" Roomba Timer> Timed Cleaning—Floorvac Robotic Vacuum webpages: http://cgi.ebay.com/ws/eBayISAPI.dll?ViewItem&category=43575198387&rd=1, accessed Apr. 20, 2005.
Put Your Roomba . . . On "Automatic" webpages: "http://www.acomputeredge.com/roomba," accessed Apr. 20, 2005.
RoboMaid Sweeps Your Floors So You Won't Have To, the Official Site, website: http://www.thereobomaid.com/, acessed Mar. 18, 2005.
Robot Review Samsung Robot Vacuum (VC-RP30W), website: http://www.onrobo.com/reviews/At_Home/Vacuun_Cleaners/on00vcrp30rosam/index.htm, accessed Mar. 18, 2005.
Robotic Vacuum Cleaner-Blue, website: http://www.sharperimage.com/us/en/catalog/productview.jhtml?sku=S1727BLU, accessed Mar. 18, 2005.
Schofield, Monica, "Neither Master nor Slave" A Practical Study in the Development and Employment of Cleaning Robots, Emerging Technologies and Factory Automation, 1999 Proceedings EFA'99 1999 7th IEEE International Conference on Barcelona, Spain Oct. 18-21, 1999, pp. 1427-1434.
Search Report in counterpart application PCT/US2007/069389 dated Feb. 14, 2008.
Wired News: Robot Vacs Are in the House, website: http://www.wired.com/news/print/0,1294,59237,00.html, accessed Mar. 18, 2005.
Zoombot Remote Controlled Vaccum—RV-500 New Roomba 2, website: http://cgi.ebay.com/ws/eBayISAPI.dll?ViewItem&category=43526&item=4373497618&rd=1, accessed Apr. 20, 2005.
Andersen et al., "Landmark based navigation strategies", SPIE Conference on Mobile Robots XIII, SPIE vol. 3525, pp. 170-181, Jan. 8, 1999.
Ascii, Mar. 25, 2002, http://ascii.jp/elem/000/000/330/330024/ accessed Nov. 1, 2011.
Certified U.S. Appl. No. 60/605,066 as provided to WIPO in PCT/US2005/030422, corresponding to U.S. Appl. No. 11/574,290, U.S. publication 2008/0184518, filed Aug. 27, 2004.
Certified U.S. Appl. No. 60/605,181 as provided to WIPO in PCT/US2005/030422, corresponding to U.S. Appl. No. 11/574,290, U.S. publication 2008/0184518, filed Aug. 27, 2004.
Derek Kurth, "Range-Only Robot Localization and SLAM with Radio", http://www.ri.cmu.edu/pub_files/pub4/kurth_derek_2004_1/kurth_derek_2004_1.pdf. 60 pages, May 2004, accessed Jul. 27, 2012.
Electrolux Trilobite, Jan. 12, 2001, http://www.electrolux-ui.com:8080/2002%5C822%5C833102EN.pdf, accessed Jul. 2, 2012, 10 pages.
Florbot GE Plastics, 1989-1990, 2 pages, available at http://www.fuseid.com/, accessed Sep. 27, 2012.
Gregg et al., "Autonomous Lawn Care Applications," 2006 Florida Conference on Recent Advances in Robotics, Miami, Florida, May 25-26, 2006, Florida International University, 5 pages.
Hitachi 'Feature', http://kadenfan.hitachi.co.jp/robot/feature/feature.html, 1 page, Nov. 19, 2008.
Hitachi, http://www.hitachi.co.jp/New/cnews/hi_030529_hi_030529.pdf , 8 pages, May 29, 2003.
Home Robot—UBOT; Microbotusa.com, retrieved from the WWW at www.microrobotusa.com, accessed Dec. 2, 2008.
King and Weiman, "Helpmate™ Autonomous Mobile Robots Navigation Systems," SPIE vol. 1388 Mobile Robots, pp. 190-198 (1990).
Li et al. "Robust Statistical Methods for Securing Wireless Localization in Sensor Networks," Information Procesing in Sensor Networks, 2005, Fourth International Symposium on, pp. 91-98, Apr. 2005.
Martishevcky, "The Accuracy of point light target coordinate determination by dissectoral tracking system", SPIE vol. 2591, pp. 25-30, Oct. 23, 2005.
Maschinemarkt Würzburg 105, Nr. 27, pp. 3, 30, Jul. 5, 1999.
Miwako Doi "Using the symbiosis of human and robots from approaching Research and Development Center," Toshiba Corporation, 16 pages, available at http://warp.ndl.go.jp/info:ndljp/pid/258151/www.soumu.go.jp/joho_tsusin/policyreports/chousa/netrobot/pdf/030214_1_33_a.pdf, Feb. 26, 2003.
Paromtchik "Toward Optical Guidance of Mobile Robots," Proceedings of the Fourth World Multiconference on Systemics, Cybermetics and Informatics, Orlando, FL, USA, Jul. 23, 2000, vol. IX, pp. 44-49, available at http://emotion.inrialpes.fr/~paromt/infos/papers/paromtchik:asama:sci:2000.ps.gz, accessed Jul. 3, 2012.
Roboking—not just a vacuum cleaner, a robot!, Jan. 21, 2004, infocom.uz/2004/01/21/robokingne-prosto-pyilesos-a-robot/, accessed Oct. 10, 2011, 7 pages.
Sebastian Thrun, "Learning Occupancy Grid Maps With Forward Sensor Models," Autonomous Robots 15, 111-127, Sep. 1, 2003.
SVET Computers—New Technologies—Robot Vacuum Cleaner, Oct. 1999, available at http://www.sk.rs/1999/10/sknt01.html, accessed Nov. 1, 2011.
Written Opinion of the International Searching Authority, PCT/US2004/001504, Aug. 20, 2012, 9 pages.

* cited by examiner

STEP 1: homing and approach

STEP 2: docking

STEP 3: drop cartridge

STEP 4 swap clean/dirty cartridge

STEP 5: load cartridge

STEP 6: undock and resume cleaning

CLEANING ROBOT ROLLER PROCESSING

CROSS-REFERENCE TO RELATED APPLICATIONS

This U.S. patent application is a continuation of and claims priority, under 35 U.S.C. §120, to U.S. application Ser. No. 11/751,413, filed May 21, 2007 now U.S. Pat. No. 8,087,117, which claims priority, under 35 U.S.C. §119(e), to U.S. provisional patent applications 60/747,791, filed on May 19, 2006, 60/803,504, filed on May 30, 2006, and 60/807,442, filed on Jul. 14, 2006. The entire contents of the aforementioned applications are hereby incorporated by reference.

TECHNICAL FIELD

The disclosure relates to coverage robots, cleaning rollers, and roller cleaning systems.

BACKGROUND

Sweeping and/or vacuuming may be performed by ordinary cleaners (vacuum cleaners, carpet sweepers) or mobile robots that sweep and/or vacuum. These cleaners and robots may include brush or beater rollers that pick up or help pick up debris. However, while such cleaners or mobile robots may include brush or beater rollers to agitate or sweep debris and dirt away from the floor (or other flat surface), filaments (i.e., hair, thread, string, carpet fiber) may become tightly wrapped around the roller. In particular, pet hair tends to accumulate rapidly and resist removal.

SUMMARY

In one aspect, a coverage robot includes a chassis, a drive system mounted on the chassis and configured to maneuver the robot, and a cleaning assembly carried by the chassis. The cleaning assembly includes a cleaning assembly housing and at least one driven flapper brush rotatably coupled to the cleaning assembly housing. The flapper brush includes an elongated core having an outer surface and end mounting features extending beyond axial ends of the outer surface and defining a central longitudinal axis of rotation. The flapper brush includes a compliant flap extending radially outward from the core to sweep a floor surface as the roller is driven to rotate. The flap is configured to prevent errant filaments from spooling tightly about the core to aid subsequent removal of the filaments. The flapper brush includes axial end guards mounted on the core adjacent the ends of the outer core surface and configured to prevent spooled filaments from traversing axially from the outer core surface onto the mounting features.

Implementations of this aspect of the disclosure may include one or more of the following features. In some implementations, the flapper brush includes multiple floor cleaning bristles extending radially outward from the core, wherein a diameter of the compliant flap about the core is less than a diameter of the bristles about the core. The end guard may be removable from each longitudinal end of the core. In some examples, the end guard is compliant, elastically deforming for removing accumulated errant filaments off of the flaps In another aspect, a coverage robot includes a chassis, a drive system mounted on the chassis and configured to maneuver the robot, and a cleaning assembly carried by the chassis. The cleaning assembly includes a cleaning assembly housing and at least one driven sweeper brush rotatably coupled to the cleaning assembly housing. The sweeper brush includes an elongated core having an outer surface and end mounting features extending beyond axial ends of the outer surface and defining a central longitudinal axis of rotation. The sweeper brush includes multiple floor cleaning bristles extending radially outward from the core. The sweeper brush includes axial end guards mounted on the core adjacent the ends of the outer core surface and configured to prevent spooled filaments from traversing axially from the outer core surface onto the mounting features.

Implementations of this aspect of the disclosure may include one or more of the following features. In some examples, the bristles are disposed about the core in multiple rows, each row forming a substantially V-shaped groove configuration along the core. The end guard may be removable from each longitudinal end of the core. In some examples, the end guard is compliant, elastically deforming for removing accumulated errant filaments off of the bristles. The end guard may be substantially conical.

In yet another aspect, a floor cleaner includes a chassis and a cleaning assembly carried by the chassis. The cleaning assembly includes a cleaning assembly housing, at least one driven cleaning roller rotatably coupled to the cleaning assembly housing, and a sensor system configured to detect spooled material accumulated by the cleaning roller. The sensor system includes an emitter disposed near a first end of the cleaning roller and a detector disposed near an opposite, second end of the cleaning roller and aligned with the emitter. The detector configured to receive a signal emitted by the emitter to detect spooled material accumulated by the cleaning roller.

Implementations of this aspect of the disclosure may include one or more of the following features. The emitter may be an infrared light emitter.

In another aspect, a coverage robot includes a chassis, a drive system mounted on the chassis and configured to maneuver the robot, a controller carried by the chassis, and a cleaning assembly carried by the chassis. The cleaning assembly includes a cleaning assembly housing and at least one driven cleaning roller rotatably coupled to the cleaning assembly housing. The coverage robot includes a roller cleaning tool carried by the chassis and configured to longitudinally traverse the roller to remove accumulated debris from the cleaning roller. The roller cleaning tool includes a body and protrusions extending outward from the body and configured to remove debris from the roller while passing over the cleaning roller.

Implementations of this aspect of the disclosure may include one or more of the following features. The roller cleaning tool may include a linear drive configured to traverse the cleaning tool across the cleaning roller. In some examples, a user manually pushes/pulls the roller cleaning tool along the cleaning roller to remove accumulated debris. In some implementations, the roller cleaning tool is substantially tubular. In other implementations, the roller cleaning tool is semi-tubular or quarter-tubular. The cross-sectional profile of roller cleaning tool may be substantially circular, triangular, rectangular, octagonal, hexagonal, or other suitable shape. In some examples, the roller cleaning tool includes a depth adjustor configured to control a depth of interference of the housing into the cleaning roller.

In another aspect, a robot roller maintenance system includes a coverage robot and a filament stripping tool. The coverage robot includes a chassis, a drive system mounted on the chassis and configured to maneuver the robot, a controller carried by the chassis, and a cleaning assembly carried by the chassis. The cleaning assembly includes a cleaning assembly housing and at least one driven cleaning roller rotatably coupled to the cleaning assembly housing. The filament stripping tool for the roller includes a substantially tubular housing defining first and second openings configured to receive a cleaning roller. The cleaning roller includes a rotatable, elongated core with end mounting features defining a central longitudinal axis of rotation, multiple floor cleaning bristles extending radially outward from the core, and at least one compliant flap extending radially outward from the core and configured to prevent errant filaments from spooling tightly about the core. The roller filament stripping tool includes protrusions extending from an interior surface of the housing toward a central longitudinal axis defined by the housing to a depth that interferes with the compliant flap. The protrusion are configured to remove accumulated filaments spooled about the roller passing through the housing.

Implementations of this aspect of the disclosure may include one or more of the following features. In some examples, at least two of the protrusions extend toward the central longitudinal axis at different heights. At least one of the first and second openings is sized larger than a diameter of the cleaning roller and larger than a diameter of a middle region between the first and second openings. A deforming portion of the housing is sized smaller than a diameter of a cleaning roller to deform peripheral longitudinal edges of the roller as the cleaning roller passes through the housing. In some examples, the deforming portion is sized smaller than a diameter of the bristles and a diameter of the compliant flap about the cleaning roller. The bristles and compliant flap elastically deform to comply with the deforming portion of the housing when the cleaning roller passes through the housing. The filament stripping tool may include a trailing comb disposed on the interior surface of the housing. The trailing comb includes tines configured to remove debris from a cleaning roller passing through the housing. In some implementations, the roller cleaning tool includes a guide ring disposed on the interior surface of the housing. The guide ring is configured to support the housing substantially concentrically on a cleaning roller while permitting rotation of the housing relative to the cleaning roller. The filament stripping tool may include a filament blade disposed on the housing. The filament blade is configured to at filaments and debris away from the cleaning roller. The filament blade may be configured to cut the filaments and debris while the tool traverses over the roller or as a separate cleaning device on the tool. In some implementations, the filament stripping tool includes a fuzz comb extending from the housing in the longitudinal direction and comprising multiple rows of tines. A user may use the fuzz comb to pull fuzz and debris out of the roller bristles.

The details of one or more implementations of the disclosure are set fourth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1A:
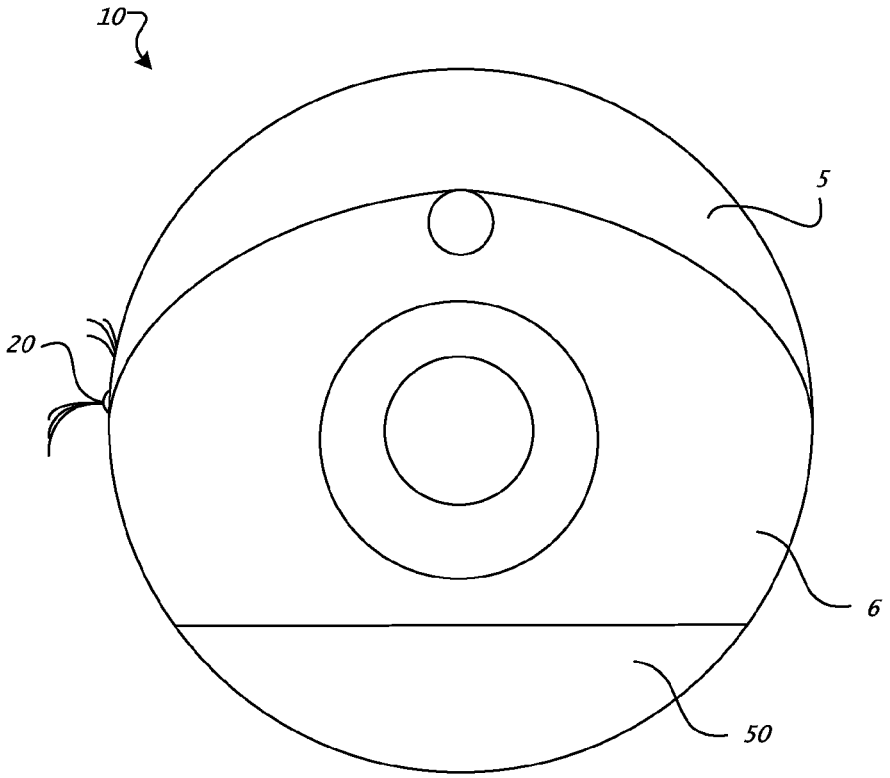
FIG. 1A is a top view of a coverage robot.
Figure 1B:
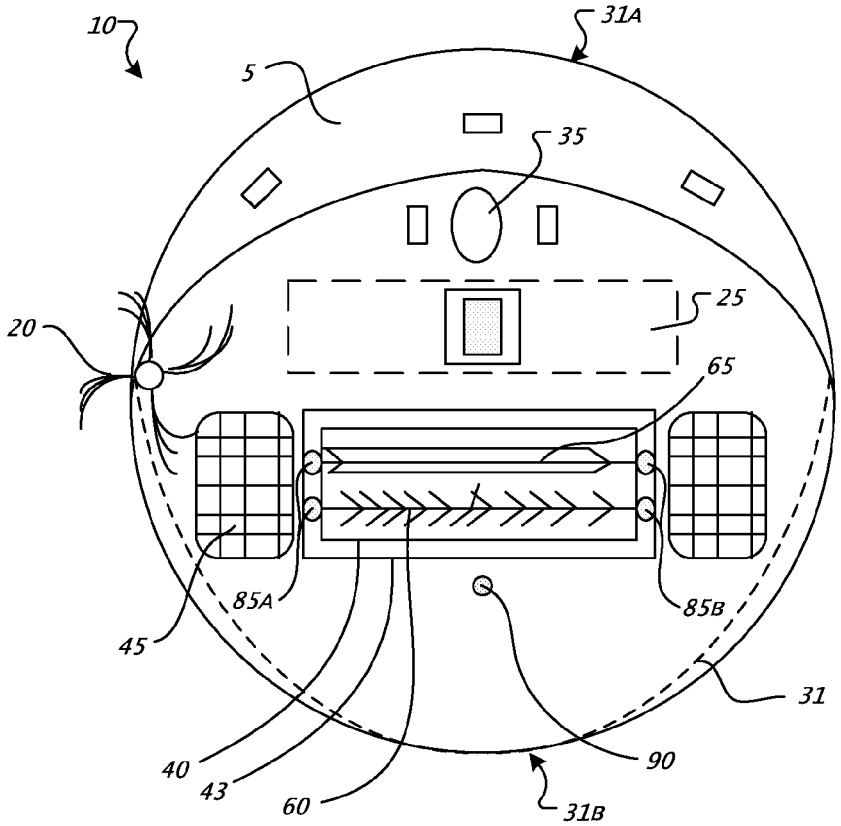
FIG. 1B is a bottom view of a coverage robot.

Referring to FIGS. 1A-1B, an autonomous robotic cleaner 10 includes a chassis 31 which carries an outer shell 6. FIG. 1A illustrates the outer shell 6 of the robot 10 connected to a bumper 5. The robot 10 may move in forward and reverse drive directions; consequently, the chassis 31 has corresponding forward and back ends, 31A and 31B respectively. A cleaning head assembly 40 is located towards the middle of the robot 10 and installed within the chassis 31. The cleaning head assembly 40 includes a main 65 brush and a secondary brush 60. A battery 25 is housed within the chassis 31 proximate the cleaning head assembly 40. In some examples, the main 65 and/or the secondary brush 60 are removable. In other examples, the cleaning head assembly 40 includes a fixed main brush 65 and/or secondary brush 60, where fixed refers to a brush permanently installed on the chassis 31.

Installed along either side of the chassis 31 are differentially driven wheels 45 that mobilize the robot 10 and provide two points of support. The forward end 31A of the chassis 31 includes a caster wheel 35 which provides additional support for the robot 10 as a third point of contact with the floor and does not hinder robot mobility. Installed along the side of the chassis 31 is a side brush 20 configured to rotate 360 degrees when the robot 10 is operational. The rotation of the side brush 20 allows the robot 10 to better clean areas adjacent the robot's side, and areas otherwise unreachable by the centrally located cleaning head assembly 40. A removable cleaning bin 50 is located towards the back end 31B of the robot 10 and installed within the outer shell 6.

Figure 2:
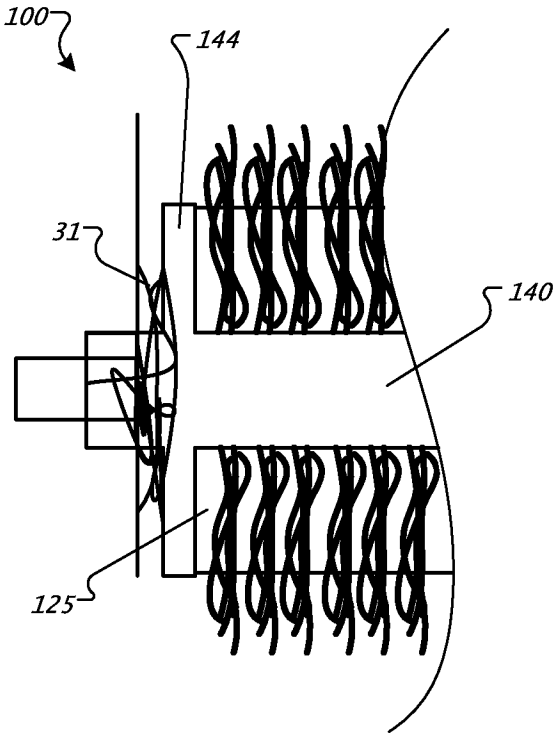
FIG. 2 is a partial side view of a cleaning roller for a coverage robot or cleaning device.
Figure 3:
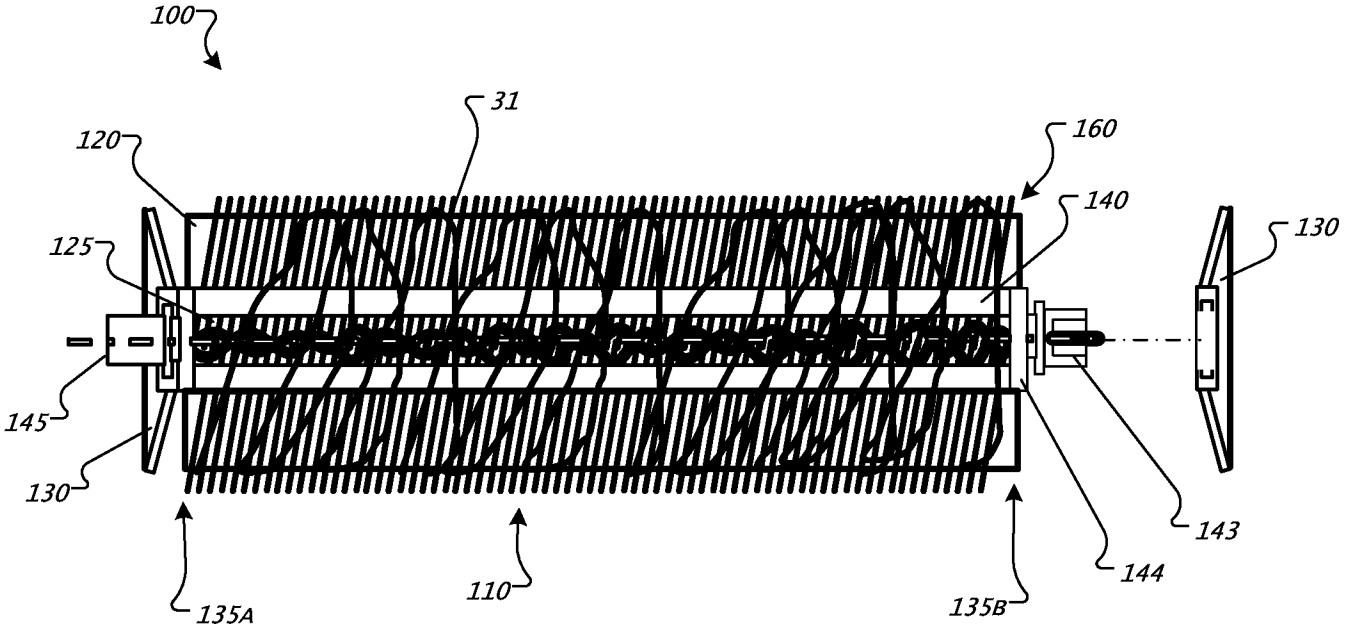
FIG. 3 is a side view of a cleaning roller for a coverage robot or cleaning device.

Referring to FIGS. 2-3, a roller 100 includes an end cap 144, which is a substantially circular plate at either or both ends of the roller 100 supporting integral ribs 125 and/or a brush core 140, and is usually no larger than necessary. Errant filaments or hairs 31 may wind off of the end of the roller 100, past the end caps 144, and enter bushings or bearings 143 rotatably supporting the roller 100 causing decreased cleaning performance or jamming the roller 100. Errant filaments 33 wound about the roller 100 may be difficult and tedious to remove.

Figure 4:
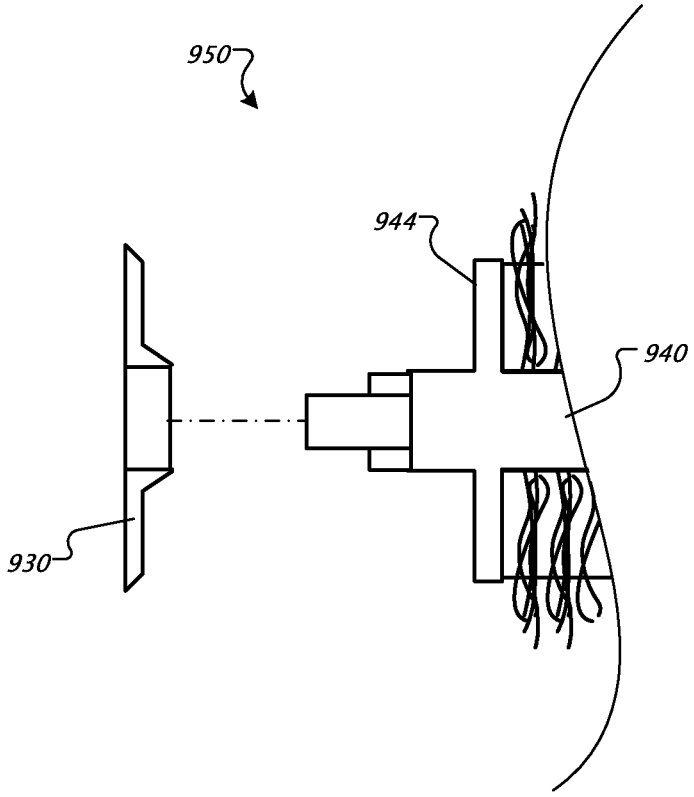
FIGS. 4-6 are partial side views of cleaning rollers for a coverage robot or cleaning device.

FIG. 3 illustrates an example of a spool roller 100. Removable conical end guards 130 made of a soft elastomer limit the longitudinal travel of filaments 33, keep filaments 33 and collected hair 33 within the brush ends 135A-B, and/or prevent hair 33 from spilling over onto bearings 143 that may be located at either one or both longitudinal ends of the roller 100. Elastomeric (e.g. soft) flaps 120 are supported by the core 140 of the roller 100 and extend longitudinally. These elastomeric or inner pliable flaps 120 are arranged between the bristles 110 (on a bristle roller). Although FIG. 4 depicts inner pliable flaps 120 and end guards 130, the end guards 130, as described, are useful for providing an area for hair or other filaments 33 to collect without the use of a pliable spooling surface. The implementation does not necessarily include the inner pliable flaps 120 (or even the bristles 110). If sufficiently pliable, the end guards 130 may be integrated with the brush 160, in which case they are deformed or movable to remove accumulated hair rings.

For example, the roller 100 may be engaged in cleaning a carpeted surface. Although the roller 100 is shown without a vacuum or secondary roller and on a carpeted surface, the roller 100 is useful on hard floors, as part of a roller pair (either similar or dissimilar rollers), and/or with a vacuum (beside, adjacent to, or surrounding the roller). Generally, the construction discussed in detail in Applicant's U.S. Pat. No. 6,883,201, which is hereby incorporated by reference in its entirety, is an effective structure for such rollers.

The end guards 130 prevent the filaments 33 from winding or traversing beyond either extremity of the spool roller 100. In some implementations, the end guards 130 are made of a soft (and/or flexible, and/or compliant) rubber, plastic, polyethylene, polymer or polymer-like material similar to the inner pliable flaps 120. The end guards 130, in some examples, cause filaments 33 to slip back down to the core 140 of the roller 100, if the rotating action of the roller 100 should cause the filaments 33 to approach either end of the spool roller 100. The end guards 130 may be removable, in order to facilitate installation and/or removal of the spool roller 100 from a robot cleaner 10. The end guards 130 need not be conical. In some examples, the end guards 130 have a smaller diameter than the bristles 110.

The core 140 of the roller 100 includes both a twisted coarse wire (e.g. a doable-helix wine core that supports the bristles 110) and a set of integral ribs 125 (integral with end caps 144 and roller axle 145). The core 140 includes a driven part (keyed or geared end) and a supporting part. In this implementation, the end guard 130 is formed as a full or partial truncated cone, the small diameter portion of the truncated cone having a through hole formed therein for receiving the roller axle 145, and being mounted toward the roller axle 145, and the large diameter portion of the truncated cone being mounted away from the roller axle 145. The end guard 130 is removable for brush cleaning and it keeps any hair 33 trapped within the two ends, thus keeping the drive mechanism clean (free of hair).

Referring to FIGS. 4-8, in some implementations, a spool roller 950 includes end guards 930. Although this implementation does not necessarily include a soft flap 120 (or even bristles 110), the end guards 930 prevent filaments 33 from winding or traversing beyond either extremity of the spool roller 950. The end guards 930 may be made of a substantially rigid plastic or other material used for consumer appliances, or soft material similar to the inner pliable flaps 120. The end guards 930, by preventing the hair or other filaments from winding past the end caps 944, cause filaments 33 which travel past the end caps 944 to slip down to the core 940 of the spool roller 950, if the rotating action of the spool roller 950 should cause the filaments 33 to approach either end of the spool roller 950. Ringed clumps of filaments 33 or hairs become trapped between the end caps 944 and the end guards 930.

Figure 5:
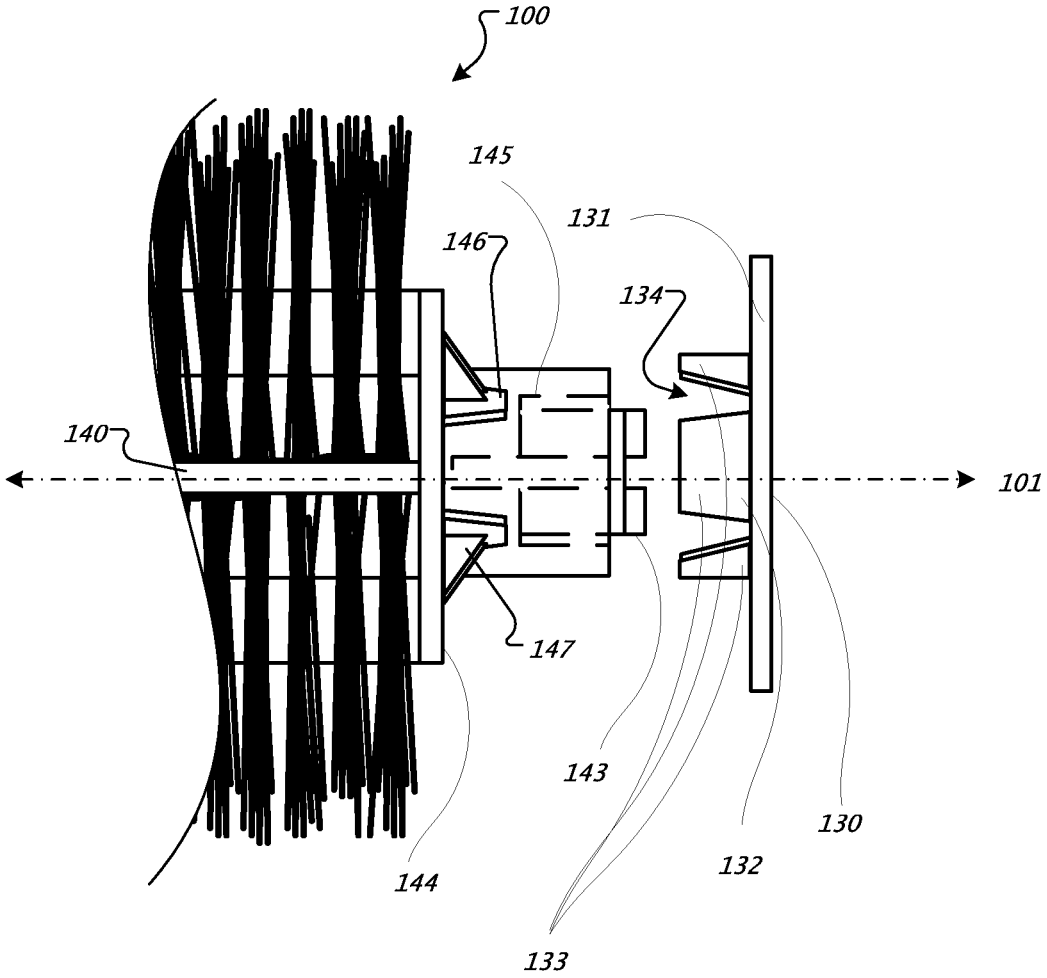
Figure 6:
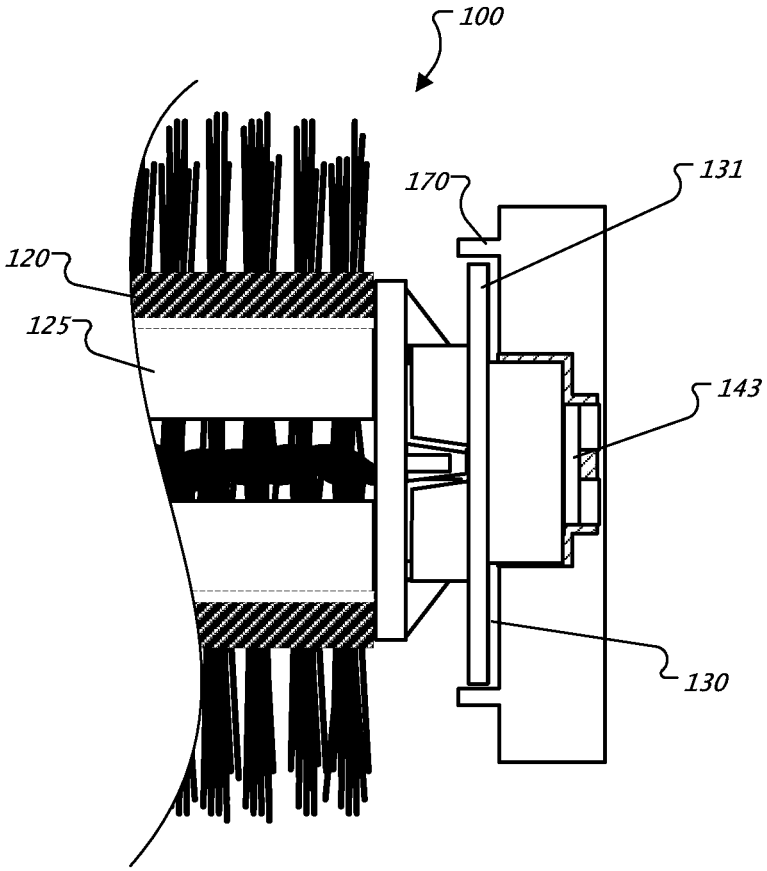

FIGS. 5 and 6 provide additional details of the spool roller 100. As shown in FIG. 4, the end guard 130, in some examples, is removable, in order to facilitate installation and/or removal of the spool roller 100 from a robot 10 or other primary cleaning device. In particular, the end guard 130 may take the form of a flat torus 131 and a mounting ring 132. The mounting ring 132 may be made of plastic, with sector tabs 133 (e.g. curved trapezoids or crenellations formed therein) and defined notches 134, and a slightly tapering inner diameter that tapers down from a slip fit (with the roller axle 145 of the roller core 140) at the flat torus 131 to a tight slip fit or very slight interference fit at the ends of the tabs 133. The ends of the tabs 133 are deformed as the end guard 130 is mounted to the axle 145, and maintain a relatively tight fit during use, yet are easily removed. As shown in FIG. 5, the notches 134 defined between the sector tabs 133 may mate with corresponding angles or protrusions 146 on the axle 145, preventing the end guard 130 from rotating.

FIG. 5 shows the end of the roller 100 (turned so the ribs 125 are orthogonal to a viewer) with the end guard 130 about to be mounted. The end guard 130 is slid onto the axle 145 of the roller 100 until the tabs 130 abut the end cap 144, or until the protrusions 146 on the axle 145 and/or end cap 144 abut the flat torus of the end guard 130. The bearing 143 is a plastic-housed metal bushing that is mounted on a metal axle pin within the axle 145 of the roller 140, and the bushing 143 is mounted to a compatible holder on the robot 10, such that the roller 100 rotates on the metal axle pin about the bushing 143. For example, the axle 145 and the end guard 130 can be mounted in a robot 10 to rotate about the bearing 143, which mates with the mount in the robot 10. Triangular shaped features 147 on the roller 100 act as ramps, allowing the end guards 130 to be easily twisted off the roller 100 for servicing.

Referring to FIG. 6, in some examples, a "fender" or labyrinth wall 170 provided in the cleaning head or robot is a perimeter wall about the outer periphery of the flat torus 131 of the end guard 130. The labyrinth wall 170 forms a simple labyrinth seal that further prevents accumulations of hair and other filaments 33 from passing the end guard 130 to enter the area where the bearing/bushing 143 is mounted.

The end guard 130 is compatible with and enhanced by the inner pliable flaps 120. For example, the diameter of the end guard 130 and the end caps 144 need not be the same, and if the end guards 130 are removed from a roller 100 having the inner pliable flaps 120, accumulations of pet hair can be readily removed, and the inner pliable flaps 120 are exposed in the axial direction for easy cleaning with (or without) secondary cleaning tools.

Figure 7A:
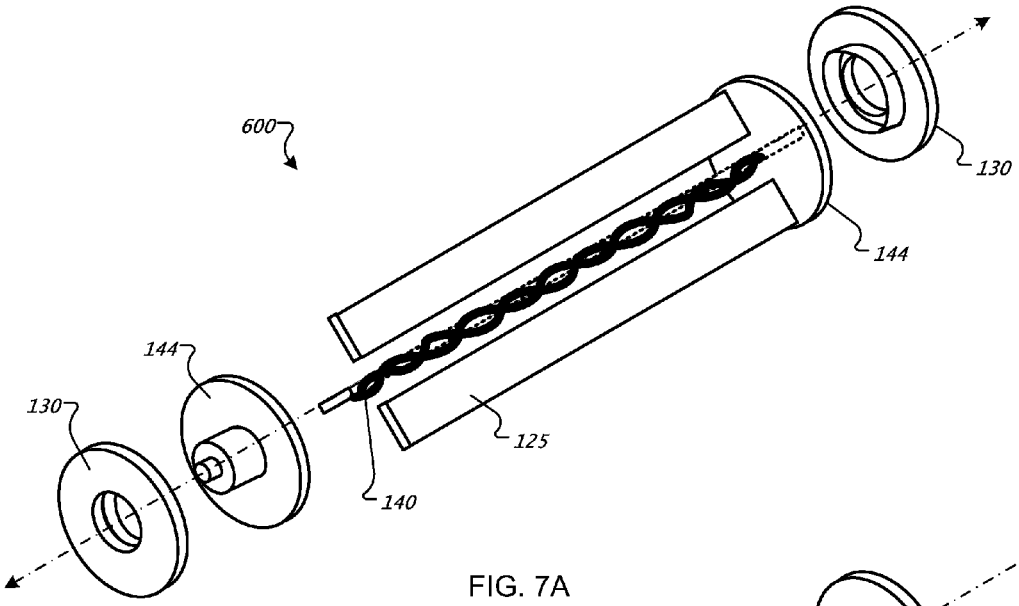
FIGS. 7A-7B are exploded views of cleaning rollers for a coverage robot or cleaning device.
Figure 7B:
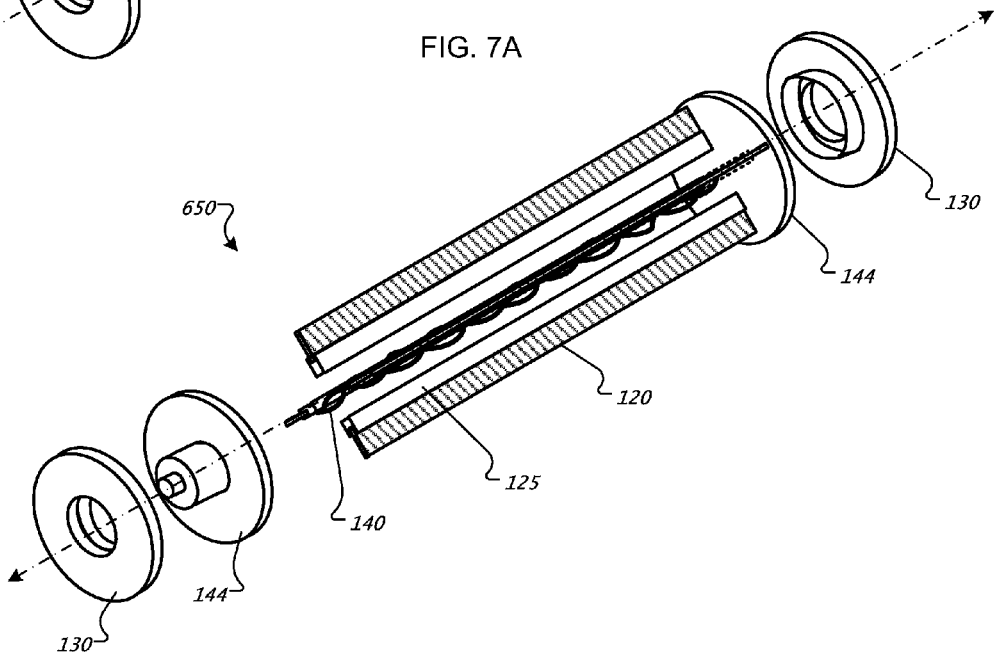
Figure 8:
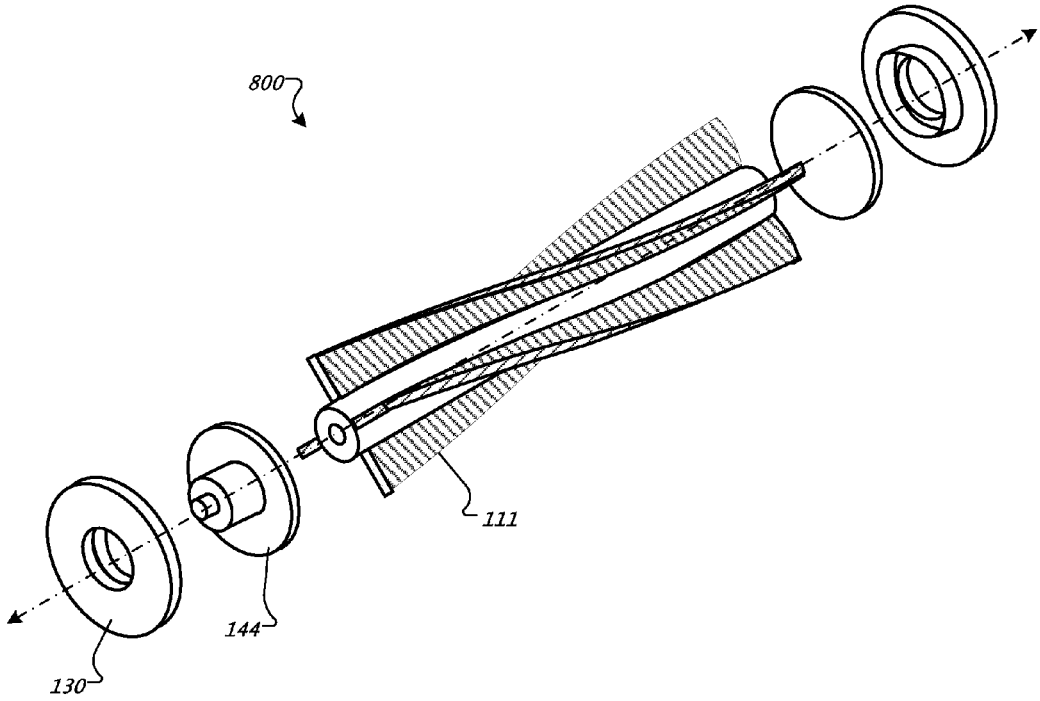
FIGS. 8-9 are exploded views of cleaning rollers for a coverage robot or cleaning device.

FIGS. 7A-7B and 8 show different configurations which may make use of the end guards 130. In FIGS. 7A and 7B, for the purposes of illustration, only the brush core 140, and not bristles 110 or beaters 111 are shown. Nonetheless, each configuration may include bristles 110 and/or beaters 111 between the integral ribs 125. FIG. 7A depicts a roller 600 having end caps 144 and integral ribs 125, but no inner pliable flaps 120. The end guard 130 permits the user to readily remove accumulated filament 31 or hair ring clumps from the roller 600. FIG. 7B depicts a roller 650 having end caps 144, integral ribs 125, and inner pliable flaps 120. Again, the end guard 130 permits the user to readily remove accumulated filament 31 or hair ring clumps from the rollers 650, works with the inner pliable flaps 120 to provide two different cleaning enhancements, and permits ready access to the inner pliable flaps 120 (especially for those implementations in which the end guard 130 is made of a larger—e.g., by about 0.5 to 8 mm—diameter disc or ring than the end cap 144).

FIG. 8 shows a beater-only roller 800 (optionally with bristles replacing any one or more of the beaters 111) having end caps 144, spiraling/winding/helicoid beaters 111 (which may be flexible but hard rubber) but no inner pliable flaps 120. The beaters 111 may be compliant and deformable.

In any of these implementations, when a user removes the end guard 130 or 930 from the end of the spool roller 100, 600, 650, 800, 950, the ring-like clump of filaments 33 can easily be slipped off from the end of the spool roller 100 by simply pulling the filaments 33 off past the end. Alternatively or in addition, the mounting ring 132 of the end guard 130 may have an outer peripheral profile that conically slopes downward and inward (i.e., toward the center of the roller 100 away from the end of the roller 100), in order to urge any accumulating filaments 33 away from the end of the roller 100 as the roller 100 spins.

The end guard 130 may have an inner edge for closely abutting the outer edge of the end cap 144, such that the outer surface (e.g. axle) of the roller 100 is blocked and protected by the end guard 130. When the end guard 130 is detached from the roller 100, any accumulated filaments 33 can easily be removed if the smallest possible diameter for rings of accumulated filaments 33 is limited to the diameter of the mounting ring 132 of the end guard 130 abutting the end cap 144 (and thus not the diameter of the roller 100), which may prevent tight winding of the accumulating filaments 33 about the roller 100 and also prevent filaments 33 from reaching the bearings 143.

Figure 9:
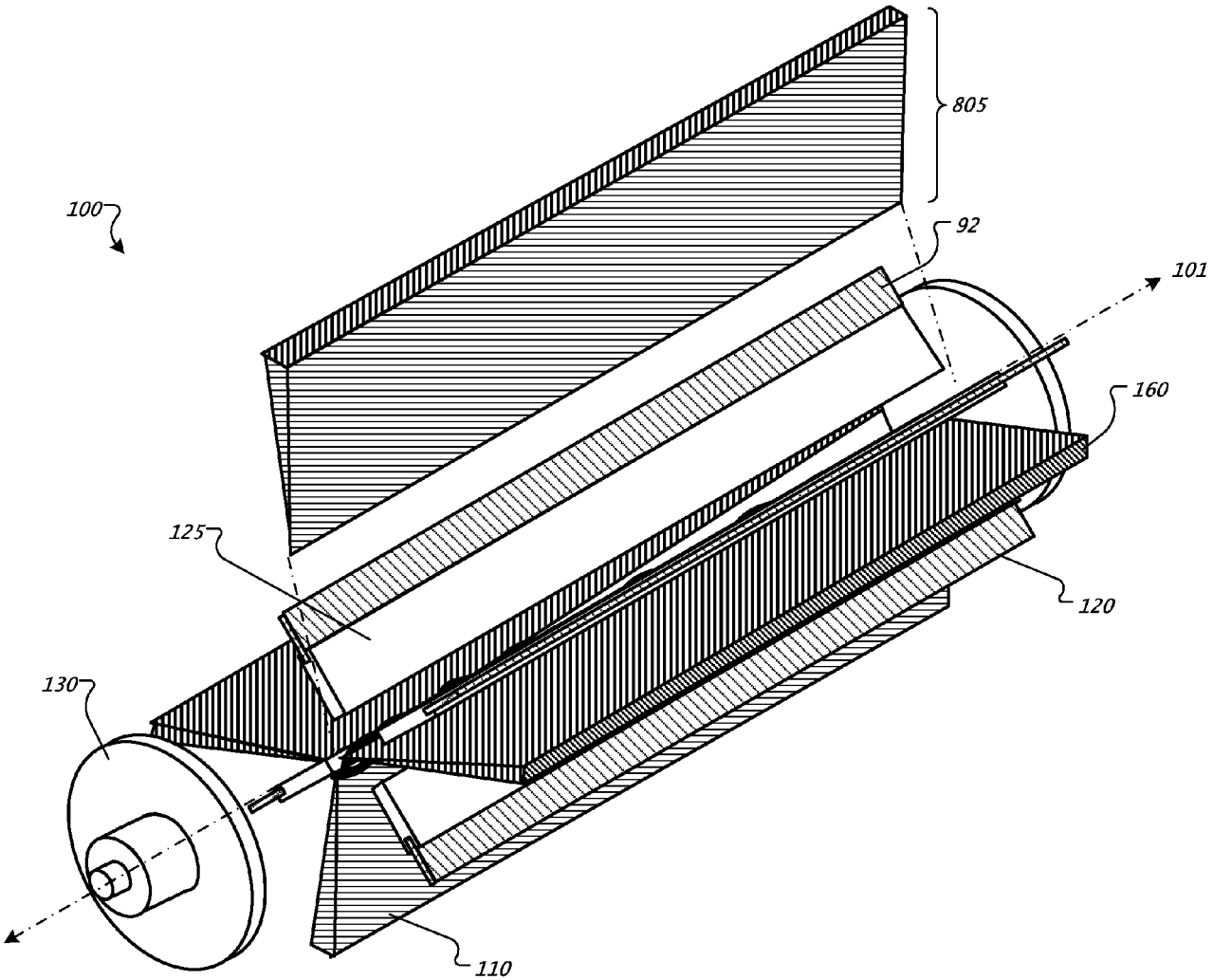
Figure 10:
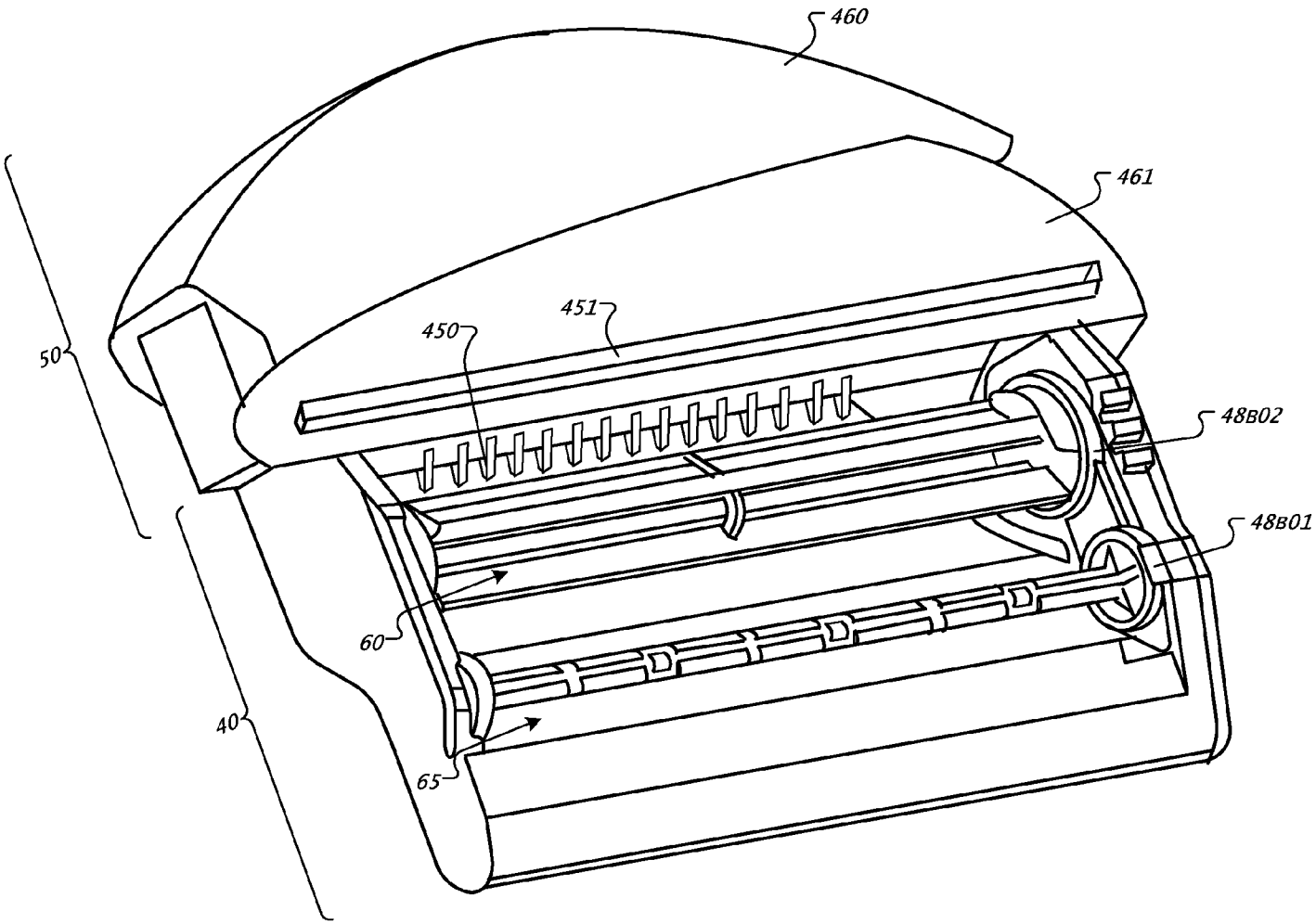
FIG. 10 is a perspective view of a cleaning head for a coverage robot adjacent a cleaning bin.

Referring to FIG. 9, in another implementation, the robot 10 may include a brush roller 100 for cleaning smooth and/or fibrous flooring surfaces (such as linoleum or tufted carpet, respectively, for example). The brush roller 100 includes a twisted helix wire bundle (central core member 140) forming a base for many bristles and a set of integral ribs 125 distributed along radial directions about the axis 101 of the roller 100. Applicant's U.S. Pat. No. 6,883,201, hereby incorporated by reference in its entirety, provides additional brush disclosure. Integral ribs 125 may impede the ingestion of matter such as rug tassels and tufted fabric by the main brush, and filament 31 and other hair-like debris can become wound about the ribs 125. A flapper brush 92 can be provided with axle guards 130 having a beveled configuration for the purpose of forcing hair and other similar matter away from the flapper brush 92 to prevent the matter from becoming entangled with the ends of the flapper brush 92. As shown in FIG. 6 of the '201 document (FIG. 10), a rim can extend completely about a first output port and second output port 48B02, 48B01 of a dual output port gear box. The soft flaps have a beneficial elastic action during anti-tassel rotation (reversing rotation to reject carpet tassels), releasing tassels to some extent.

The soft flaps 120 on the roller 100 act as a cushioning spool when long fringes/tassels get wrapped around the brushes 160. The soft flaps 120 cushion the tug on the tassels and permit easier release of the tassels since the elastic deformation on the flaps 120 acts as a spring-back mechanism to release the tassels from a tight wind on the hard roller core 140. When the robot 10 uses anti-tassel software, the robot 10 frees-up easier (as lesser force is required to unwind the already sprung-up tassels) when cleaning with such a flap-fitted brush roller 100.

In some implementations, bristles 110 of may extend radially outward from the core 140 (not shown in FIG. 9). The bristles 110 may be arranged in straight, angled, or curved rows; in clusters similarly arranged; or essentially randomly. For illustration purposes, FIG. 9 does not show individual bristles, but shows a rough bristle envelope 805 (a volume occupied by a typical bristle row) as a simplified triangular prism shape. In addition to the bristles 110, the roller 100 includes inner pliable flaps 120, which may extend along the roller 100 generally parallel to the bristles 110. The inner pliable flaps 120 may be self-supporting (i.e., largely attached directly to some part of the brush core, such as a hollow core) or may be formed as part of and/or supported by integral ribs 125 (especially in the case where a wound spiral wire core is used). If the bristles 110 tend to spiral or follow another path, the inner pliable flaps 120 may be arranged to follow such paths or cross such paths.

In most cases, the roller 100 will rotate in a direction opposite to the direction of movement of the robot 10 (e.g., optionally facing a secondary, counter-rotating roller). However, in some cases, the roller 100 will rotate in a direction that is the same as the direction of movement during normal cleaning In some implementations, as the roller 100 spins about its longitudinal central axis, the rows of bristles 110 impinge on the tufted fibers of carpet and contact dirt, filaments, debris on the piles of the carpet. In other implementations, the inner pliable flaps 120 are positioned to bend from contact with the cleaning surface, positioned to not contact the cleaning surface, and positioned so that only some inner pliable flaps 120 contact the cleaning surface.

The narrow, stiff fibers of the bristles 110 may beat or skim the carpet pile or other surface, or sink into and emerge from the carpet pile by virtue of the spinning of the roller 100. Debris driven by or caught by the bristles 110 may be carried off of or out of the carpet pile or other surface. The debris or filaments may be swept directly into the bin 50, or toward a vacuum, secondary roller 65, or other secondary transport device may serve to entrain, catch, or capture debris and/or filaments ejected from the direction of the roller 100, either in combination with or independently of the roller 100.

As the roller 100 is applied to a cleaning surface, strands of hair, thread, or other long fibers (also referred to as the filaments 33) lying on the surface may be picked up by the rotating bristles 110 or inner pliable flaps 120 and become wound around the roller 100. In addition to a direct sweeping action, the bristles 110 also may condition tight tufts of carpet fiber, drawing debris out from the carpet which can then adhere to "sticky" material of the inner pliable flaps 120. As the bristles 110 clean the work-surface, the bristles 120 trap and pick up hair among other debris, such as the filaments 33, for example.

The inner pliable flaps 120 generally extend in a paddle-wheel arrangement generally along the length of the roller, but may also extend in a spiraling or helical arrangement similar to the reel blades of a mower reel. The diameter of the inner pliable flaps 120 may be slightly shorter than the diameter of the bristles 110 themselves, and the inner pliable flaps 120 may work in conjunction with the bristles 110. In order to place the spooling diameter appropriately and facilitate cleaning with a tool, the inner pliable flaps 120 may have a diameter measurement that is less than the diameter of the bristles 110. The inner pliable flaps 120, in the case where they are supported by integral ribs 125, extend radially from about 1-20 mm less (in the radial direction) than the radius of end caps 144 to about 1-10 mm greater (in the radial direction) than the radius of end caps 144 (for a 30-60 mm diameter roller 100; larger rollers would have flaps 120 of proportional size).

The filaments 33 are permitted to sink slightly into the bristles 110 or between the bristles 110 while winding about the outer perimeter of the inner pliable flaps 120, but not to traverse to the base of the bristles 110 at the core 140 of the roller 100. The material and/or thickness or shape of the inner pliable flaps 120 may be selected so as to support spooling of filaments 33 on the outer edges thereof, while still maintaining elastic flexibility. Creases or "dead zones" in the cleaning bristles 110 of the roller 100 may be prevented. Instead of parting or crushing the fibers of the bristles 110 at the base of the bristles 110, the rings of filaments 33 accumulate on the inner pliable flaps 120 which are below the outer edges of the bristles 110.

The presence of inner pliable flaps 120 between bristles 110 provide a spooling frame that spools the hair or other filaments 33 and prevents hair or other filaments 33 from being wound tightly along a roller body 140. In the case of a spooling frame including integral ribs 125 and inner pliable flaps 120 (e.g. in a paddle-wheel arrangement), the inner pliable flaps 120 provide a stand-off. The hair or other filaments 33 will not tightly wind about the integral ribs 125. Where a roller body 140 is used, the inner pliable flaps 120 may add strength to the bristles 110 by acting as a backbone and by keeping bristles coordinated and/or aligned properly.

The inner pliable flaps 120 collect debris that may have evaded or slipped past the bristles 110 as the bristles 110 dig into medium to high pile carpets. The bristles 110 may agitate the carpet fibers for better cleaning and the flaps 120 may beat the debris into the cleaning/picked-up-dirt-travel path. On medium to high-pile carpets, dirt picked up or dirt picked-up per unit of power consumption increases by as much to ⅓ in comparison to bristles only. This brush, and the other brushes described herein, may be employed in manual vacuum cleaners and also sweepers, including upright, canister, and central vacuum cleaners.

Referring to FIGS. 11A-15C, a roller cleaning tool 200 may be used to remove spooled filaments or hair 33 from the roller 100. The roller cleaning tool 200 includes a substantially rigid (e.g., molded plastic) tube 240 and one or more protrusions 250 (referred to as "teeth") positioned radially around the tubular tool 200 and extending from the interior surface 243 of the tube 240 toward a central longitudinal axis 201 of the tube 240. The tube 240 includes two oppositely placed openings 241, 242 (one on each longitudinal extremity of the shaft 240) through which the roller 100 may be passed (or vice versa). In cases where one opening 241, 242 is wider than the other, the two openings 241, 242 can be described as an entry openings 241 and an exit opening 242. In cases where both openings 241, 242 are of similar diameter, or the tube 240 is designed to be passed in both directions, both openings function as entry and exit openings, 241 and 242 respectively.

Figure 11B:
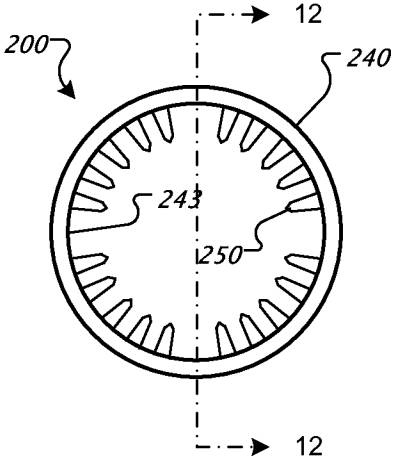
FIG. 11B is a front view of a roller cleaning tool.
Figure 11A:
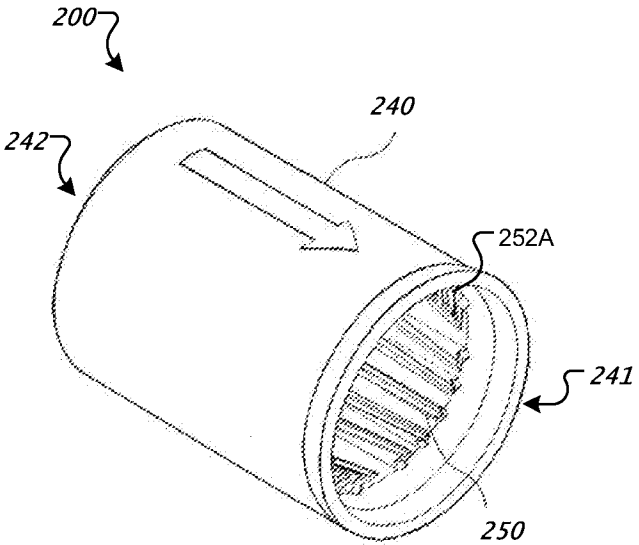
FIG. 11A is a perspective view of a roller cleaning tool.

As shown in FIGS. 11A-11B, one example of the roller cleaning tool 200 includes forward canted teeth 252A that are arranged within the main diameter of the roller cleaning tool 200, angled toward a wider entry opening. In one implementation, four clustered groups of five teeth 250 may be separated from one another by 2-8 mm and from the next cluster by 4-12 mm in a 2-5 cm tube. In some examples, the separations between teeth clusters are present in the same number as the number of integral ribs 125 or inner pliable flaps 120. The teeth 250 may include an angled entry portion or hook, e.g., a V-shaped profile on the leading edge of each tooth, opening toward the roller in the direction of tube application.

In some examples, the teeth 250 can be installed or formed in the tubular tool 200 such that the teeth 250 protrude from the inner surface 243 at a substantially orthogonal orientation to the inner surface 243. In an alternative implementation, the teeth 250 may be canted or angled toward the opening of the tubular tool 200, for example, and/or may include a hook, angle, loop, or other appropriately shaped member for seizing and retaining debris, as shown in other drawings. The teeth 250 would usually be formed in one piece with the tube by molding, especially if the tube 240 and teeth 250 are plastic; but may be formed separately from the tube 240, and then attached thereto (e.g., by forming plastic to surround or affix metal teeth within a plastic tube). Some or all of the teeth 250 may also have a leading blade to cut hairs or filaments.

In some examples, the roller cleaning tool 200 defines a "bell-mouthed" or "musket-shaped" profile having a diameter that is wider at the (mouth) opening 241. A diameter D1 of the opening 241 of the bell-mouthed tubular tool 200 may also be greater than the diameter of the bristles 110 and/or inner pliable flaps 120 of the roller 100. The opening diameter D1 permits the user to more easily guide the roller 100 into the opening 241 of the bell-mouthed tubular tool 200 due to the compaction of the bristles 110 and/or inner pliable flaps 120 of the roller 100. The opening 241 may have a diameter D1 that tapers from its widest section at the opening 241 down to a substantially constant but narrower inner diameter D2 (e.g. FIG. 13).

Figure 12:
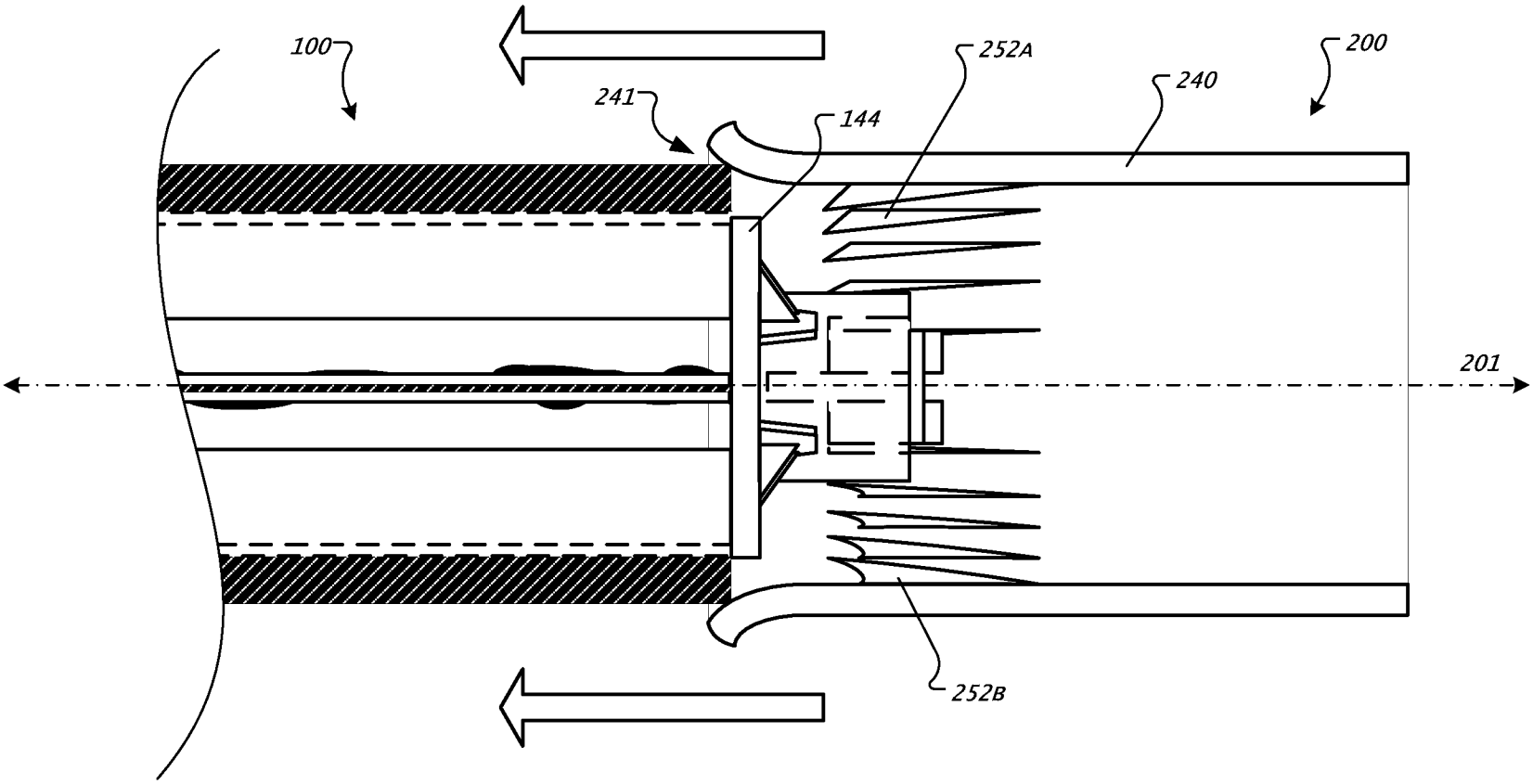
FIG. 12 is a sectional side view of a roller cleaning tool cleaning a roller.

FIG. 12 demonstrates the roller cleaning tool 200 in use. As shown, the roller cleaning tool 200 is applied with the larger opening 241 toward the roller 100, which facilitates entry of the roller 100 into the tool 200. The diameter D1 of the larger opening 241 is at least slightly larger than the axial extension or spooling diameter of the inner pliable flaps 120. Along the length of the tube 240, the tube 200 narrows to a constant, main diameter, and the inner pliable flaps 120 are deformed by the main inner diameter D2 of the tube 200. Any filaments or hairs 31 collected about the spooling diameter are positioned where they will be caught by the approaching teeth 250 (which extend into the tube 200 to a point that is closer to the roller axis 101 than the undeformed flaps 120, but farther away than the end cap 144). Two kinds of teeth 250 are shown in FIG. 12, triangular forward canted teeth 252A with a straight leading profile, and shark-tooth forward canted teeth 252B with a curved entry portion or hook, e.g., a U or J-shaped profile on the leading edge of each tooth, opening toward the roller 100 in the direction of tube application. Either or both teeth 252A, 252B may be used, in groups or otherwise.

In some implementations, the inner pliable flaps 120 of the roller 100 are soft or pliable and can flex, which allows for a manual roller cleaning tool 200 with teeth 250 to be slid length-wise, optionally with a slight twisting action, over the combination flap-bristle roller 100. The roller cleaning tool 200 compresses the inner pliable flaps 120 allowing wound-up rings of hair or filament 31 to loosen and slide off the roller 100 easily, as teeth 250 in the tool 200 grab the windings and clumps of hair or other filaments 33.

Preferably, the diameter D2 of a portion of the tube 240 (and/or the entry 241 and/or exit opening 242 of the tube 240) is less than the undeformed diameter of the bristles 110 or beaters 111, and when inner pliable flaps 120 are provided, less than the inner pliable flaps 120 of the roller 100. As the roller 100 passes through the roller cleaning tool 200, the bristles 110 and/or inner pliable flaps 120 of the roller 100 deform inward such that the tension of any filaments 33 spooled around the bristles 110 and/or inner pliable flaps 120 is relieved by the deformation. Teeth 250 placed to work within any spooling diameter catch the filaments without necessarily relying upon the deforming the bristles or inner pliable flaps 120. Deforming bristles 110 to bend away from the direction of tube movement facilitates movement of clumps and filaments 33 off the end of the bristles 110 as the ends of the bristles 110 are curved to point in the direction of the tube movement. Deforming the inner pliable flaps 120 (or any beaters) to bend toward the axial center of the tube 240 facilitates movement of clumps and filaments 33 along the deformed inner pliable flaps 120 in the direction of the tube movement.

Figure 13:
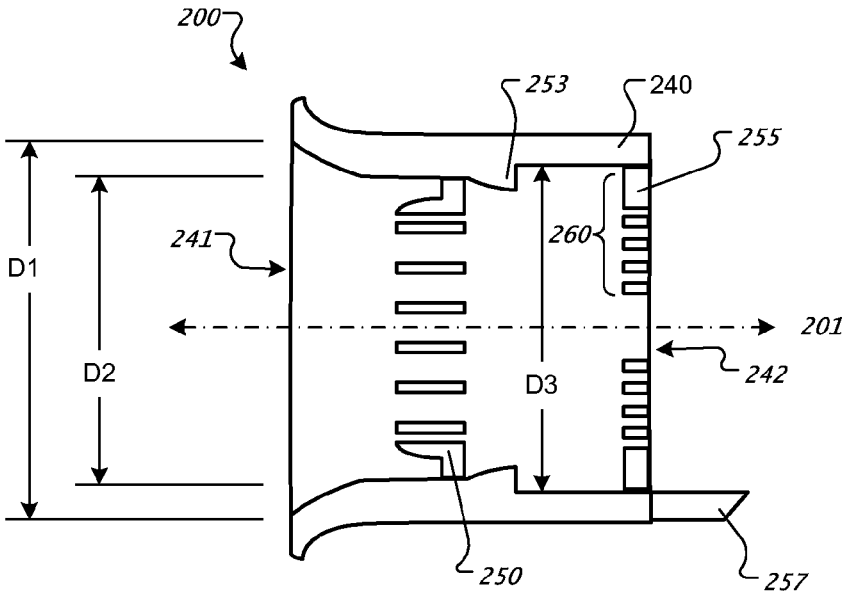
FIG. 13 is a sectional side view of a roller cleaning tool.

Referring to FIG. 13, in some implementations, the roller cleaning tool 200 includes trailing comb teeth 255, which may grab and trap remaining loose strands of filaments 33 or debris. The trailing comb teeth 255 form the internal tines of at least one comb 270 protruding from the internal surface 243 of the tube 240. If filaments or hairs 31 from a roller 100 are missed or released by the teeth 250, one or more tines 255 of one or more combs 260 provide an additional debris-seizing mechanism. The combs 260, having a smaller size and spacing, also tend to slide along the forward-bent bristles 110, entraining hair and filaments that are not necessarily hooked by the teeth 250. The tines 255 may be formed to be more deformable, deeper, thinner, or harder (and vice versa) than the teeth 250. The tines 255 may elastically bend, and/or scrape or sweep the exterior surfaces of the core 140 of the roller 100 and/or the bristles 110. In the example shown, the trailing comb teeth 255 are disposed in a trailing region of the tube 240 having a diameter D3 larger than the diameter D2 of a fore-region of the tube 240.

In some examples, the tool 200 includes one or more protrusions 253 extending from the interior surface 243 toward the center axis 201 of the tube 240 and located rearward of the teeth 250. The protrusion 253 may be defined as a continuous ring extending inward from the interior surface 243 of the tube 243. The protrusion 253 aids filament 31 removal.

In some examples, the tool 200 includes a cutter 257 for cutting filament or other objects off the roller. In the example shown, the cutter 257 extends longitudinally off the exit end 242 of the tool 200. In other examples, the cutter 257 may extend laterally or at any angle off the entry end 241, exit end 242, or anywhere therebetween.

Each tooth 250, in some examples, is about 1-2 mm wide and spaced from a neighboring tooth 250 in the same group by about the same amount, the trailing comb teeth 255 are less than about 1 mm wide and spaced equal to or less than their width. One exemplary distribution has six groups of two to five teeth 250, and six groups of seven to fifteen trailing teeth 255 (the number of groups may correspond to the number of bristles 110; integral ribs 125; or inner pliable flaps 120). In some instances, the teeth 250 are configured as forward-pointing hooks or finger teeth rather than a comb tooth.

In some implementations, the teeth 250 may be arranged in two or more positions longitudinally along the length of the tubular tool 200. For example, the teeth 250 at the second position may be comb teeth rather than hook teeth, e.g., first (hook) teeth 250 extend inward toward the center of the tubular tool 200 near a first opening of the tubular tool 200, and second (comb) teeth 250B, extend inward by less than the teeth 250 at a second position farther away from the opening. Insertion effort required to initially insert the roller 100 into the tubular tool 200 may be designed by altering the diameter, bell mouth, and positioning of the teeth 250 at particular distance from the opening of the tubular tool 200. Alternatively, the teeth 250 and 255 may be positioned at the same longitudinal position along the tubular tool 200, at different positions and depths about the circumference, individually or in clusters, so that thicker or thinner accumulations of filaments and/or having varying degrees of tufting or fraying are more likely to be engaged by at least one of the clusters of teeth 250 or 255.

Figure 14:
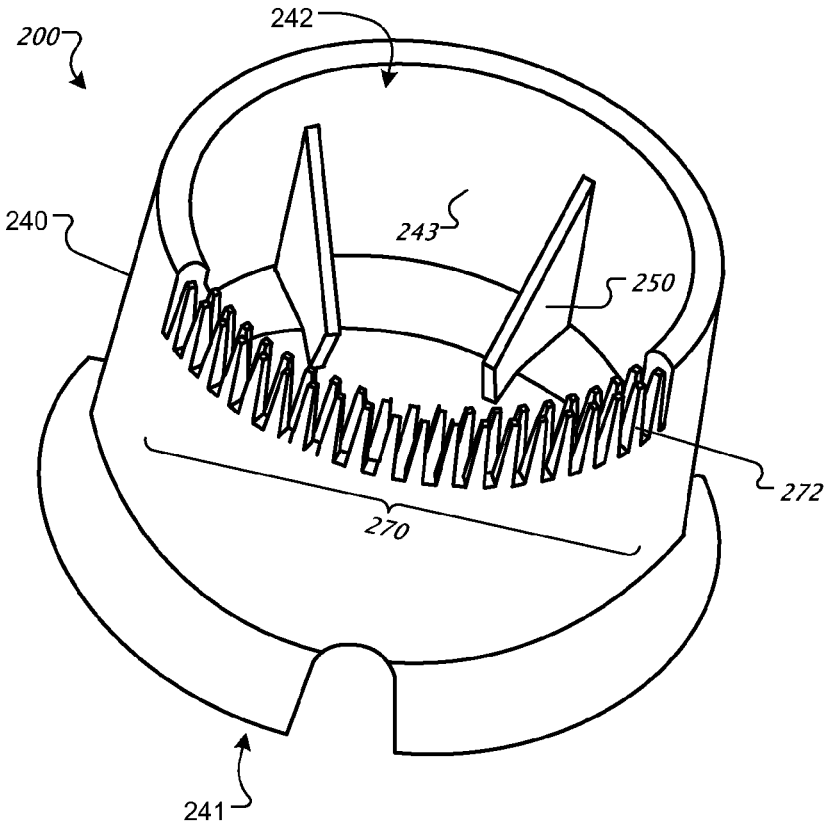
FIG. 14 is a perspective view of a roller cleaning tool.

Referring to FIG. 14, in some implementations, the tool 200 includes a fuzz comb 270 extending in the longitudinal direction. The multi-tine comb 270 is arranged along a sector of the exit end 202 of the tube 200. Staggered multiple rows of teeth 272 in the fuzz comb 270 grab fine fuzz and wooly pet hair off the brush bristles 110. Staggered multiple rows of teeth 272 provide superior combing over a standard single-row comb. In some examples, the comb 270 includes parallel arranged teeth 272 that taper at a distal end and configured as flat cantilevered beams off the exit end 242 of the tool 200. In other examples, the comb 270 does not extend beyond the exit end 242 of the tool 200 (as shown). After passing the cleaning tool 200 over the roller 100 one or more times to remove debris or filament, the comb 270 may be used to clean remaining hair or filaments not previously removed. As such, the tool 200 combines the features of a stripping ring tube and a flat brush, and the user need not pick up two tools or put down the roller 100 in order to finish detailed cleaning of the roller 100.

Figure 15:
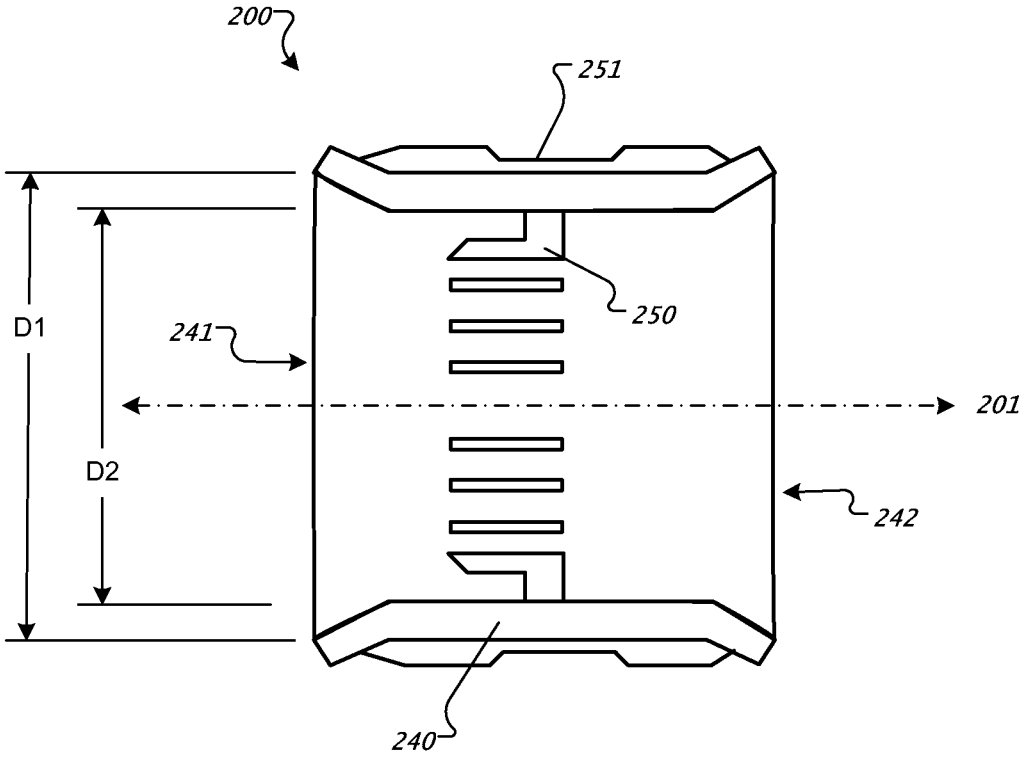
FIG. 15 is a sectional side view of a roller cleaning tool.

FIG. 15 shows a side section view of another implementation of the roller cleaning tool 200. The example shown shares many features with the tools 200 described earlier. In this case, the outer surface of the tube 240 is provided with dumb-bell shaped knurling ribs 251, each gripper knurling rib extending longitudinally, with a lesser diameter portion in the longitudinal center. The knurling provides a readily gripped surface, as well as some additional structural strength. Weight-saving holes may be formed through the outer surface of the tube in view of the additional structural strength provided by the knurling/ribs. In some implementations, the tool 200 is configured in which both longitudinal ends 241, 242 of the tube 240 are of a greater diameter D1 than the main inner diameter D2.

In some examples, the teeth 250 and/or the tube 240 are configured to provide tooth depth adjustment. By varying the depth of the teeth 250, the tool 200 may be (i) used to remove resistant accumulations of filaments or hair in a stepwise manner and/or (ii) used to clear debris from different types of rollers which may have different bristle and/or inner pliable flap diameters, or different roller core diameters.

In one example, a brush roller 100 wound with many filaments may be difficult to clear in a single pass through the tube 200 due to removal resistance of a tight concentration of hair or spooled filaments by the teeth 250. Removal of accumulations of filaments may be facilitated by adjusting the depth of the teeth 250 between cleaning passes. The user may initially adjust the depth of the teeth 250 to a shallower setting such that the teeth 250 only catch an outermost layer of accumulated filaments 33. Thereafter (after cleaning the first collected accumulation from the tubular tool), the user may adjust the depth of the teeth 250 to a deeper setting, and pass the roller 100 through the tubular tool 200 again, catching another layer. The process of adjusting the depth may be repeated until all the debris is removed from the roller 100.

When the tool 200 is used on different rollers (e.g., both brushes of a dual brush cleaner, different brushes on different cleaners), a tooth depth may be set to be as close as possible to the outermost diameter of the core 140 of the roller 100, while still clearing the core 140 when the roller 100 is passed through the tubular tool 200. If the tool 200 is provided for use with two different rollers 100 of one cleaner, the adjusting mechanism may include two detents for the tightest clearance of each kind of roller 100. In order to adjustably attach the teeth 250 to the tubular tool 200, the teeth 250 themselves 250 may be threaded. Alternatively, adjustment of the teeth 250 may be achieved using wedging and friction, or any other suitable technique and/or structure. Each of the implementations depicted in the drawings may include an adjustment mechanism (an adjusting ring, threading, or the like) to change the radial depth of the teeth 250.

Figure 16A:
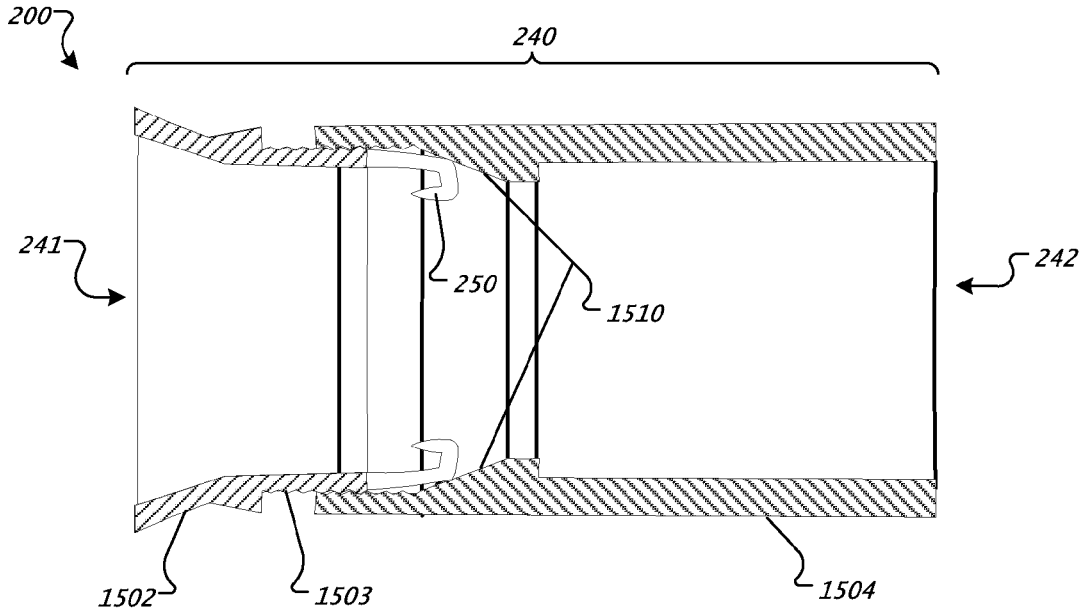
FIG. 16A-16B are sectional side views of a roller cleaning tool.
Figure 16B:
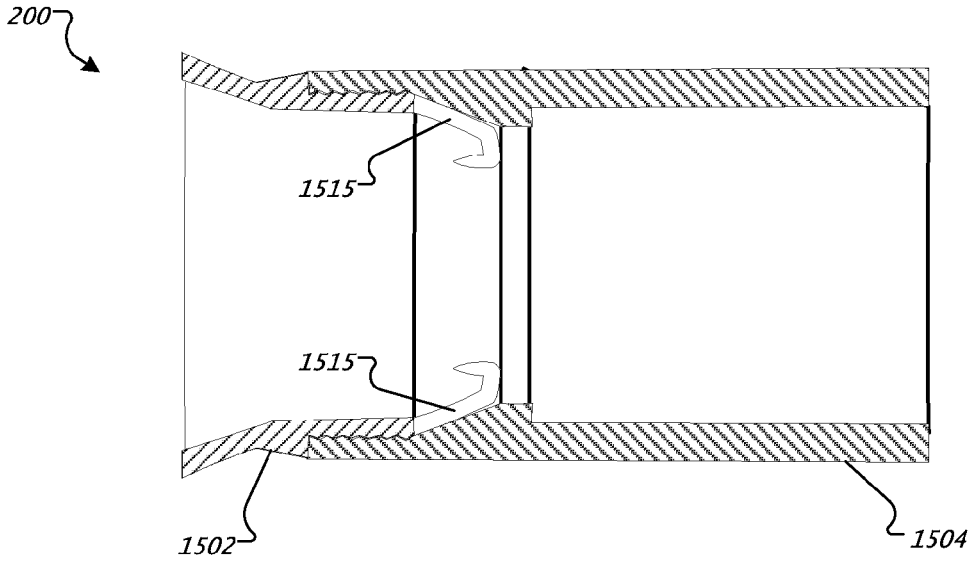

FIGS. 16A-16B shows an exemplary structure for adjusting the tooth depth. The tube 240 includes an inner tube 1502 (including teeth 250) having threads 1503 threadable into an outer tube 1504. Both the inner tube 1502 and the outer tube 1504 have essentially similar inner and outer diameters. At a shallow position shown in FIG. 16A, an internal conic surface 1510 abuts a series of cantilevered teeth 250, permitting each tooth 250 to keep an essentially undeformed profile at the shallower level. The arms 1515 of the cantilevered teeth 250 are formed from durable, fatigue-resistant or softer plastic or elastomer. As the inner tube 1502 is screwed into the outer tube 1504 toward the position shown in FIG. 16B, the internal conic surface 1510 forces the arms 1515 of the teeth 250 to deform, pushing the all of the teeth 250 to a deeper level. This is merely one example of an adjusting mechanism; other mechanisms may be used. In this example, the depth of the teeth 250 is continuously adjustable. However, this mechanism or other mechanisms may render the depth of the teeth 250 adjustable in a stepwise manner with detents or markings to denote particular recommended stopping positions (e.g., for larger or smaller brushes).

Figure 17A:
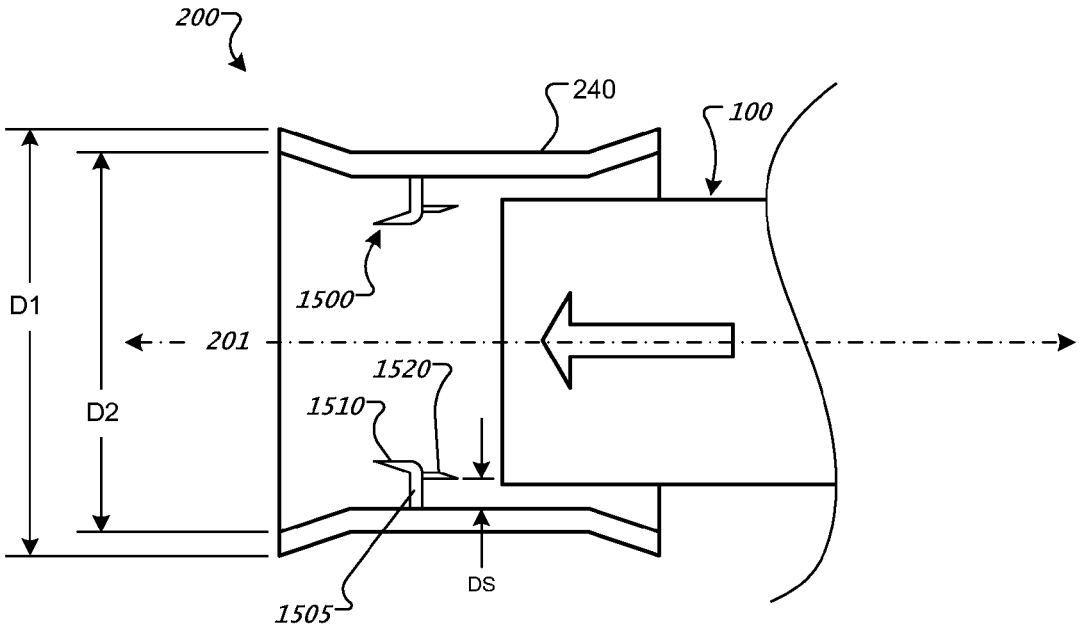
FIG. 17A-17B are sectional side views of a roller cleaning tool cleaning a roller.
Figure 17B:
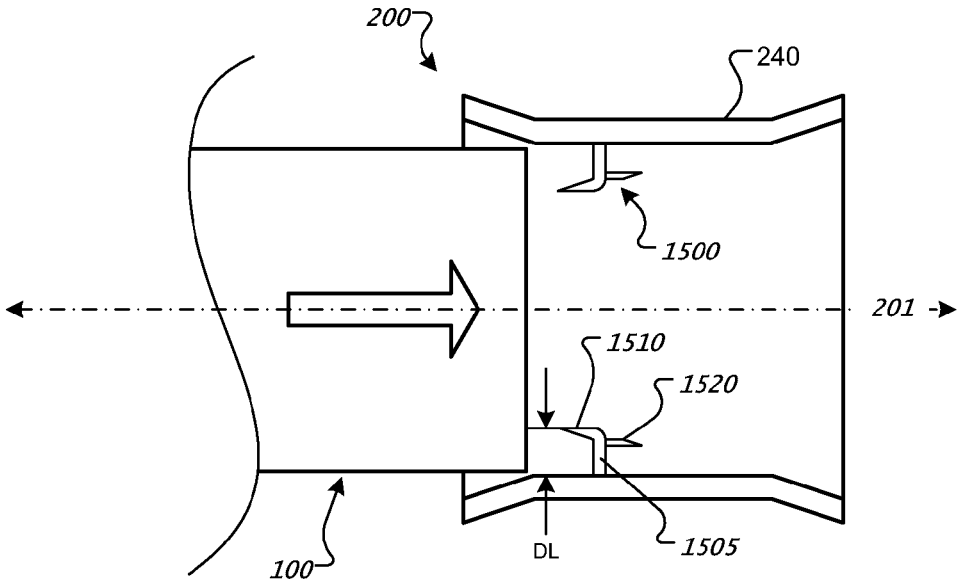

Referring to FIGS. 17A-17B, the tool 200 may also be bi-directional, such that the teeth 250 and inner diameter are arranged to clean a smaller diameter roller inserted from one side (FIG. 17A), and a larger diameter roller from the other side (FIG. 17B). Teeth 1500 are configured with first and second projections, 1510 and 1520 respectively, extending from a stem 1505 in opposite directions along the longitudinal axis 201 of the tube 240. The first projection 1510 is position higher at a distance DL from the interior surface 243 of the tube 240 than the second projection 1520, which is positioned at a distance DS from the interior surface 243 of the tube 240.

Figure 18A:
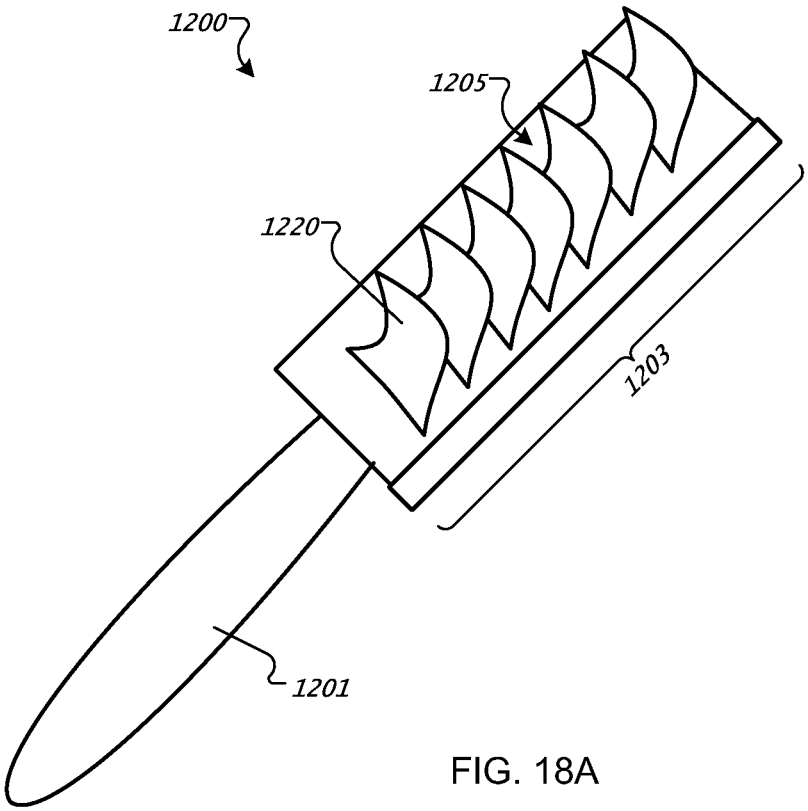
FIG. 18A-18B are front and rear perspective views a dematting rake and slicker brush tool.
Figure 18B:
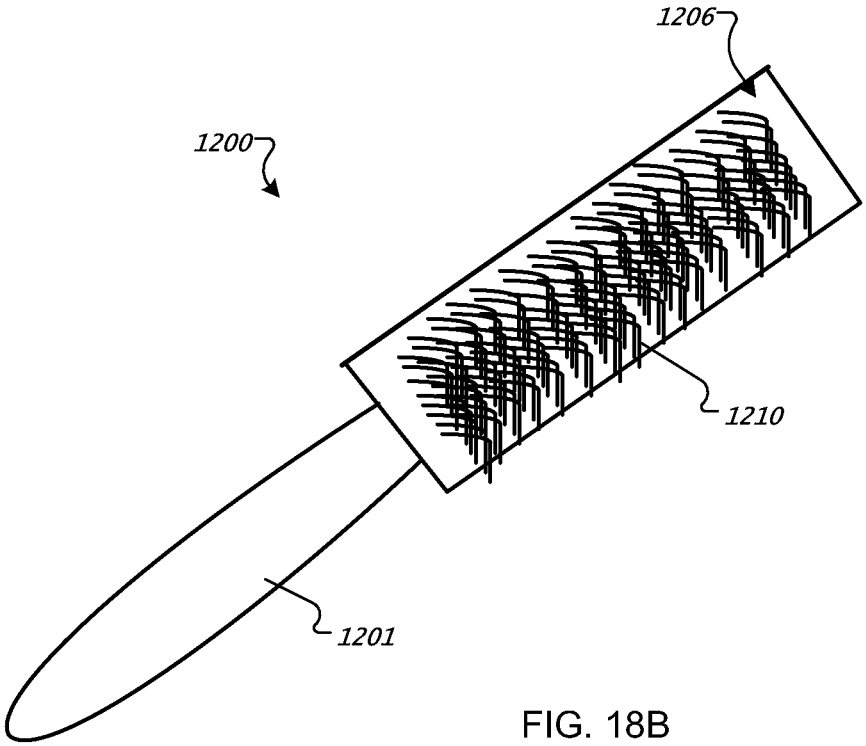

FIGS. 18A-18B illustrate a dematting rake and slicker brush 1200 that may be used to clear debris from the roller 100. The dematting rake/slicker brush 1200 may be include a handle 1201 and a cleaning head 1203 which may have a first (e.g., generally flat) side 1205 and a second (e.g., generally flat) side 1206 opposite the first side 1205. The first side 1205 of the cleaning head 1203 includes a series of dematting blades 1220. The second side 1206 of the cleaning head 1203 includes slicker tines 1210 are arranged to accumulate filaments 33 which may be wound on the roller 100. The operator may use the first side 1205 of the dematting rake/slicker brush 1200 to break up accumulations of filaments 33 on the roller 100, and then use the slicker brush to collect the same, without changing brushes or putting down the robot 10 or removed roller 100. The slicker tines 1210 tend to permit hair or filaments 33 to be removed by flattening the slicker tines 1210 and drawing the slicker brush 1200 along a surface (including the user's hand).

Figure 19A:
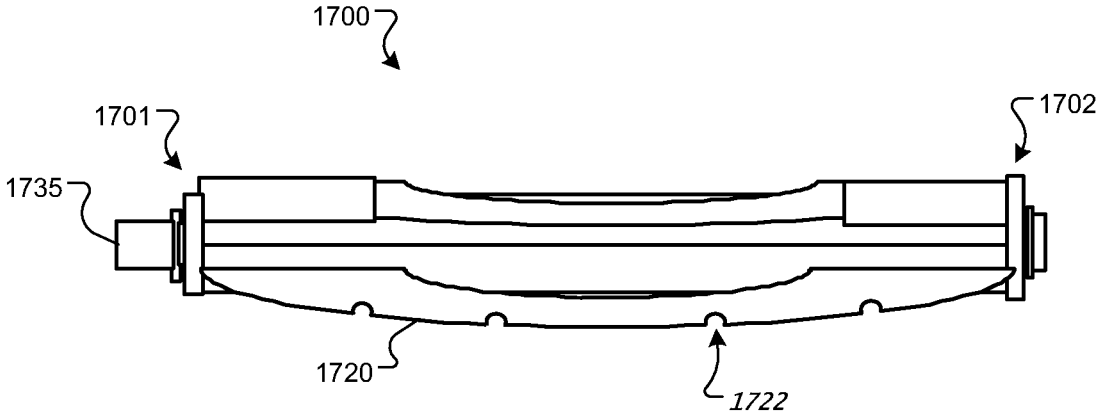
FIG. 19A is a side view of a cleaning roller for a coverage robot or cleaning device.
Figure 19B:
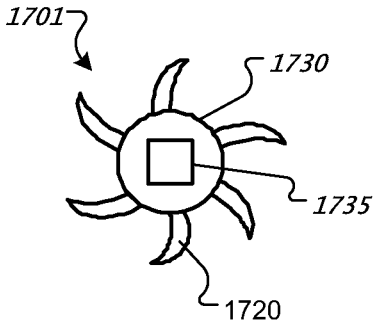
FIG. 19B-19C are end views of a cleaning roller for a coverage robot or cleaning device.
Figure 19C:
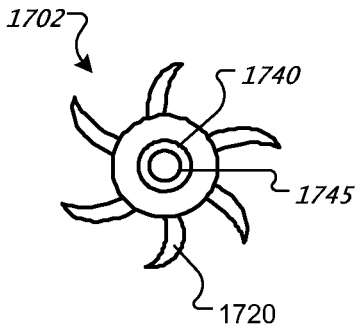

FIGS. 19A-C depicts a smaller roller 1700 having first and second ends 1701 and 1702, respectively, including overmolded polymer/elastomeric flaps 1720 arranged lengthwise along a core 1730 with a slight curvature along the length. These flaps 1720 define notches 1722 (only some shown) to accommodate wire bales. The first end 1701 of the roller 1700 includes a square peg 1735 driven by a cleaning head motor (e.g. via a gearbox). The second end 1702 of the roller 1700 includes a circular or hex-shaped peg 1740, which incorporates a bronze bushing 1745.

The selection of brush may be made in view of the following characteristics, inter alia: a) ability to clean various kinds of debris; b) ability to move swept hair into the bin; c) ability to allow manual cleaning of the brush; d) lowest possible brush bounce.

Figure 20:
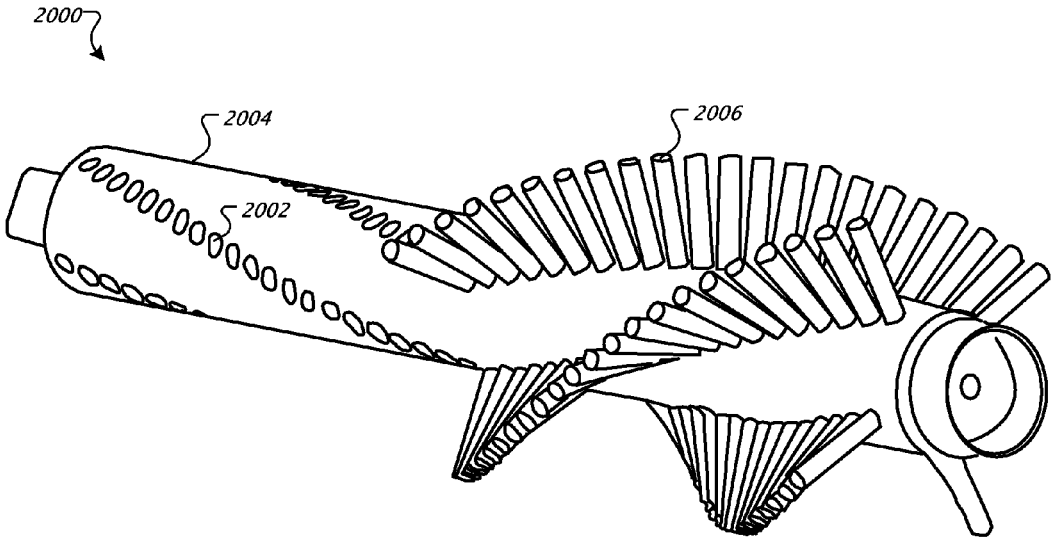
FIG. 20 is a perspective view of a cleaning roller for a coverage robot or cleaning device.

Bristles may assist in picking up hair effectively. In one implementation, a cylindrical brush 2000 as illustrated in FIG. 20 can fling more hair into the bin 50 of the robot 10, trapping less within the bristle structure. The brush 2000 is manufactured by populating long bristle plugs 2002 defined in a solid-core shaft 2004 lengthwise and in a slightly cambered fashion with bristles 2006. The long bristles 2006 allow for better flexing, thereby decreasing power consumption. The brush 2000 may contain three, four, or more curved rows of bristle-plugs 2002 to keep the brush 2000 in constant contact with the work surface, thereby reducing the chordal action of brush and brush bounce.

Figure 21:
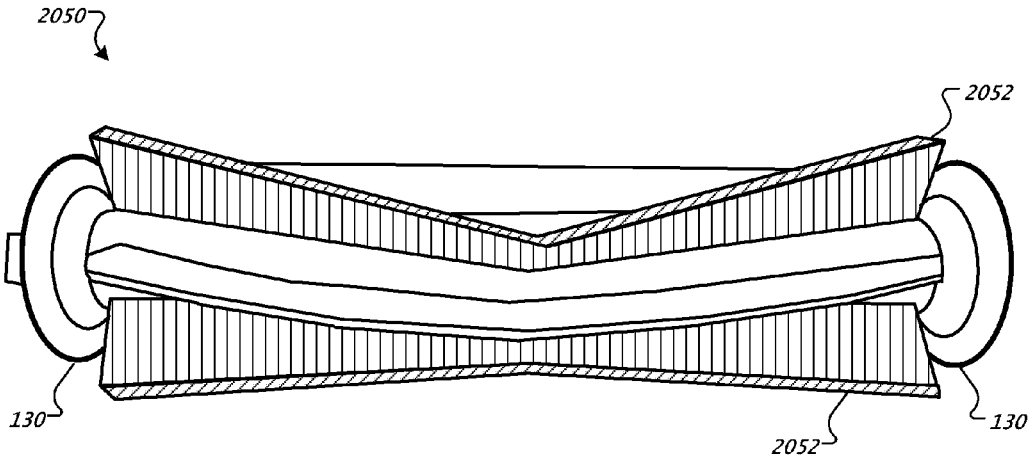
FIG. 21 is a side view of a cleaning roller for a coverage robot or cleaning device.

FIG. 21 depicts a brush 2050 including V-shape bristle rows 2052 configured to act as a scooping device in the direction of rotation. The V-shape bristle rows 2052 (depicted as a bristle envelopes) funnel debris inwards as ramps, increasing the deposition of debris into the bin 50. In this example, the end guards 130 may be easily twisted off the brush 2050.

Figure 22:
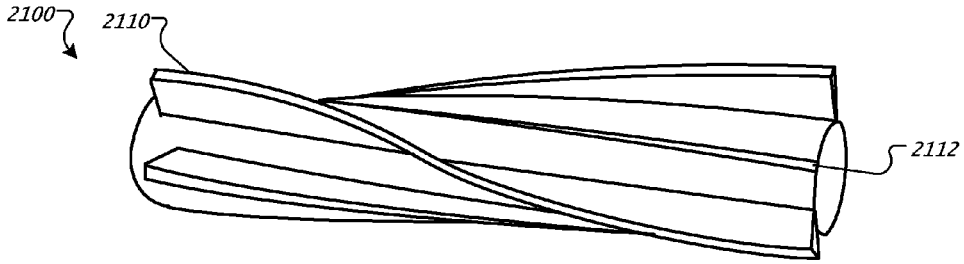
FIG. 22-24 are side views of a cleaning roller for a coverage robot or cleaning device.
Figure 23:
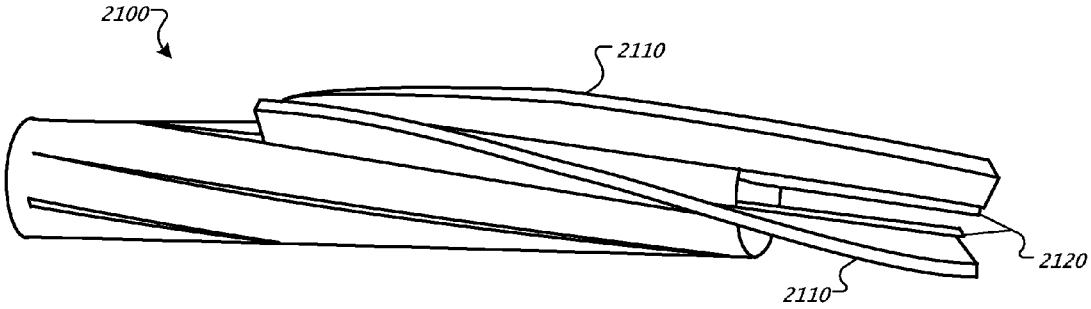
Figure 24:
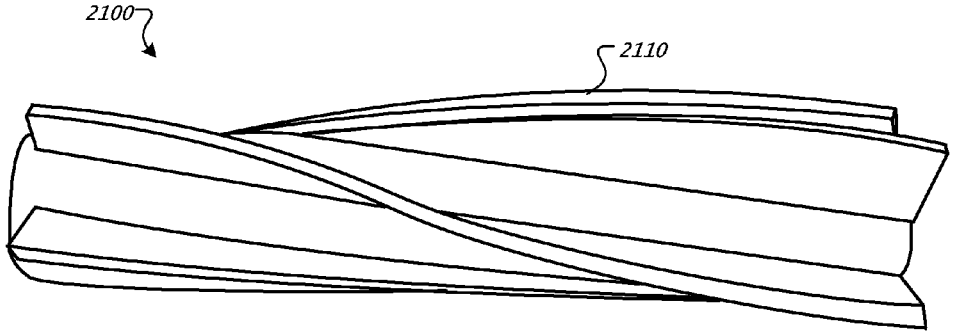

FIGS. 22-24 illustrate a brush roller 2100 including a removable bristle tuft 2110. The brush roller 2100 allows entire rows 2110 of bristles 110 to be removed exposing the core for cleaning and washing, if necessary. The removable rows 2110 of bristles 110 are embedded into an extruded-style backing 2120 (see FIG. 22). This allows the bristle-rows 2110 to be slid into a bristle tuft groove 2112 defined by the brush 2100 and removed for manual cleaning of the brush 2100. The bristle rows 2110 may be disposable after a period of use (see FIG. 21). A gradual single-helix bristle tuft groove 2112 containing a bristle tuft 2110 provides a low bounce condition.

Figure 25A:
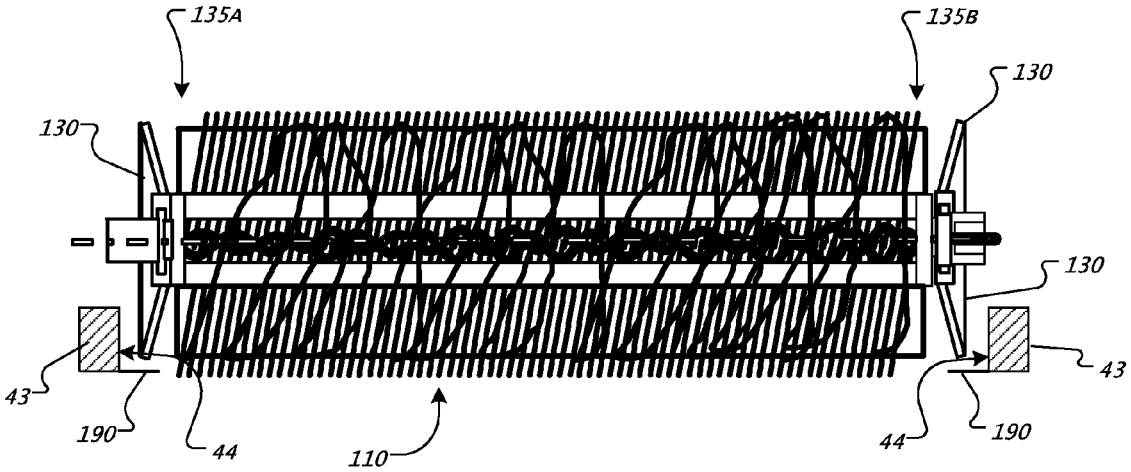
FIG. 25A is a side view of a cleaning roller for a coverage robot and a sectional view of a wire bail assembly.
Figure 25B:
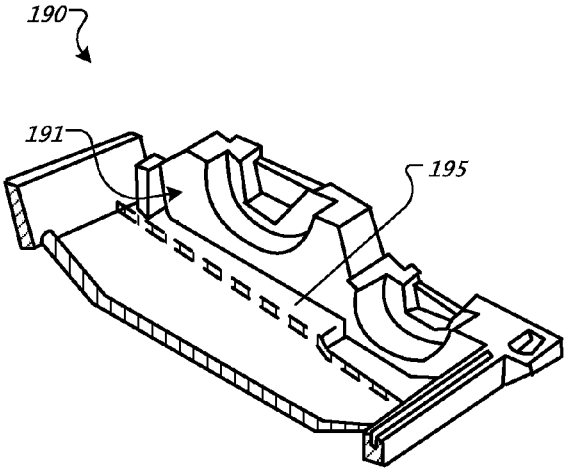
FIG. 25B is a partial perspective view of a wire bail assembly.
Figure 25C:
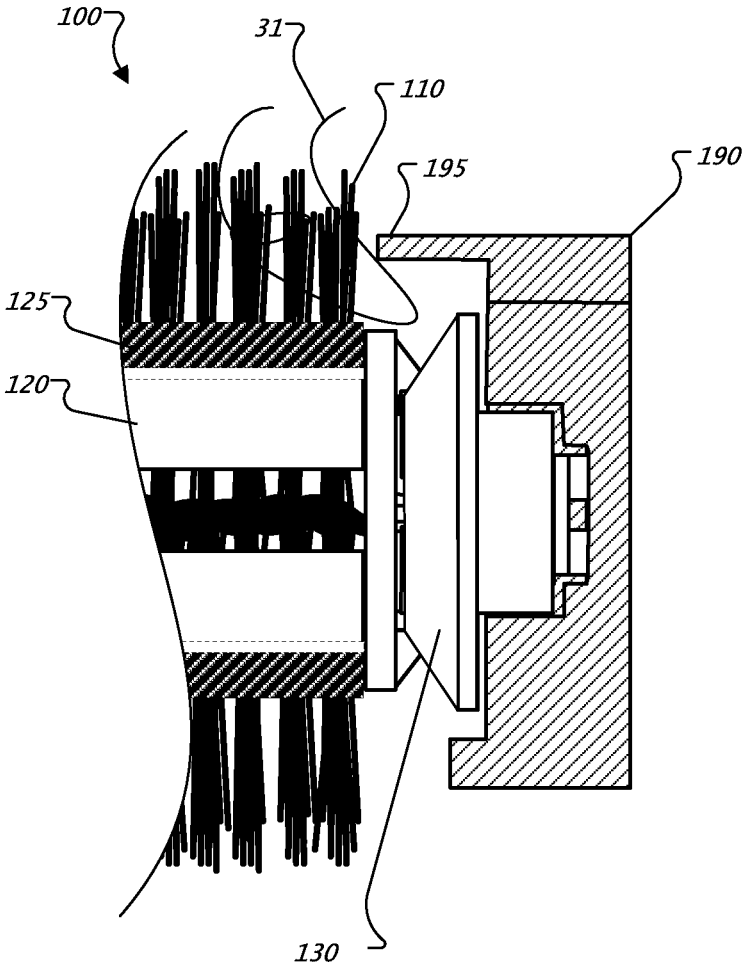
FIG. 25C is a side view of a cleaning roller for a coverage robot and a sectional view of a wire bail assembly.

Referring to FIGS. 25A-25C, the bristles 110 normally pick up hair as the brush 100 spins, any part of hair that extends past the bristles 110 gets wrapped in the brush ends 135A, 135B. While elastomeric-molded-cones or end guards 130 (or other disc shaped parts) may be attached to the ends 135A, 135B of the brush 100 to aid prevention of hair entanglement, the end guards 130 may themselves, via static, or by physical interference grab hair or filaments 33 off carpets and wrap it between cleaning head walls and the end guard 130, creating an entanglement in the bearings 143 and brush ends 135A, 135B. In some examples, the cleaning head assembly 40 includes a wire bale assembly 190 having shelves 195 (e.g. ski-like blades) extending laterally from the inner walls 191 of toward the bristles 110. The shelves 195 may extend along the entire length of a wire bale on the inner walls 191 of the wire bale assembly 190. The bristle diameter is sized so that the bristles 110 extends past the shelf 195. The shelf 195 acts as a spooling guide by directing the entry of hair or filaments 33 into the bristles 110 and away from the brush ends 135A, 135B. The shelf 195 also prevents static built on the sidewalls 44 of the cleaning head chassis 43 from attracting hair. The cone 130 acts as a spool, wrapping on itself any leftover end-length of hair trapped by the bristles 110 and preventing hair or filaments 33 from getting wound into the extremes of the bristle brush ends 135A, 135B. The cone barrier 130 also prevents hair from getting attracted to the sidewalls of the cleaning head assembly 40.

Figure 26:
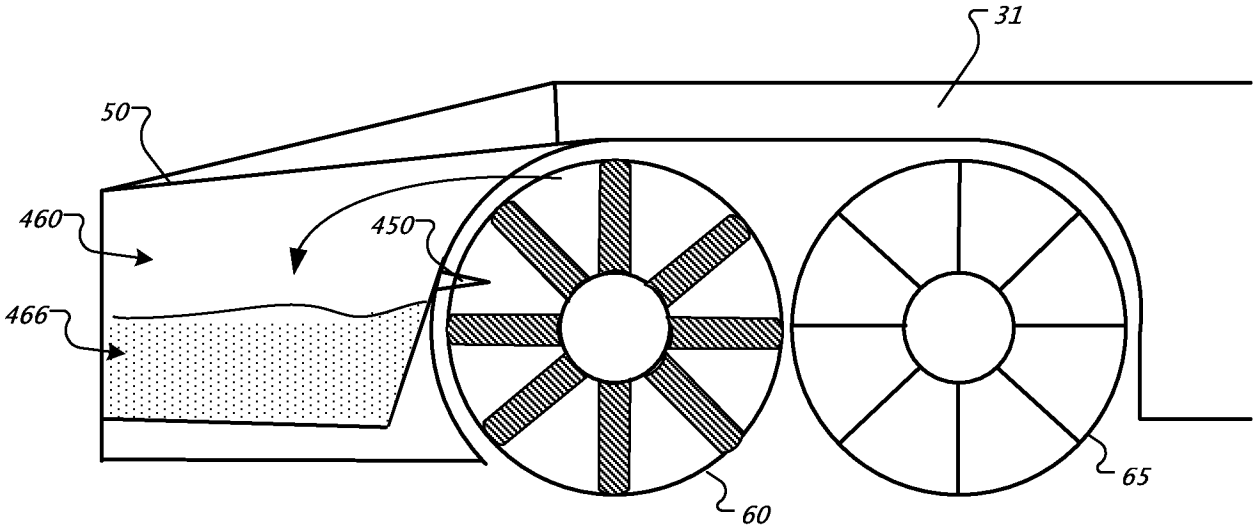
FIG. 26 is a schematic view of a coverage robot with a cleaning bin.

Referring to FIG. 26, the robot 10 may include a bin 400 defining a sweeper bin portion 460 and including a comb or teeth 450 disposed engagingly adjacent the bristle brush 60 and configured to comb hair or debris off the bristle brush 60 as the brush 60 rotates. In some examples, the comb 450 is disposed at the mouth of a cleaning bin 50 of the robot 10. Referring back to FIG. 10, the bin 50 may include a sweeper portion 460 with teeth 450 disposed at a month of the sweeper portion 460 engagingly adjacent the main roller 60 of the cleaning head assembly 40 and a vacuum portion 461 having a squeegee mouth 451.

A spinning roller 100 situated closely to the bristle brush 60 and powered by the same gear-train rolls hair onto itself thus lowering the hair entrapment on the bristle brush 60. The spinning roller 100 may have a sticky surface like that of a lint-roller, or a silicone type hair grabbing surface.

Referring back to FIG. 1B, in some implementations, the robot 10 includes a communication module 90 installed on the bottom of the chassis 31. The communication module 90 provides a communication link between the communication module 1400 on the maintenance station 5100 and the robot 10. The communication module 90, in some instances, includes both an emitter and a detector, and provides an alternative communication path while the robot 10 is located within the maintenance station 5100. In some implementations, the robot 10 includes a roller full sensor assembly 85 installed on either side of and proximate the cleaning head 40. The roller full sensor assembly 85 provides user and system feedback regarding a degree of filament wound about the main brush 65, the secondary brush 60, or both. The roller full sensor assembly 85 includes an emitter 85A for emitting modulated beams and a detector 85B configured to detect the beams. The emitter 85A and detector 86B are positioned on opposite sides of the cleaning head roller 60, 65 and aligned to detect filament wound about the cleaning head roller 60, 65. The roller full sensor assembly 85 includes a signal processing circuit configured to receive and interpret detector output. In some examples, the roller full sensor system 85 detects when the roller 100 has accumulated filaments, when roller effectiveness has declined, or when a bin is full (as disclosed in U.S. Provisional Patent No. 60/741,442, filed Dec. 2, 2005, and herein incorporated by reference in its entirety), trigging automatic clearing of debris from the roller 100 (i.e., the return of the robot to a cleaning station, as described below). In some examples, the robot 10 includes a head cleaning tool 200 configured to clear debris from the roller 100 in response to a timer, a received command from a remote terminal, the roller full sensor system 85, or a button located on the chassis/body 31 of the robot 10.

Once a cleaning cycle is complete, either via the roller full sensor system 85 or visual observation, the user can open the wire bale and pull the roller(s) 60, 65. The roller 60,65 can then be wiped clean off hair and inserted back in place.

Figure 27:
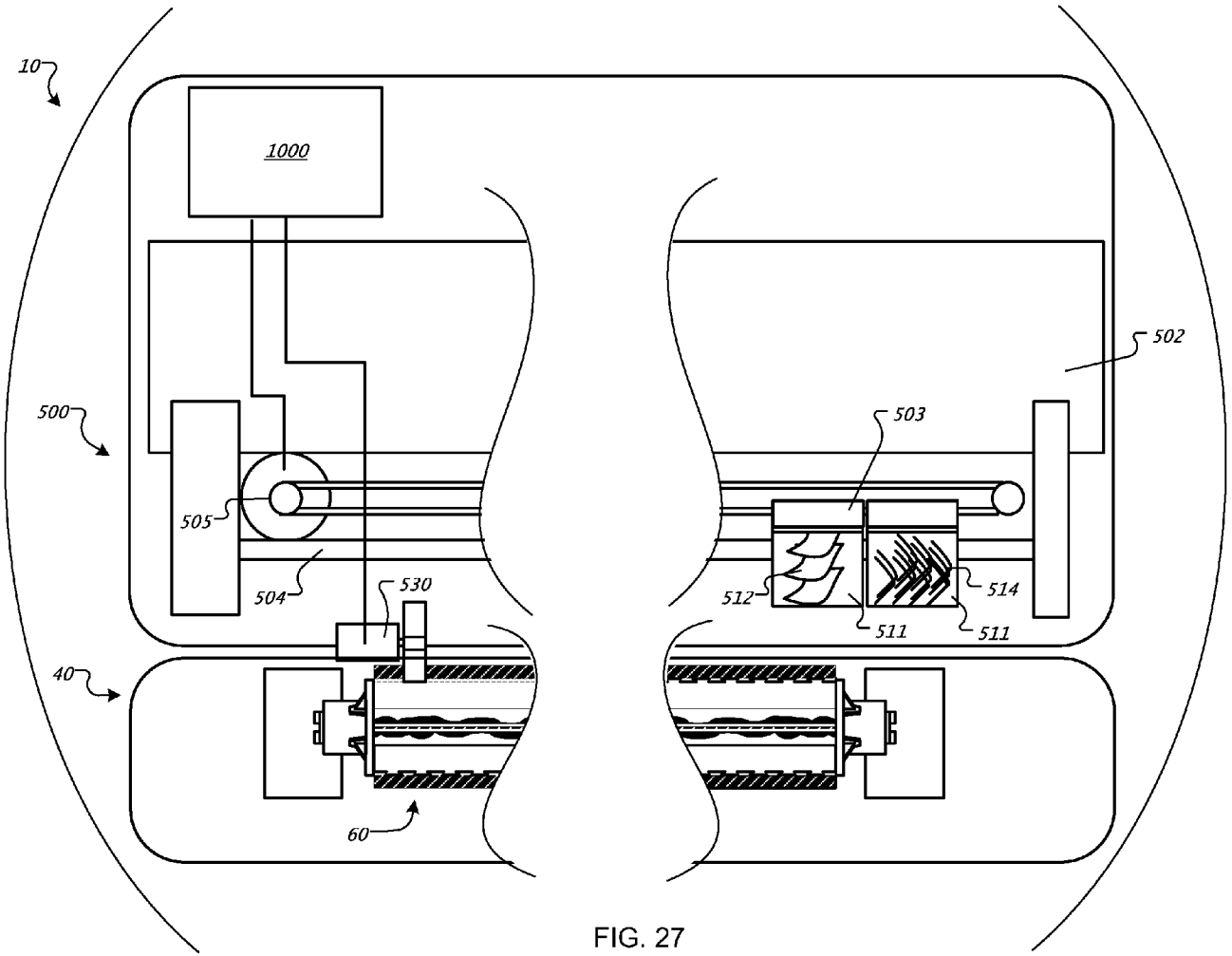
FIG. 27 is a c a coverage robot with a roller cleaning assembly.
Figure 28A:
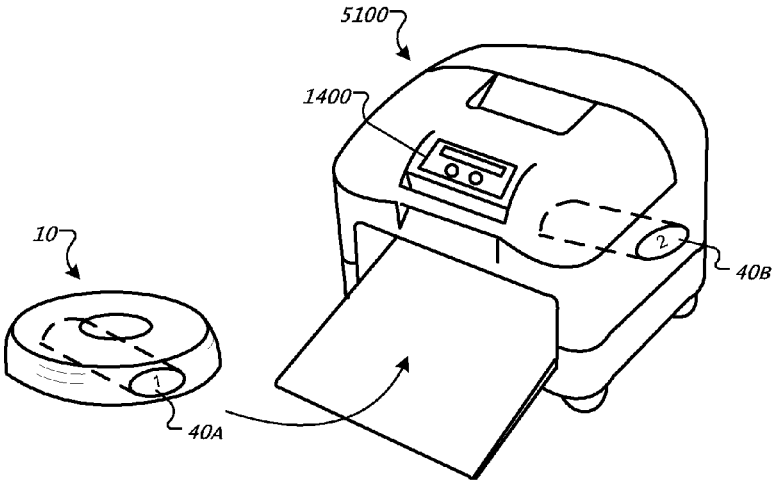
FIG. 28A-28F are schematic views of a coverage robot interacting with a maintenance station for roller cleaning.
Figure 28B:
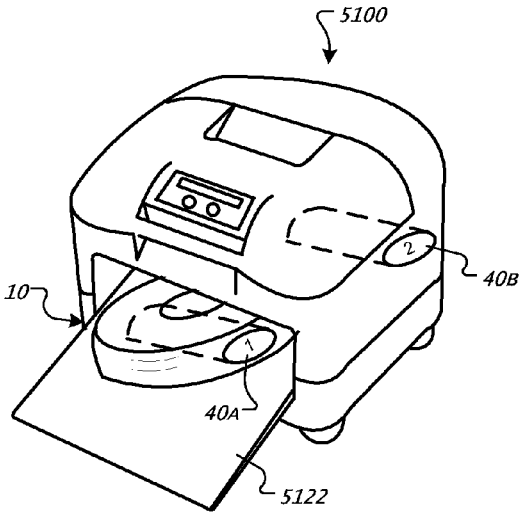
Figure 28C:
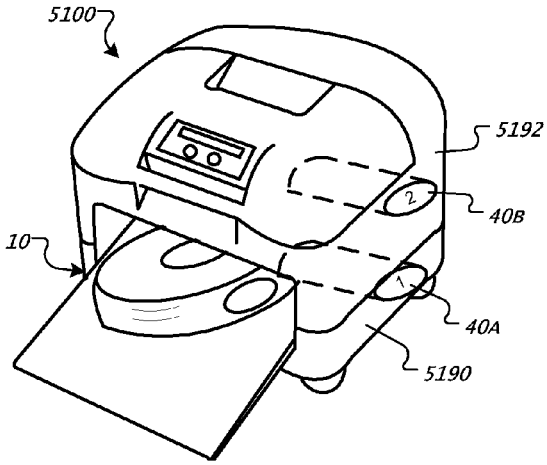
Figure 28D:
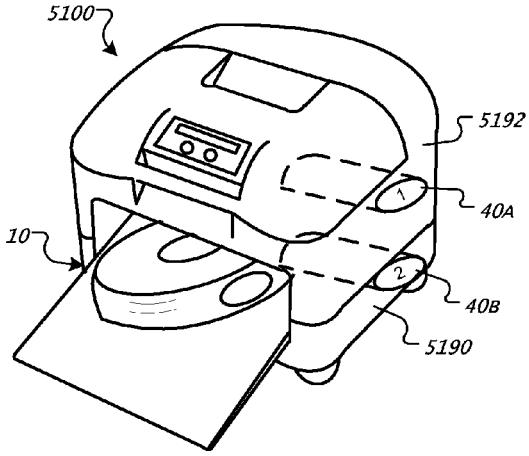
Figure 28E:
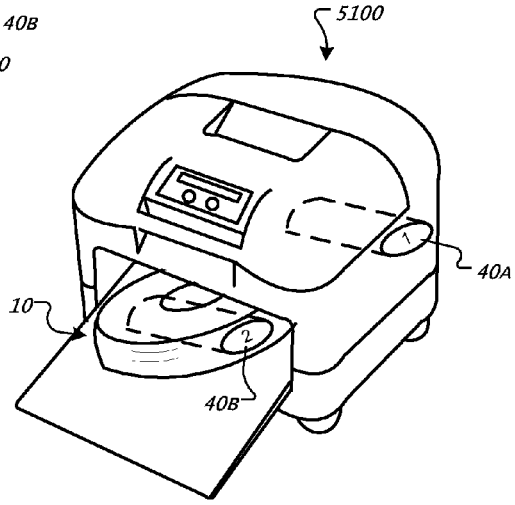
Figure 28F:
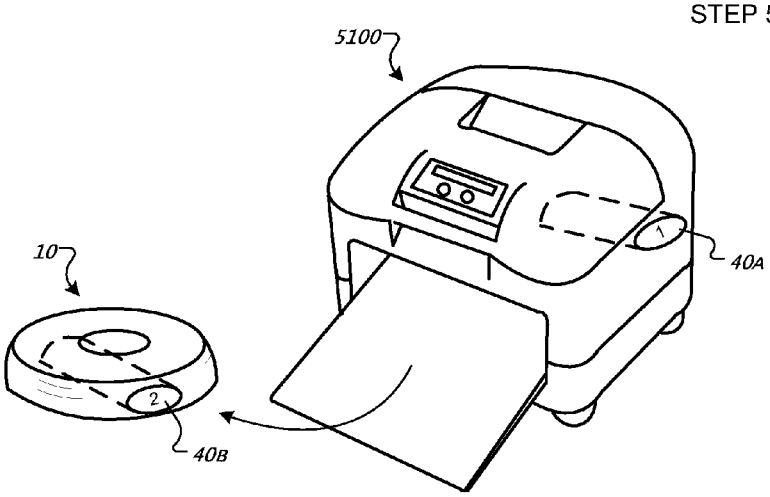

Referring to FIG. 27, in some implementations, the robot 10 includes a roller cleaning assembly 500 controlled by a controller 1000 carried by the robot 10 for automatically cleaning one or more rollers 100 carried by the cleaning head 40. The roller cleaning assembly 500 includes a driven linear slide guide 502 carrying a cleaning head cleaner 510 (e.g. a roller cleaning tool 200 configured as a semi-circular or quarter circular tool) and/or a trimmer 520. In some examples, the driven linear slide guide 502 includes a guide mount or rail follower 503 slidably secured to a shaft or rail 504 and belt driven by a motor 505. A rotator 530 rotates the roller 60, 65 during cleaning.

The cleaning head cleaner 510, in some examples, includes a series of teeth or combs 512 configured to strip filament and debris from a roller 60, 65. In some implementations, the cleaning head cleaner 510 includes one or more semi-tubular or quarter-tubular tools 511 having teeth 512, dematting rakes 514, combs, or slicker combs. The tubular tool 511 may be independently driven by one or more servo, step or other motors 505 and transmissions (which may be a belt, chain, worm, ball screw, spline, rack and pinion, or any other linear motion drive). In some examples, the roller 60, 65 and the cleaning head cleaner 510 are moved relative to one another. In other examples, the cleaning head cleaner 510 is fixed in place while the roller 60, 65 is moved over the cleaning head cleaner 510.

The robot 10 commences a cleaning routine by traversing the cleaning head 510 over the roller 60, 65 such that the teeth 512, dematting rakes 514, combs, or slicker combs, separately or together, cut and remove filaments and debris from the roller 60, 65. In one example, as the cleaning head 510 traverses over the roller 60, 65, the teeth 512 are actuated in a rotating motion to facilitate removal of filaments and debris from the roller 60, 65. In some examples, an interference depth of the teeth 512 into the roller 60, 65 is variable and progressively increases with each subsequent pass of the cleaning head 510.

Referring to FIGS. 28A-F, in some implementations, the robot 10 includes a removable cleaning head cartridge 40, which includes at least one roller 60, 65. When the robot 10 determines that cleaning head cartridge 40 needs servicing (e.g. via the roller full detection system 85 or a timer) the robot 10 initiates a maintenance routine. Step S19-1, illustrated in FIG. 28A, entails the robot 10 approaching the cleaning station 5100 with the aid of navigation system. In one example, the robot 10 navigates to the cleaning station 5100 in response to a received homing signal emitted by the station 5100. In step S19-2, illustrated in FIG. 28B, the robot 10 docks with the station 5100. In the example shown, the robot 10 maneuvers up a ramp 5122 and is secured in place by a locking assembly 5260. In step S19-3, illustrated in FIG. 28C, the dirty cartridge 40A is automatically unloaded from the robot 10, either by the robot 10 or the cleaning station 5100, into a transfer bay 5190 in the cleaning station 5100. In some examples, the dirty cartridge 40A is manually unloaded from the robot 10 and placed in the transfer bay 5190 by a user. In other examples, the dirty cartridge 40A is automatically unloaded from the robot 10, but manually placed in the transfer bay 5190 by the user. In step S19-4, illustrated in FIG. 28D, the cleaning station 5100 exchanges a clean cartridge 40B in a cleaning bay 5192 with the dirty cartridge 40A in the transfer bay 5190. In step S19-5, illustrated in FIG. 28E, the cleaning station 5100 automatically transfers the clean cartridge 40B into the robot 10. In some examples, the user manually transfers the clean cartridge 40B from the transfer bay 5190 into the robot 10. In step S19-6, illustrated in FIG. 28F, the robot 10 exits the station 5100 and may continue a cleaning mission. Meanwhile, the dirty cartridge 40A in the cleaning bay 5192 is cleaned. The maintenance station 5100 includes a roller cleaning assembly 500 for cleanly the roller 100. The automated cleaning process may be slower than by hand, require less power, clean more thoroughly, and perform quietly. The robot 10 continues cleaning rooms while the cleaning station 5100 cleans the dirty cartridge 40A using cleaning tools 510 (instead of a supplementary vacuum), by taking many slow passes.

Other details and features combinable with those described herein may be found in the following U.S. patent applications filed May 21, 2007, entitled "COVERAGE ROBOTS AND ASSOCIATED CLEANING BINS" having assigned Ser. No. 11/751,267; and "REMOVING DEBRIS FROM CLEANING ROBOTS" having assigned Ser. No. 11/751,470. The entire contents of the aforementioned applications are hereby incorporated by reference.

A number of implementations have been described. Nevertheless, it will be understood that various modifications may be made without departing from the spirit and scope of the disclosure. Although reference has been made to cleaning and/or vacuuming robots by way of examples, it is nonetheless understood that any of the features set forth in the above-discussed implementations also apply to any suitable type of robot or mobile machine which employs a rotating brush to sweep dirt or debris. For example, a hand-operated or automated vacuum-cleaner can equivalently employ the filament-removal features described herein, such as a roller having sweeping bristles and inner pliable flaps, the various tools, etc. Accordingly, other implementations are within the scope of the following claims.

What is claimed is:

1. A floor cleaner comprising:

a chassis; and a cleaning assembly carried by the chassis and comprising:

a cleaning assembly housing; and at least one driven brush rotatably coupled to the cleaning assembly housing and comprising:

an elongated core having an outer surface and end mounting features extending beyond respective axial ends of the outer surface of the core and defining a central longitudinal axis of rotation;

a compliant portion extending radially outward from the core to sweep a floor surface as the core is rotated about the central longitudinal axis of rotation; and an axial end guard mountable about one of the end mounting features, the axial end guard configured to prevent spooled filaments from traversing axially beyond the extremity of the mounting feature about which the axial end guard is mounted, wherein the end guard is removable from a longitudinal end of the core.

2. The floor cleaner of claim 1, wherein at least a portion of the axial end guard forms an interference fit with the end mounting feature about which the axial end guard is mounted.

3. The floor cleaner of claim 2, wherein the end guard comprises a flat torus and a mounting ring, the mounting ring extending in a direction away from a surface of the flat torus, and the mounting ring forming an interference fit with the end mounting feature about which the axial end guard is mounted.

4. The floor cleaner of claim 1, wherein the outward radial extension of the brush is greater than the outward radial extension of the axial end guard mounted on the end mounting feature.

5. The floor cleaner of claim 1, wherein the axial end guard defines a through hole through which extends the end mounting feature about which the axial end guard is mounted.

6. The floor cleaner of claim 1, further comprising a bearing circumscribed by the axial end guard, wherein the core is rotatable relative to the bearing.

7. The floor cleaner of claim 1, wherein the compliant portion further comprises multiple floor cleaning bristles extending radially outward from the core.

8. The floor cleaner of claim 7, wherein the bristles are disposed about the core in multiple rows, each row forming a substantially V-shaped groove configuration along the core.

9. The floor cleaner of claim 1, wherein the axial end guard forms a labyrinth seal about the end mounting feature on which the axial end guard is mounted.

10. A floor cleaner comprising:

a chassis;

a cleaning assembly carried by the chassis and comprising:

a cleaning assembly housing; and at least one brush rotatably coupled to the cleaning assembly housing and comprising:

an elongated core having an outer surface and end mounting features extending beyond respective axial ends of the outer surface of the core and defining a central longitudinal axis of rotation, the core rotatable relative to the cleaning assembly housing;

a compliant portion extending radially outward from the core to sweep a floor surface as the core is rotated about the central longitudinal axis of rotation; and an axial end guard mountable in a fixed axial position relative to the core, the axial end guard configured to prevent spooled filaments from traversing axially beyond the extremity of at least one of the end mounting features, wherein the end guard is removable from a longitudinal end of the core.

11. The floor cleaner of claim 10, further comprising an end cap disposed at an axial end of the core, between the core and the mounted axial end guard.

12. The floor cleaner of claim 10, wherein at least a portion of the axial end guard is mountable in an interference fit with one of the end mounting features extending beyond respective axial ends of the outer surface of the core.

13. The floor cleaner of claim 12, wherein the end guard comprises a flat torus and a mounting ring, the mounting ring extending in a direction away from a surface of the flat torus, and the mounting ring forming an interference fit with the end mounting feature about which the axial end guard is mounted.

14. The floor cleaner of claim 10, wherein the axial end guard is mountable to circumscribe one of the end mounting features extending beyond respective axial ends of the outer surface of the core.

15. The floor cleaner of claim 10, wherein the compliant portion further comprises multiple floor cleaning bristles extending radially outward from the core.

* * * * *